US007423594B2

(12) United States Patent
Yanagi et al.

(10) Patent No.: US 7,423,594 B2
(45) Date of Patent: Sep. 9, 2008

(54) ANTENNA APPARATUS

(75) Inventors: Masahiro Yanagi, Shinagawa (JP); Shigemi Kurashima, Shinagawa (JP); Hideki Iwata, Shinagawa (JP); Takashi Arita, Shinagawa (JP); Takashi Yuba, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/402,867

(22) Filed: Apr. 13, 2006

(65) Prior Publication Data

US 2006/0267844 A1 Nov. 30, 2006

(30) Foreign Application Priority Data

May 31, 2005 (JP) ..... 2005-160286
Feb. 8, 2006 (JP) ..... 2006-031242

(51) Int. Cl.
*H01Q 1/38* (2006.01)
*H01Q 1/50* (2006.01)

(52) U.S. Cl. ..... 343/700 MS; 343/850

(58) Field of Classification Search ..... 343/700 MS, 343/702, 846, 850, 853, 795
See application file for complete search history.

(56) References Cited

U.S. PATENT DOCUMENTS 4,079,268 A * 3/1978 Fletcher et al. ..... 307/151
5,617,103 A * 4/1997 Koscica et al. ..... 343/700 MS
6,812,892 B2 * 11/2004 Tai et al. ..... 343/700 MS
6,906,669 B2 * 6/2005 Sabet et al. ..... 343/700 MS
7,102,574 B2 * 9/2006 Otaka et al. ..... 343/700 MS
7,180,449 B2 * 2/2007 Liang et al. ..... 343/700 MS
2005/0030230 A1 * 2/2005 Otaka et al. ..... 343/700 MS
2006/0164316 A1 * 7/2006 Schillmeier et al. ..... 343/795
2006/0214850 A1 * 9/2006 O'Riordan et al. .... 343/700 MS

FOREIGN PATENT DOCUMENTS

JP 2002-198723 7/2002
JP 2004-112397 4/2004
JP 2004-235971 8/2004

OTHER PUBLICATIONS

T. Taniguchi et al., "An Omnidirectional and Low-VSWR Antenna for the FCC-Approved UWB Frequency Band," IEEE AP-S International Symposium, vol. 3, Jun. 2003, pp. 460-463.

* cited by examiner

*Primary Examiner*—Hoang V Nguyen
(74) *Attorney, Agent, or Firm*—Staas & Halsey LLP

(57) ABSTRACT

An antenna apparatus is disclosed. The antenna apparatus includes a dielectric substrate; an antenna element pattern formed on the dielectric substrate; a grounding pattern connected to the element pattern; a feed line formed on the dielectric substrate, and connected to the element pattern; and a filter connected to the feed line.

31 Claims, 50 Drawing Sheets

(A)

(B)

(C)

(A)

(B)

(C)

(A)

(B)

ANTENNA APPARATUS

BACKGROUND OF THE INVENTION

1. Field of the Invention

The present invention generally relates to an antenna apparatus, and especially relates to an antenna apparatus including an element pattern, a strip line for feeding electric power to the element pattern, and a grounding pattern that counters the strip line, the strip line and the grounding pattern being formed by a pattern on a printed wiring board.

2. Description of the Related Art

In recent years and continuing, a radio-communications technology using UWB (ultra-wide band) attracts attention, since communications of radar positioning and a large transmission capacity are possible. The UWB, ranging between 3.1 and 10.6 GHz, has been approved by the US FCC (Federal Communication Commission) since 2002.

Communications using UWB employ a communication system wherein a pulse signal is transmitted in the super-wide band. For this reason, antennas used in the UWB have to be capable of transmitting and receiving with the super-wide band.

As an antenna at least for the 3.1-10.6 GHz frequency band approved by the FCC, an antenna consisting of a grounding plate and a feeder is proposed (Non-Patent Reference 1).

FIG. 1 is a block diagram of an example of a conventional UWB radio system 1.

The conventional radio system 1 consists of an antenna apparatus 11, a filter 12, and a transceiver circuit 13.

FIG. 2A and FIG. 2B are plan views of the conventional antenna apparatus 11. FIG. 2A shows an upper surface view, and FIG. 2B shows a bottom plan view.

The antenna apparatus 11 for transmitting and receiving in the UWB (ultra-wide-band) includes a printed wiring board 21, an element pattern 22, and a micro-strip line 23 for feeding electric power to the element pattern 22 that are formed on the upper surface of the printed wiring board 21. Further, the antenna apparatus 11 includes a grounding pattern 24 formed on the rear side of the printed wiring board 21, countering the micro-strip line 23.

The antenna apparatus 11 obtains a desired property by adjusting an angle θ between the grounding pattern 24 and a side of the element pattern 22, the side countering the grounding pattern 24.

[Non-Patent Reference 1]

"An omnidirectional and low-VSWR antenna for the FCC-approved UWB frequency band" by T. Taniguchi and T. Kobayashi (Tokyo Denki University) in 2003 IEEE AP-S International Symp., volume: 3, pp. 460-463, Jun. 22-27, 2003. (Disclosure on March 22 at B201 classroom).

[Description of the Invention]

[Problem(s) to be Solved by the Invention]

Nevertheless, it is desired that an antenna apparatus of this kind be installed in a personal computer., a portable communication apparatus, etc.; i.e., further miniaturization and thinner shape are desired.

SUMMARY OF THE INVENTION

The present invention provides an antenna apparatus that substantially obviates one or more of the problems caused by the limitations and disadvantages of the related art.

The present invention aims at offering an antenna apparatus that is thin and small providing versatile functions.

Features of the present invention are set forth in the description that follows, and in part will become apparent from the description and the accompanying drawings, or may be learned by practice of the invention according to the teachings provided in the description. Problem solutions provided by the present invention will be realized and attained by an antenna apparatus particularly pointed out in the specification in such full, clear, concise, and exact terms as to enable a person having ordinary skill in the art to practice the invention. To achieve these solutions and in accordance with the purpose of the invention, as embodied and broadly described herein, the invention provides an antenna apparatus as follows.

[Means for Solving the Problem]

The antenna apparatus according to the present invention includes a dielectric substrate, an element pattern formed on the dielectric substrate, a grounding pattern connected to the element pattern, a feeding line connected to the element pattern, and a filter that is inserted into the feeding line.

[Effect of the Invention]

According to the present invention, since the filter is constituted by using the grounding pattern, the filtering function is available without increasing the number of lines, such as a track, to the antenna apparatus. In this way, a filter and the like are dispensed with on the transceiver unit side, and an antenna apparatus that is thin, small, and offers various functions is realized.

DESCRIPTION OF THE PREFERRED EMBODIMENTS

In the following, embodiments of the present invention are described with reference to the accompanying drawings.

The First Embodiment

Figure 1:
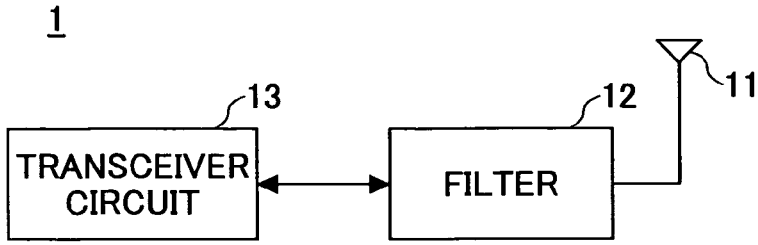
FIG. 1 is a block diagram of an example of a conventional UWB radio system.
Figure 2:
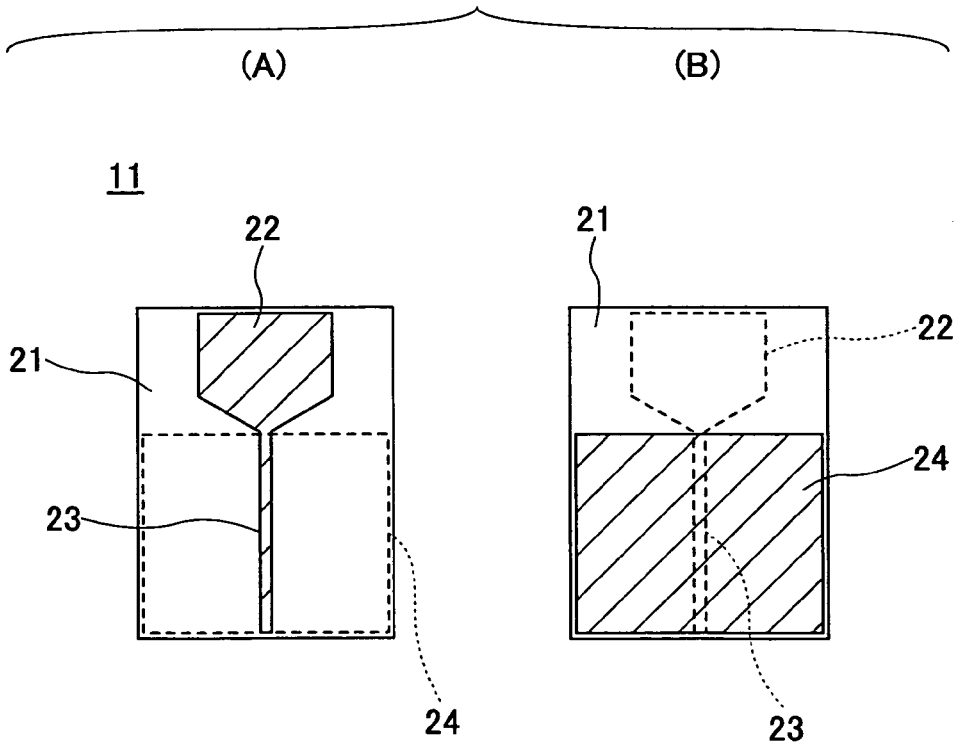
FIG. 2 gives plan views of a conventional antenna apparatus.
Figure 3:
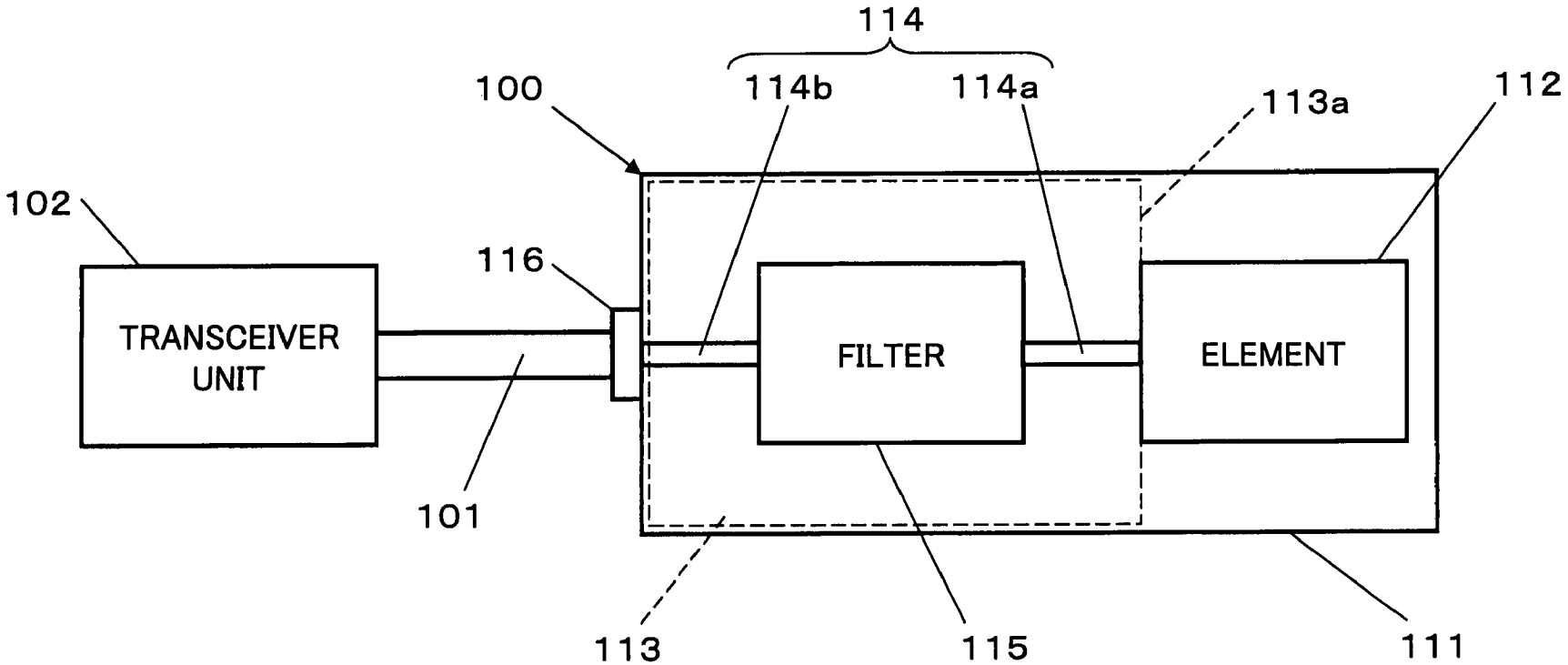
FIG. 3 is a block diagram of an antenna apparatus according to the first embodiment of the present invention.
Figure 4:
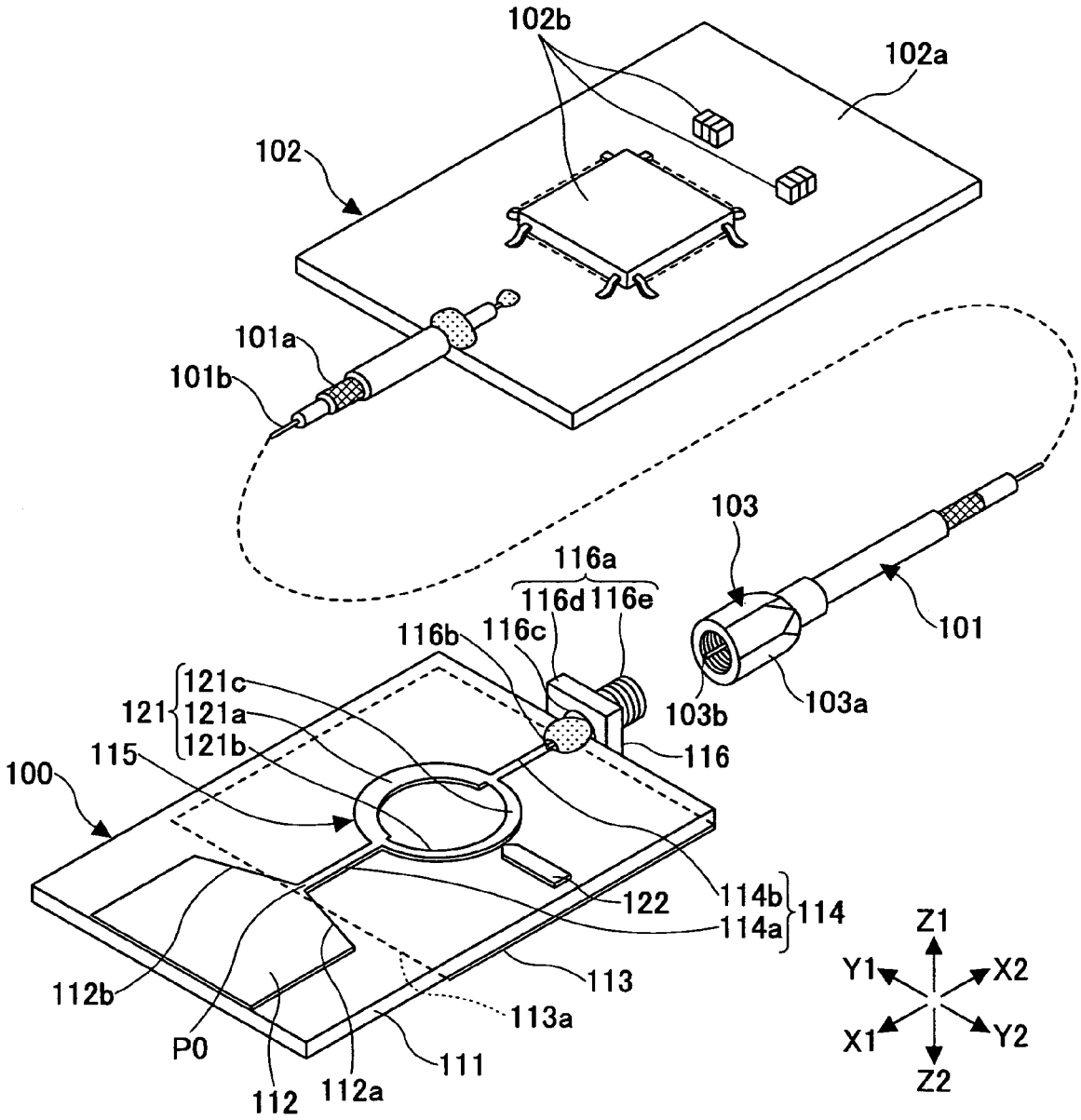
FIG. 4 is a perspective diagram of the antenna apparatus according to the first embodiment of the present invention.
Figure 5:
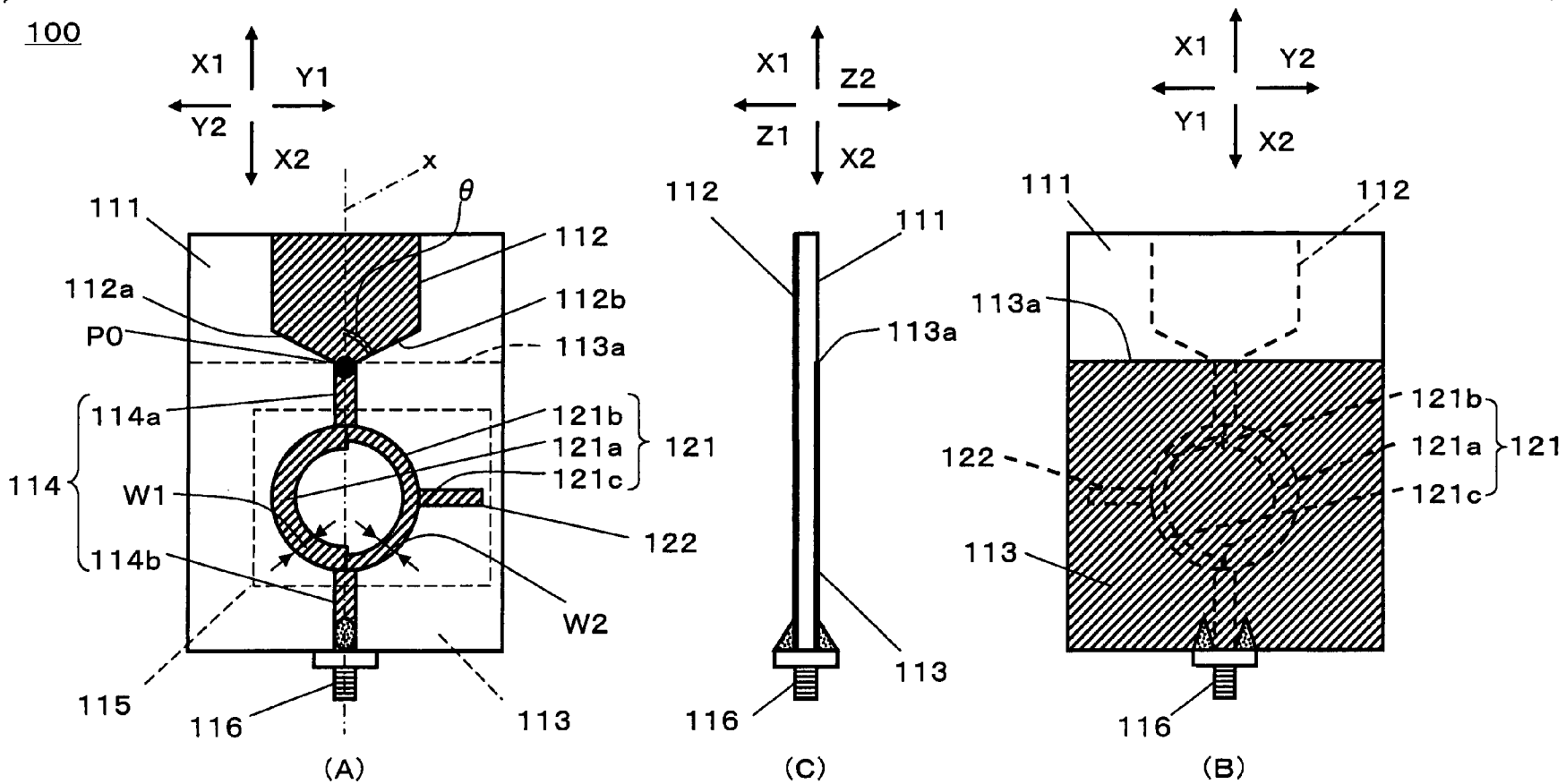
FIG. 5 gives a plan view, a side elevation, and a bottom view of the antenna apparatus according to the first embodiment of the present invention.

FIG. 3 is a block diagram of an antenna apparatus 100 according to the first embodiment of the present invention. FIG. 4 is a perspective diagram of the antenna apparatus 100. FIG. 5 gives a plan view, a side elevation, and a bottom view of the antenna apparatus 100.

The antenna apparatus 100 of the first embodiment is for transmitting and receiving at the UWB frequencies. The antenna apparatus 100 includes a dielectric substrate 111, an element pattern 112, a grounding pattern 113, a strip line 114, a filter 115, and a connector 116.

The dielectric substrate 111 is shaped like a quadrangle, and made of a material such as glass epoxy resin, flexible PET resin, carbon, PI, and LCP (liquid crystal polymer). The element pattern 112 is shaped like a pentagon, is formed on a first surface of the dielectric substrate 111, and is made of an electric conduction material such as copper and aluminum.

The grounding pattern 113 is formed on a second surface, which is opposite to the first surface, of the dielectric substrate 111 adjacent to the element pattern 112 in directions of arrows X1 and X2. The grounding pattern 113 is made of an electric conduction material such as copper and aluminum, the same as the element pattern 112. Sides 112*a* and 112*b* that meet at a peak P0 of the element pattern 112 are formed so that the sides 112*a* and 112*b* form a predetermined angle θ to an axis that perpendicularly intersects a side 113*a* of the grounding pattern 113. In the case of UWB, the angle θ is set to about, for example, 63°.

The strip line 114 is formed on the first surface of the dielectric substrate 111 at a part that counters the grounding pattern 113, and includes a line 114*a* and a line 114*b*. The line 114*a* is extended from the peak P0 of the element pattern 112 in the direction of the arrow X2, one end of the line 114*a* being connected to the peak P0. The other end of the line 114*a* is connected to an end of a filter 115.

Further, as for the line 114*b*, one end is connected to the other end of the filter 115, and the other end of the line 114*b* is connected to a signal line through a connector 116.

The filter 115 is, for example, a ring filter with a stub, having a band elimination property at a center frequency f0 of a wavelength λ. The filter 115 is arranged between the end of the line 114*a* and the end of the line 114*b*, countering the grounding pattern 113. The filter 115 and the grounding pattern 113 that counters the filter 115 through the dielectric substrate 111 form a constant distribution circuit, and provide the desired filtering function.

The filter 115 includes a ring section 121 and an open stub section 122. The ring section 121 includes a λ/2 path section 121*a*, a first λ/4 path section 121*b*, and a second λ/4 path section 121*c*. Here, λ represents the wavelength of center frequency f0.

The λ/2 path section 121*a* is formed in the shape of a semicircle, an end of which is connected to the end of the line 114*a*, and the other end of which is connected to the end of the line 114*b*. The length of the λ/2 path sections 121*a* is set at λ/2. Here, λ represents the wavelength corresponding to the center frequency of the band elimination property. Further, a line width w1 of the λ/2 path section 121*a* is formed greater than a line width w2 of the first λ/4 path section 121*b* and the second λ/4 path section 121*c*.

An end of the first λ/4 path section 121*b* is connected to the end of the line 114*a*, and the other end of the first λ/4 path section 121*b* is connected to an end of the second λ/4 path section 121*c*. The length of the first λ/4 path section 121*b* is set at λ/4.

An end of the second λ/4 path section 121*c* is connected to the other end of the first λ/4 path section 121*b*, and the other end of the second λ/4 path section 121*c* is connected to the end of line 114*b*. The length of the second λ/4 path section 121*c* is set at λ/4.

The first λ/4 path section 121*b*, and the second λ/4 path section 121*c* constitute a semi-circle that is symmetrical to the λ/2 path section 121*a* centering on an axis x in the directions of X1 and X2.

The open stub section 122 extends from a node of the first λ/4 path section 121*b* and the second λ/4 path section 121*c* for a length of λ/4 in the direction of an arrow Y2, with the other end being open.

By structuring as described above, the band elimination property at the center frequency f0 of the wavelength λ is acquired.

The other end of the line 114*b* is connected to the connector 116 at an edge section on the side in the arrow X2 direction of the dielectric substrate 111.

The connector 116 is an edge mounting type socket connector, and includes a shield section 116*a*, a signal-line connector section 116*b*, and an insulated section 116*c* (refer to FIG. 4). The shield section 116*a* includes an attachment section 116*d*, and a connection section 116*e*. The attachment section 116*d* and the connection section 116*e* are fabricated in one body.

The attachment section 116*d* is arranged so that it may perpendicularly intersect the dielectric substrate 111, and is soldered to the grounding pattern 113 such that the connector 116 is fixed to the dielectric substrate 111. The connector section 116*e* is shaped like a cylinder that penetrates the attachment section 116*d* in the directions of the arrows X1 and X2, and extends in the arrow X2 direction from the attachment section 116*d*. A screw thread is formed in the circumferential part of the connector section 116*e*.

A plug connector 130 receives the connector section 116*e*. The signal-line connection section 116*b* is supported at a through hole of the attachment section 116*d* through the insulated section 116*c*. When the plug connector 103 engages the attachment section 116*d*, a signal pin 103*b* of the plug connector 103 engages signal-line connection section 116*b*. The insulated section 116*c* is made of one of resin and ceramics, and intervenes between the shield section 116*a* and the signal-line connector section 116*b*. Further, the insulated section 116*c* supports the signal-line connection section 116*b*, and insulates the shield section 116*a* from the signal-line connection section 116*b*.

The signal-line connection section 116*b* is soldered to the end of the line 114*b* on the first surface of the dielectric substrate 111. Further, the attachment section 116*d* is soldered to the grounding pattern 113 provided on the second surface of the dielectric substrate 111.

The plug connector 103 includes a shield section 103*a* and the signal pin 103*b* that is connected to an end of a coaxial cable 101. The shield section 103*a* is shaped like a cylinder, and is connected to a shield 101*a* of the coaxial cable 101. An internal screw thread is formed on the inner circumferential side of the shield section 103*a*. The internal screw thread is screwed onto the screw thread formed in the perimeter of the connector section 116*e* of the socket connector 116.

The shield section 103*a* is insulated from the signal pin 103*b* and is connected to the signal-line 101*b* of the coaxial cable 101. When the plug connector 103 is connected to the socket connector 116, the signal pin 103*a* is inserted in the signal-line connection section 116*b* of the socket connector 116.

The other ends of the shield section 101*a* and the signal-line 101*b* of the coaxial cable 101 are connected to the transceiver unit 102. The transceiver unit 102 includes various electronic parts 102*b* provided on a printed wiring board 102*a*, and is a unit for performing communications by UWB using the antenna apparatus 100.

Figure 6:
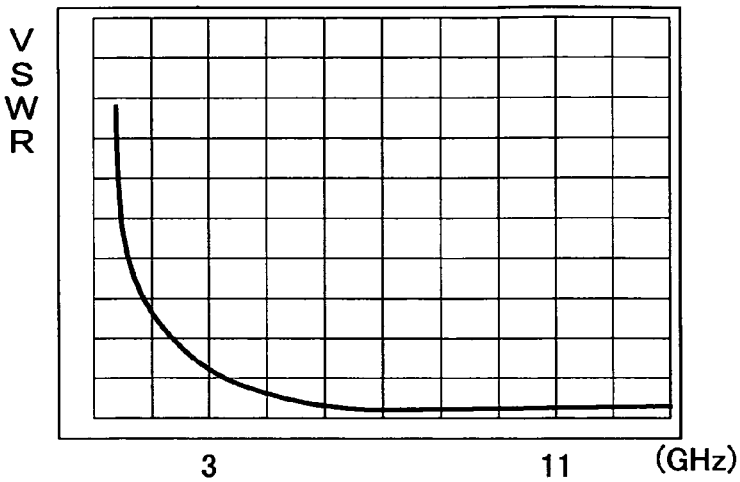
FIG. 6 gives graphs showing properties of the antenna apparatus according to the first embodiment of the present invention of operation.
Figure 6:
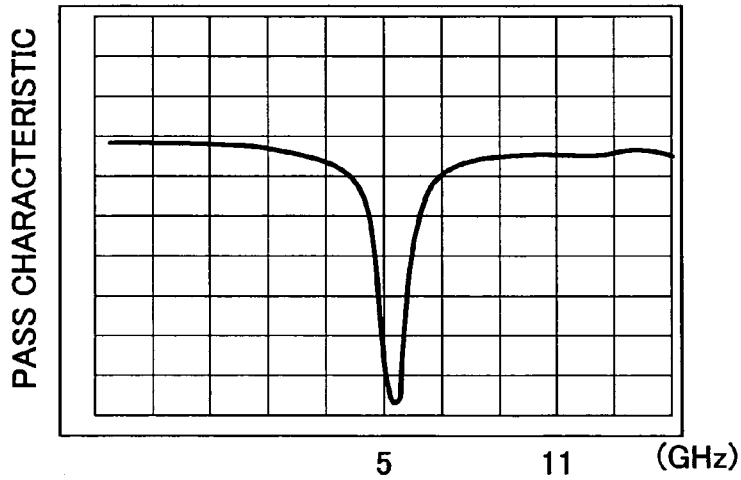
Figure 6:
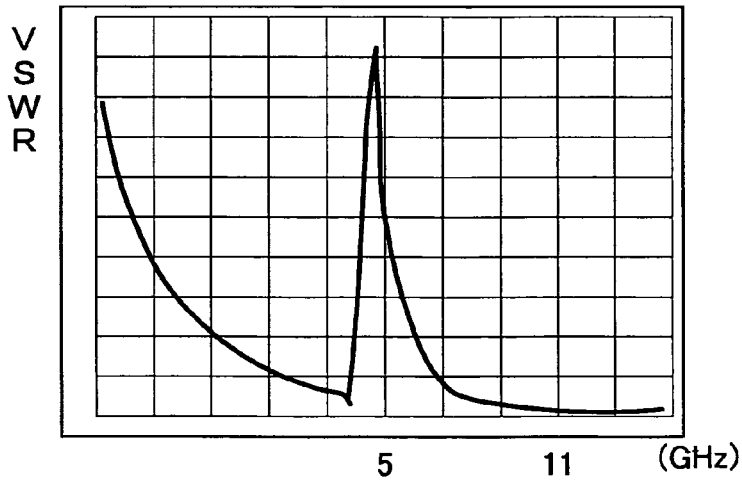

FIG. 6 gives graphs showing operational properties of the antenna apparatus 100 according to the first embodiment of the present invention. The first graph (indicated by (A)) shows a VSWR property of the element pattern 112, the second graph (indicated by (B)) shows a frequency characteristic of the filter 115, and the third graph (indicated by (C)) shows a VSWR property of the antenna apparatus 100.

The VSWR property of the antenna apparatus 100 is a sum of the VSWR property of the element pattern 112 and the frequency characteristic of the filter 115.

Accordingly, a desired bandwidth can be cut (signal prevented from passing); for example, a communication system using UWB can have a frequency characteristic of the filter 115 that cuts the 5.2 GHz frequency band, which band is in use by an existing wireless LAN. In this way, adverse influence from/to existing radio communications systems can be eliminated with the antenna apparatus 100.

[Effect]

According to the present embodiment, the grounding pattern is shared with the antenna element pattern 112 and the filter 115 by forming the grounding pattern, which is indispensable to the flat antenna apparatus for UWB, such that the filter is formed by the constant distribution circuit provided countering the ground pattern. In this way, a thin, small, and multi-functional antenna apparatus is realized.

The Second Embodiment

Figure 7:
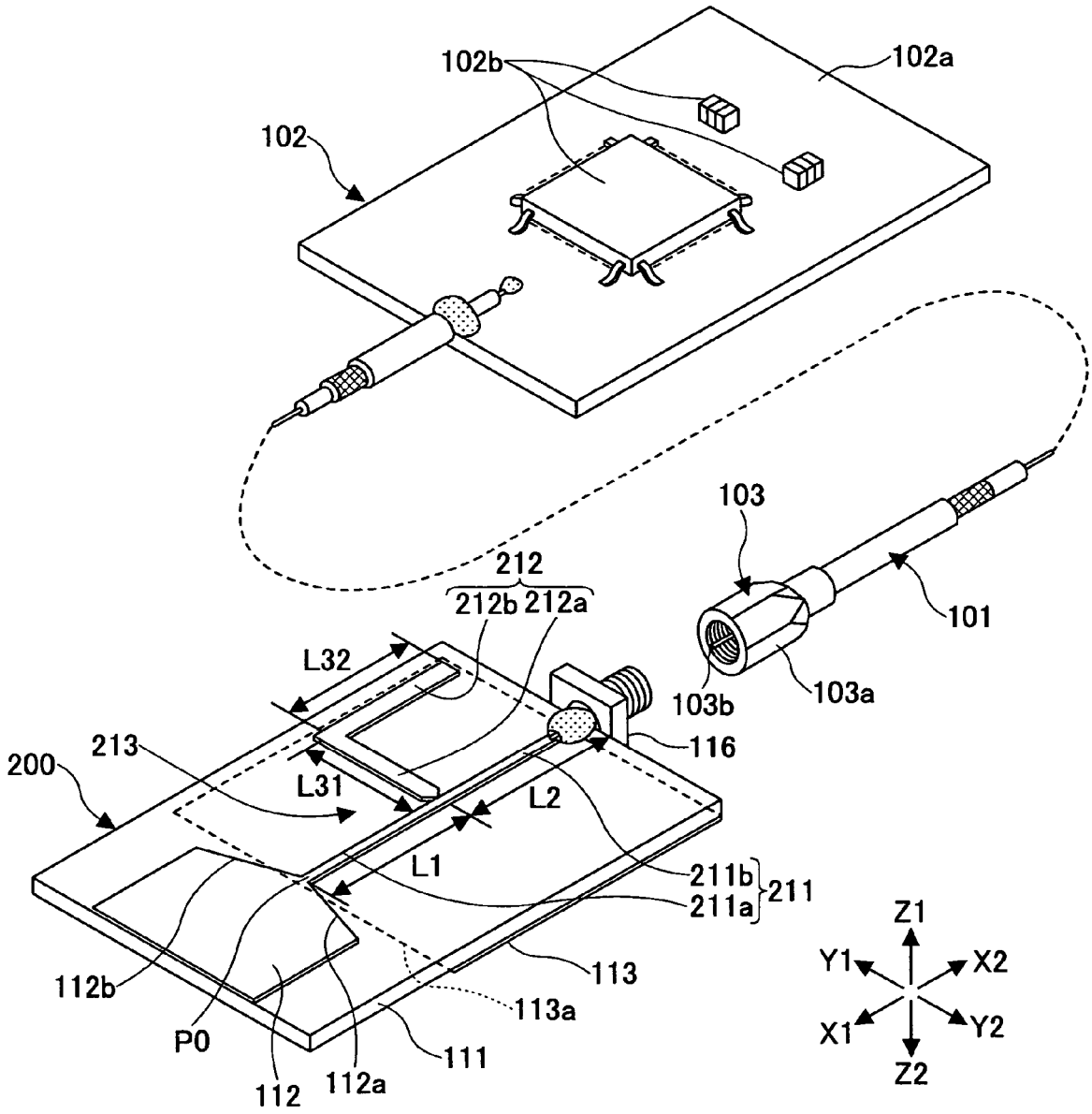
FIG. 7 is a perspective diagram of the antenna apparatus according to the second embodiment of the present invention.
Figure 8:
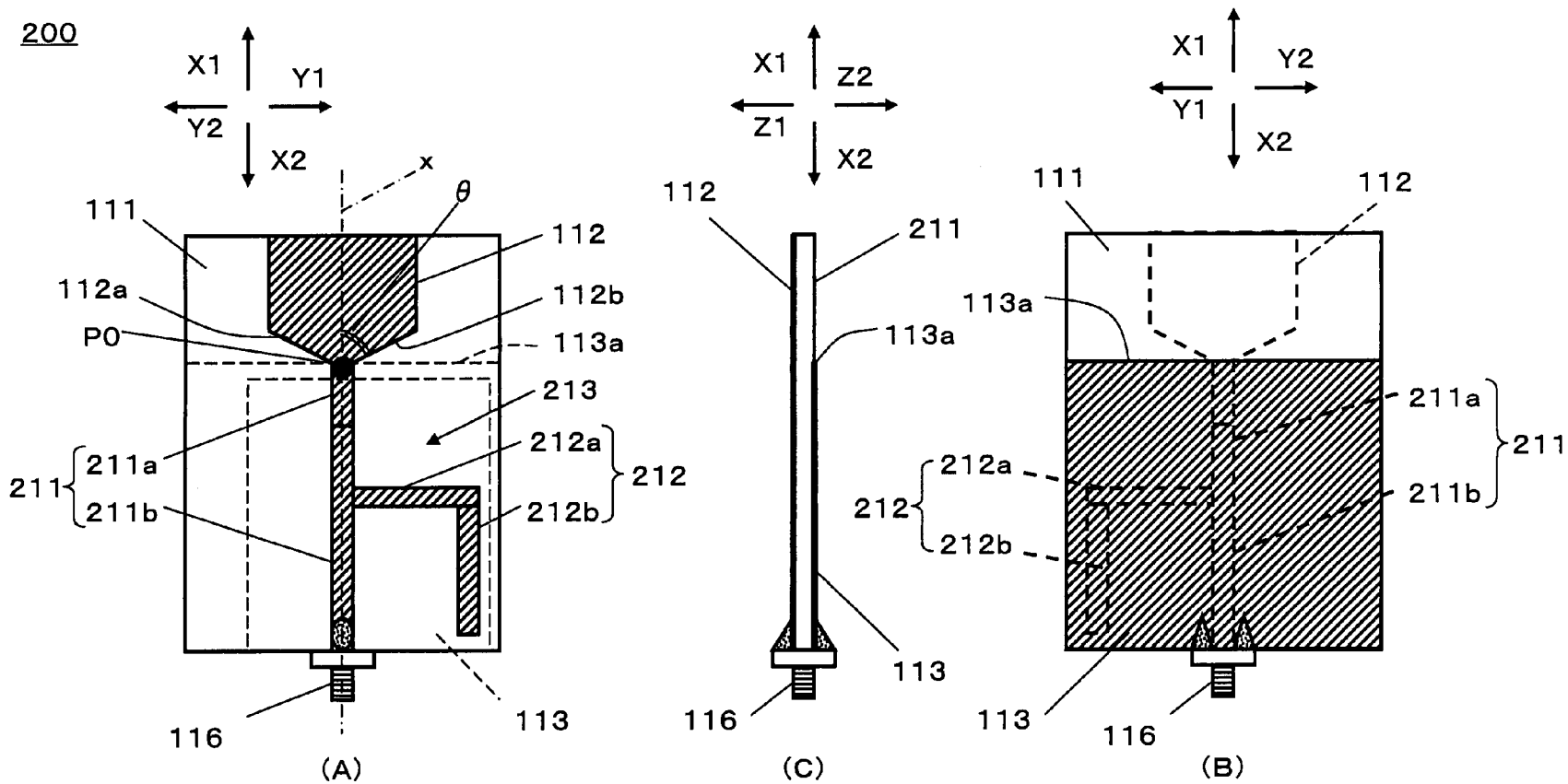
FIG. 8 gives a plan view, a side elevation, and a bottom view of the antenna apparatus according to the second embodiment of the present invention.

FIG. 7 is a perspective diagram of an antenna apparatus 200 according to the second embodiment of the present invention, and FIG. 8 gives a plan view, a side elevation, and a bottom view of the antenna apparatus according to the antenna apparatus 200. In FIG. 7 and FIG. 8, the same reference marks are given to the same components as FIG. 3 and FIG. 4, and the explanations thereof are not repeated.

The antenna apparatus 200 includes a filter 213 that is constituted by a strip line 211 and a stub 212, wherein the stub 212 is provided near the strip line 211 that connects the element pattern 112 and the connector 116.

The strip line 211 consists of a line 211*a* and a line 211*b*, and is arranged in the direction of the arrow X2. The length L1 of the line 211*a* is λ/4. One end of the line 211*a* is connected to the peak P0 of the element pattern 112, and other end is connected to an end of the line 211*b*. The length L2 of the line 211*b* is λ/4. One end of the line 211*b* is connected to the other end of the line 211*a*, and the other end is connected to the signal-line connection section 116*b* of the connector 116.

The stub 212 consists of a line 212*a* and a line 212*b*. One end of the line 212*a* is connected to a node of the line 211*a* and line 211*b* of the strip line 211, and is extended in the direction of the arrow Y1, which is a direction perpendicular to the strip line 211. The line 212*b* is connected to the other end of the line 212*a*, and is extended in the direction of the arrow X2, departing from the element pattern 112, the direction being parallel to the strip line 211. The length L31 of the line 212*a* and the length L32 of the line 212*b* are made such that the sum of the lengths L31 and L32, which represents the length of the stub 212, becomes λ/2.

By bending the stub 212 as described above, the amount of extension of the stub 212 in the direction of the arrow Y1 can be made small, and the width in the directions of the arrows Y1 and Y2 of the dielectric substrate 111 is made small.

Figure 9:
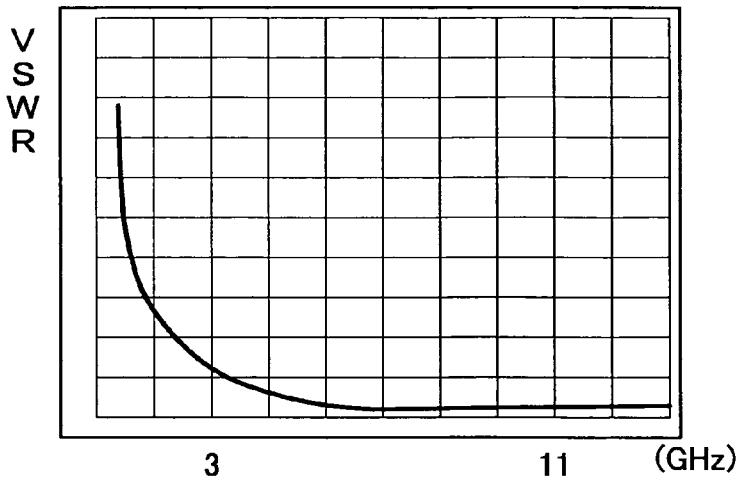
FIG. 9 gives graphs showing properties of the antenna apparatus according to the second embodiment of the present invention.
Figure 9:
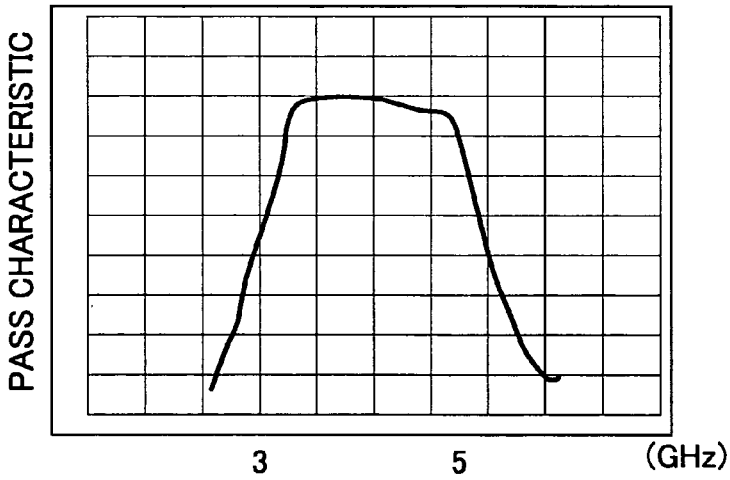
Figure 9:
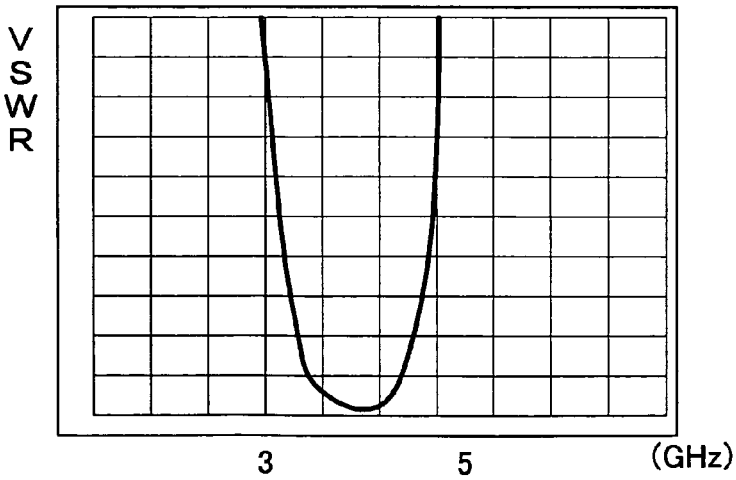

FIG. 9 gives graphs showing the operational properties of the antenna apparatus 200 of the second embodiment. The first graph shows a VSWR property of the element pattern 112. The second graph shows a frequency characteristic of the filter 213. The third graph shows a VSWR property of the antenna apparatus 200.

The VSWR property of the antenna apparatus 200 is obtained by adding the VSWR property of the element pattern 112 and the frequency characteristic of the filter 213.

Accordingly, a desired bandwidth can be cut (signal is prevented from passing); for example, a UWB communication system can have a filter 213 frequency characteristic that cuts the 4.2 GHz frequency band being used by an existing wireless LAN. In this way, adverse influence from/to existing radio communications systems can be eliminated with the antenna apparatus 200.

[Effect]

According to the present embodiment, the grounding pattern is shared with the antenna element pattern 112 and the filter 213 by forming the grounding pattern, which is indispensable with the flat antenna apparatus for UWB, such that the filter is formed by the constant distribution circuit provided countering the ground pattern. In this way, a thin, small, and multi-functional antenna apparatus is realized, similar to the first embodiment.

The Third Embodiment

Figure 10:
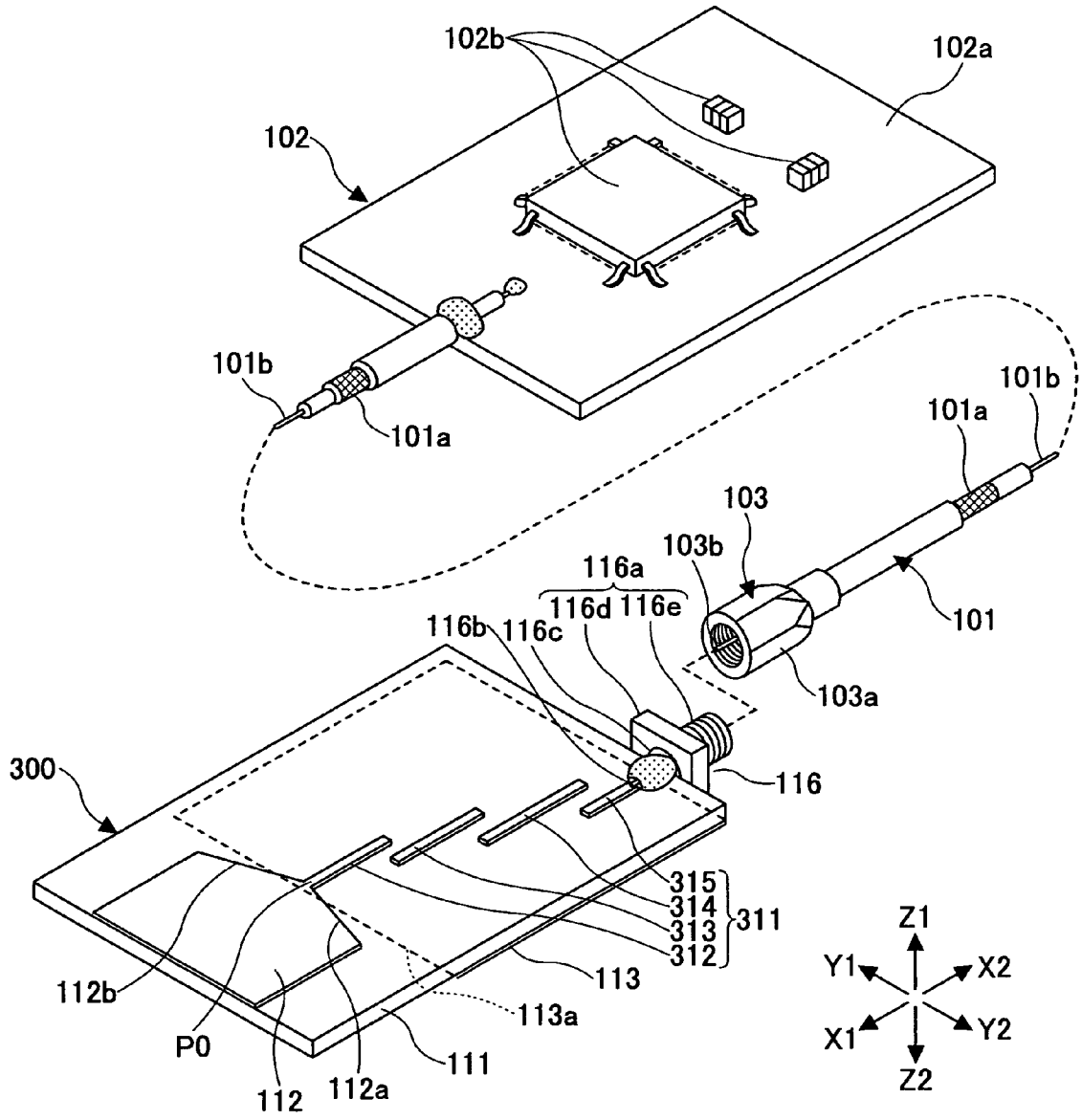
FIG. 10 is a perspective diagram of the antenna apparatus according to the third embodiment of the present invention.
Figure 11:
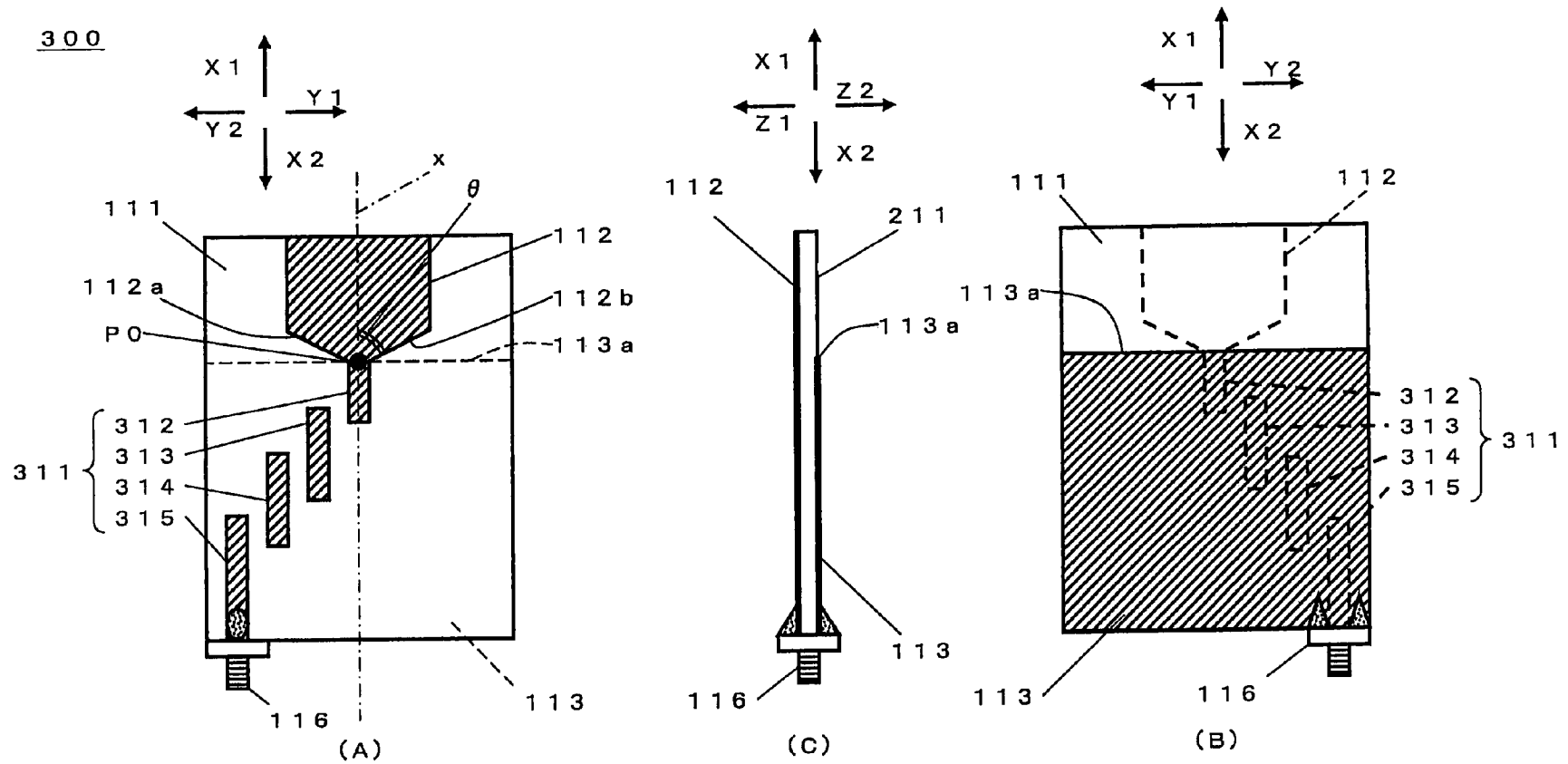
FIG. 11 gives a plan view, a side elevation, and a bottom view of the antenna apparatus according to the third embodiment of the present invention.

FIG. 10 is a perspective diagram of an antenna apparatus 300 according to the third embodiment of the present invention, and FIG. 11 gives a plan view, a side elevation, and a bottom view of the antenna apparatus according to the antenna apparatus 300. In FIG. 10 and FIG. 11, the same reference marks are given to the same components as FIG. 4 and FIG. 5, and the explanations thereof are not repeated.

The antenna apparatus 300 includes a filter 311 that differs from the first and the second embodiments. The filter 311 of the present embodiment is constituted by a so-called edge coupled filter. The filter 311 includes strip lines 312, 313, 314, and 315. The degree of coupling between the strip lines (i.e., between the strip line 312 and the strip line 313; between the strip line 313 and the strip line 314; and between the strip line 314 and the strip line 315 in this example) is adjusted by controlling a distance, an amount of overlap, etc., such that a desired frequency characteristic is obtained.

The Fourth Embodiment

Figure 12:
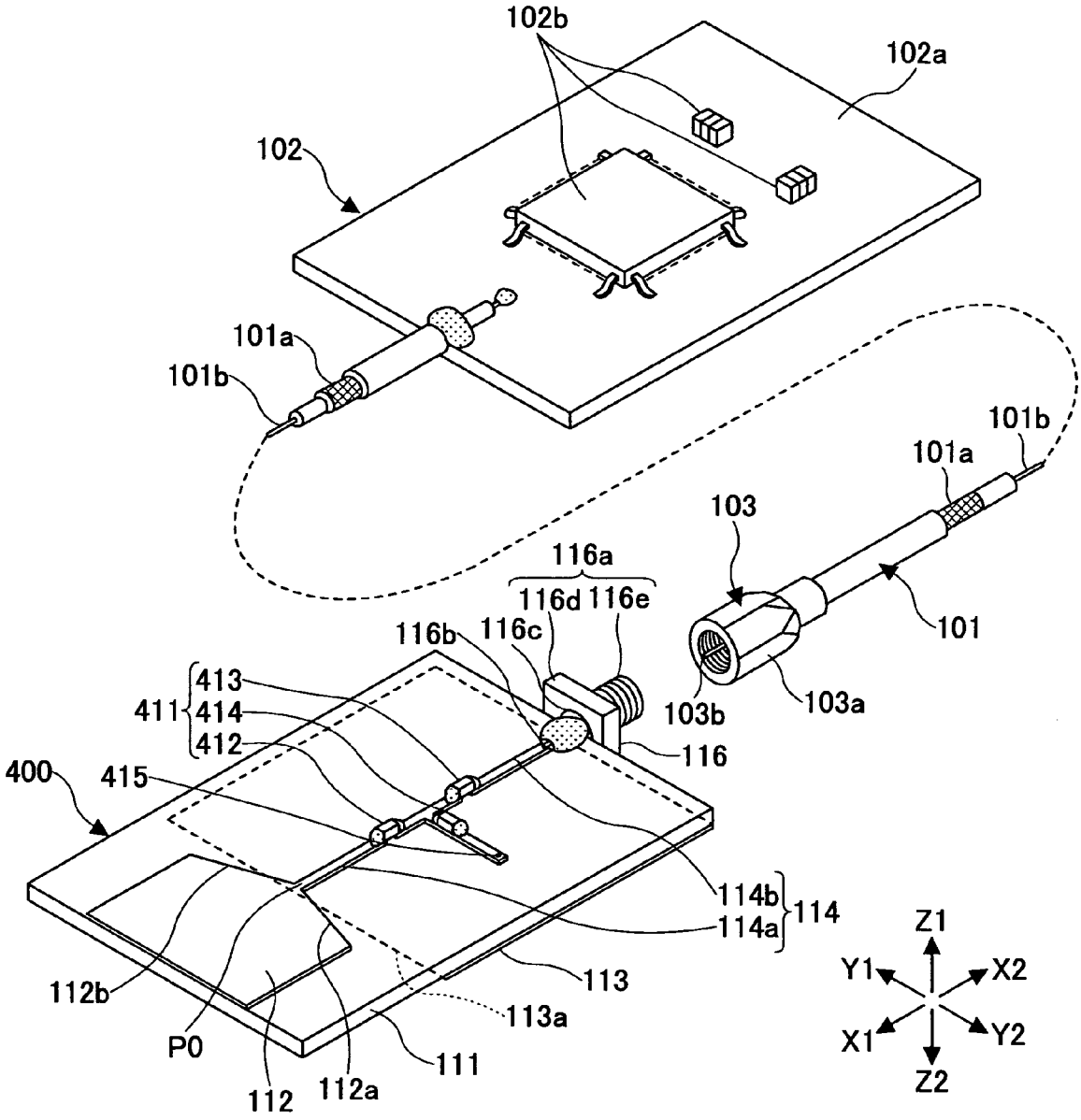
FIG. 12 is a perspective diagram of the antenna apparatus according to the fourth embodiment of the present invention.
Figure 13:
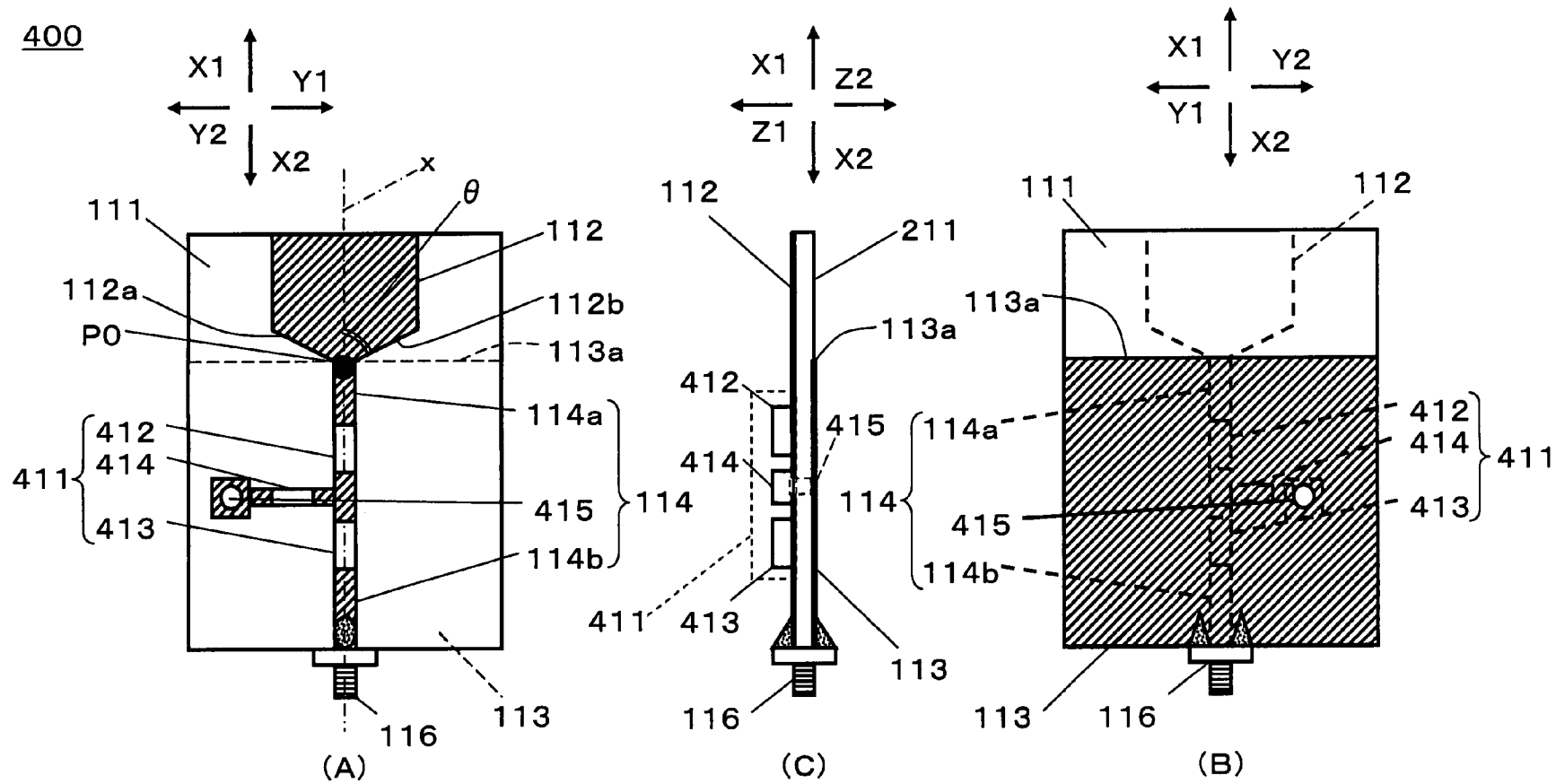
FIG. 13 gives a plan view, a side elevation, and a bottom view of the antenna apparatus according to the fourth embodiment of the present invention.

FIG. 12 is a perspective diagram of an antenna apparatus 400 according to the fourth embodiment of the present invention, and FIG. 13 gives a plan view, a side elevation, and a bottom view of the antenna apparatus according to the antenna apparatus 400. In FIG. 12 and FIG. 13, the same reference marks are given to the same components as FIG. 4 and FIG. 5, and the explanations thereof are not repeated.

The antenna apparatus 400 includes a filter 411 that differs from the filters of the first through third embodiments. The filter 411 of the present embodiment includes chip parts 412, 413, and 414 on the strip line 114.

An end of the chip part 412 is connected to the other end of the line 114*a* of the strip line 114, and the other end is connected to an end of the chip part 413 and an end of the chip part 414. As for the chip part 413, the other end is connected to an end of the line 114*b* of the strip line 114. The other end of the chip part 414 is connected to the grounding pattern 113 formed on the opposite surface via a through hole 415.

Figure 14A:
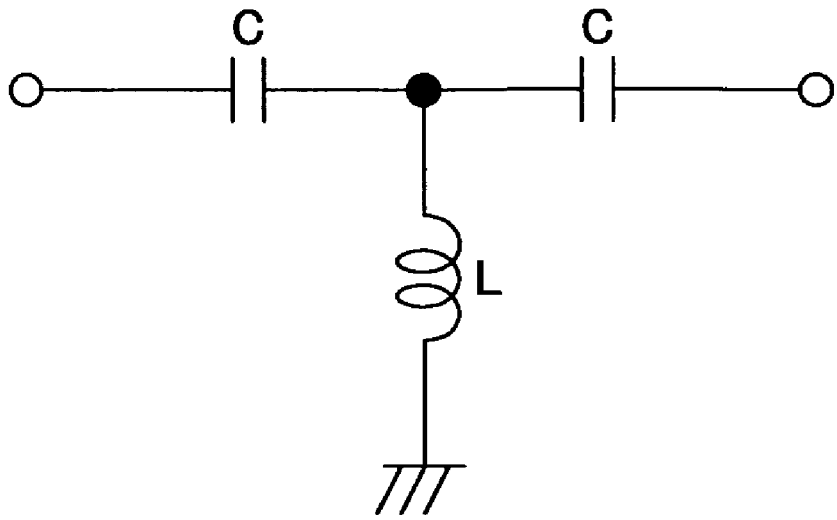
FIG. 14A and FIG. 14B are circuit diagrams showing equivalent circuits of a filter 411.
Figure 14B:
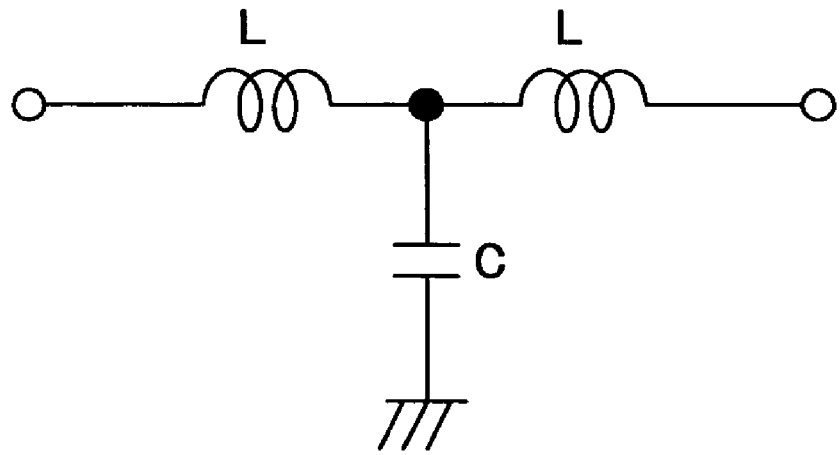

FIG. 14A and FIG. 14B are circuit diagrams showing equivalent circuits of the filter 411.

Here, if the chip parts 412 and 413 are capacitors C and the chip part 414 is an inductor L, a high-pass filter, of which equivalent circuit is as shown in FIG. 14A, is formed on the strip line 114. If, otherwise, the chip parts 412 and 413 are inductors L and the chip part 414 is a capacitor C, a low-pass filter, of which equivalent circuit is as shown in FIG. 14B, is formed on the strip line 114.

The Fifth Embodiment

Figure 15:
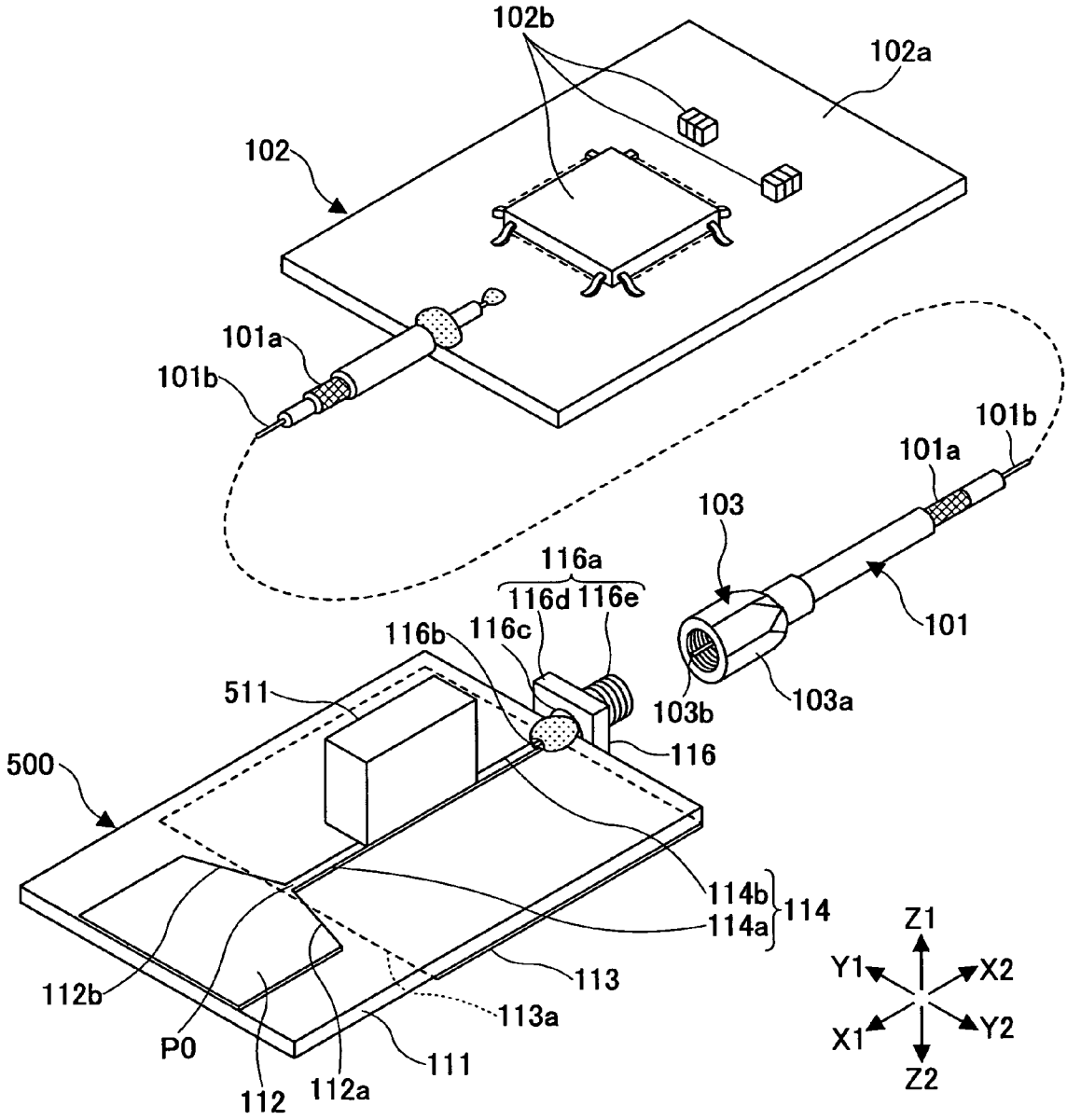
FIG. 15 is a perspective diagram of the antenna apparatus according to the fifth embodiment of the present invention.

FIG. 15 is a perspective diagram of an antenna apparatus 500 according to the fifth embodiment of the present invention. In FIG. 15, the same reference marks are given to the same components as FIG. 4 and FIG. 5, and the explanations thereof are not repeated.

The antenna apparatus 500 includes a filter 511 that is different from the filters of the first through the fourth embodiments.

Figure 16A:
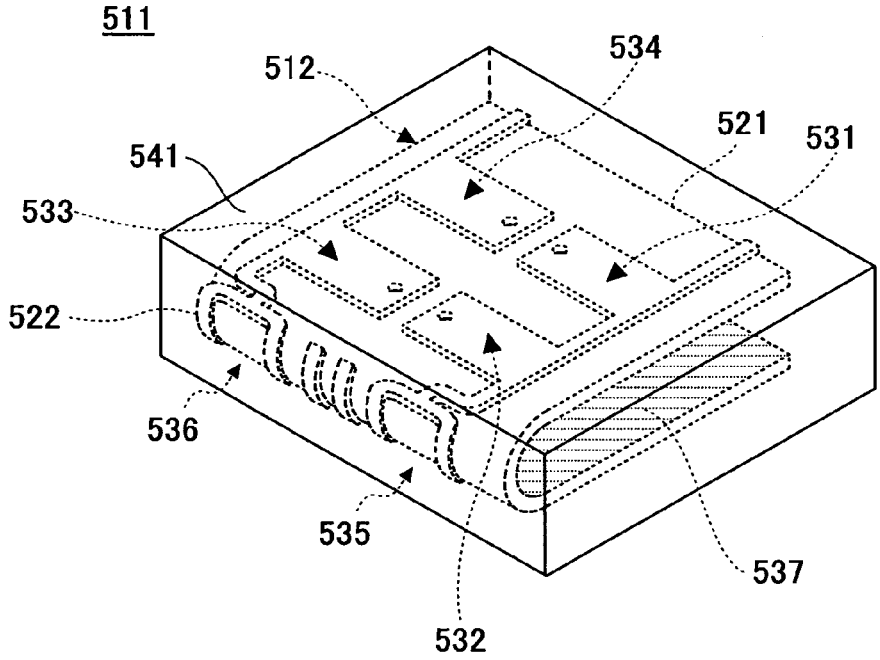
FIG. 16A and FIG. 16B are perspective diagrams of a filter 511.
Figure 16B:
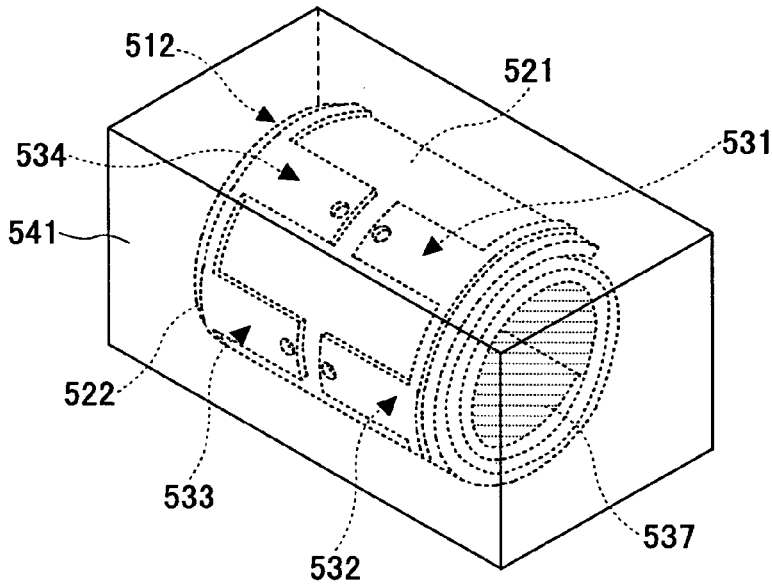
Figure 17:
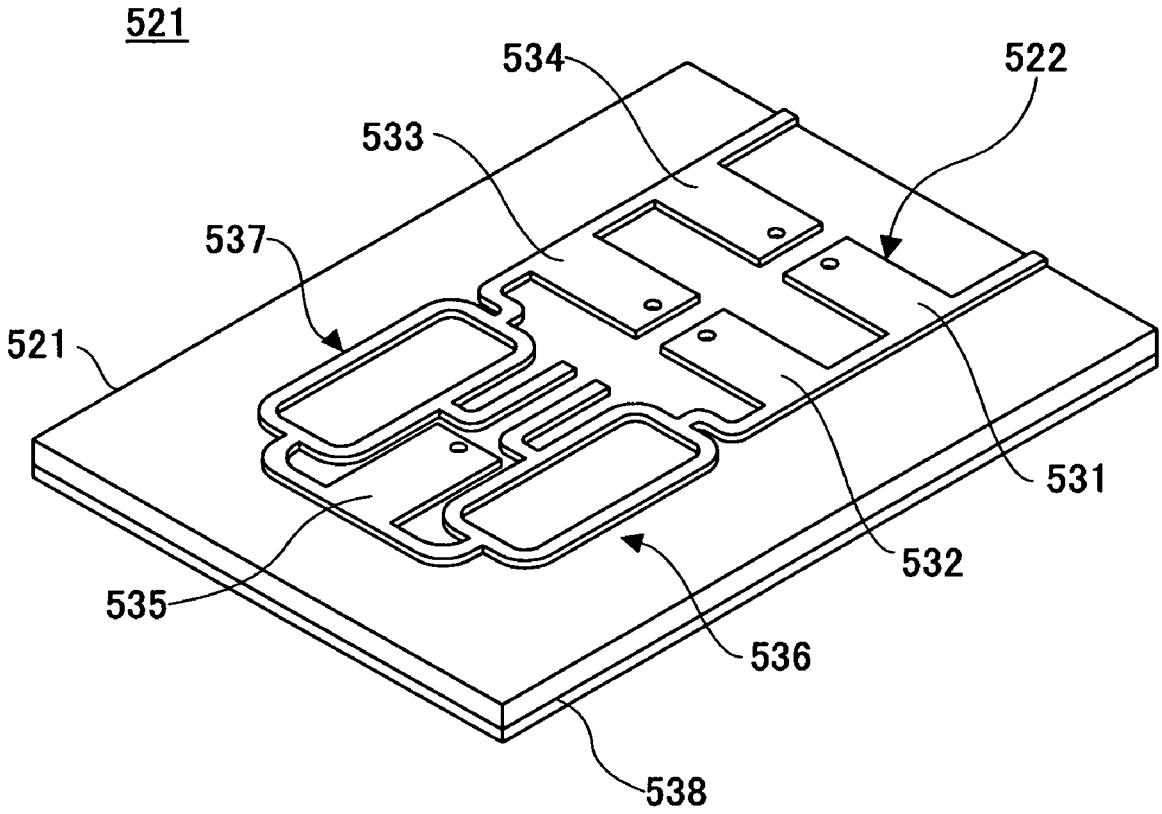
FIG. 17 is a perspective diagram of a flexible printed wiring board 521.

FIG. 16A and FIG. 16B are perspective diagrams of the filter 511. FIG. 17 is a perspective diagram of a flexible printed wiring board 521.

The filter 511 includes the flexible printed wiring board 521. On a surface of the flexible printed wiring board 521, short stubs 531 through 535, a first ring filter 536 with an open stub, and a second ring filter 537 with an open stub are formed by an electric conduction pattern 522. On the other surface of the flexible printed wiring board 521, a grounding pattern 538 is formed all over the other surface. The flexible printed wiring board 521 with the components as described above is bent as shown in FIG. 16A, or is rolled as shown in FIG. 16B. Resin 541 is supplied such that the filter 511 is enclosed and made into a unit structure.

According to the present embodiment, a band-pass property with a sharp attenuation at a desired frequency can be acquired.

The Sixth Embodiment

Figure 18:
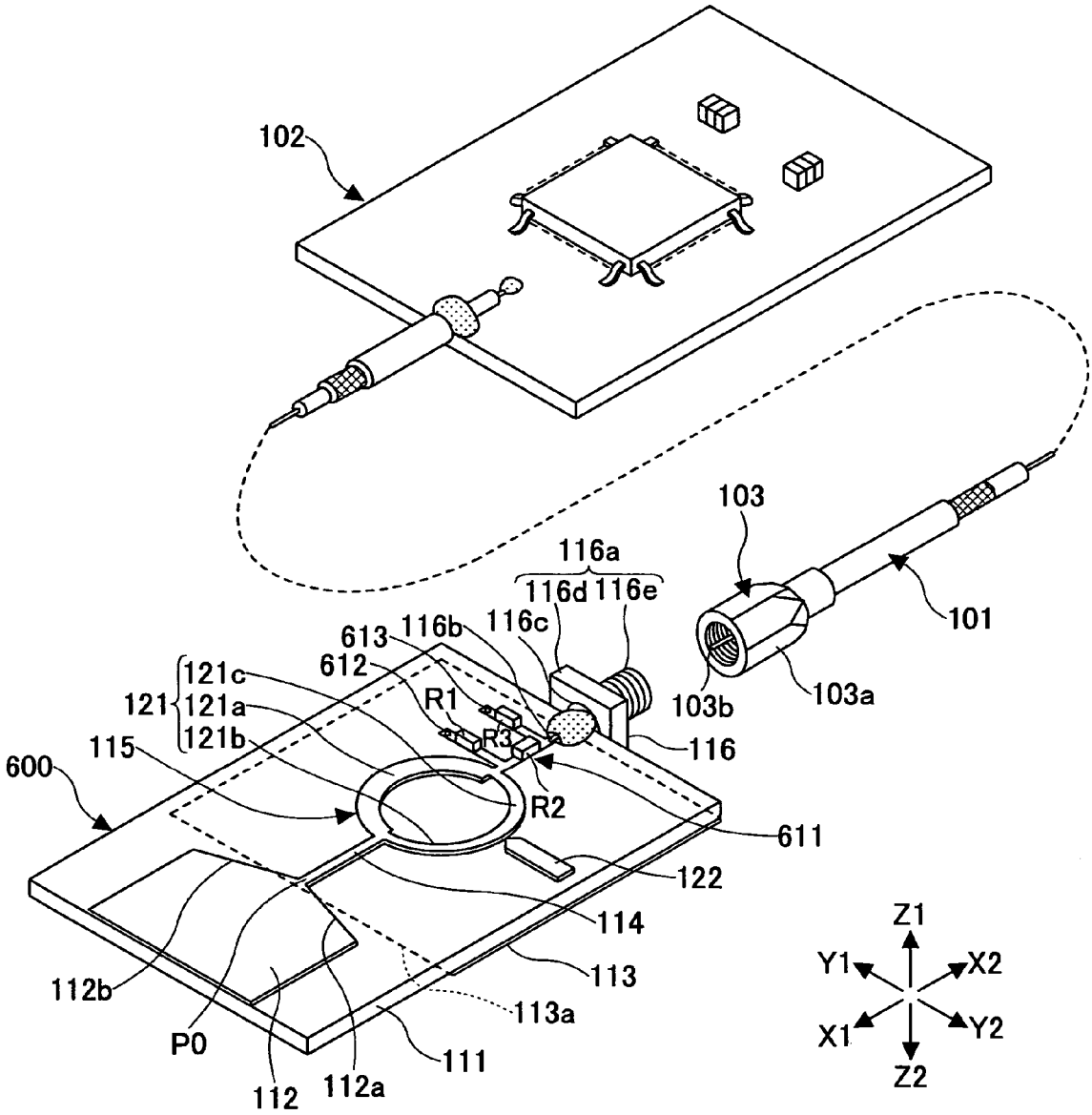
FIG. 18 is a perspective diagram of the antenna apparatus according to the sixth embodiment of the present invention.
Figure 19:
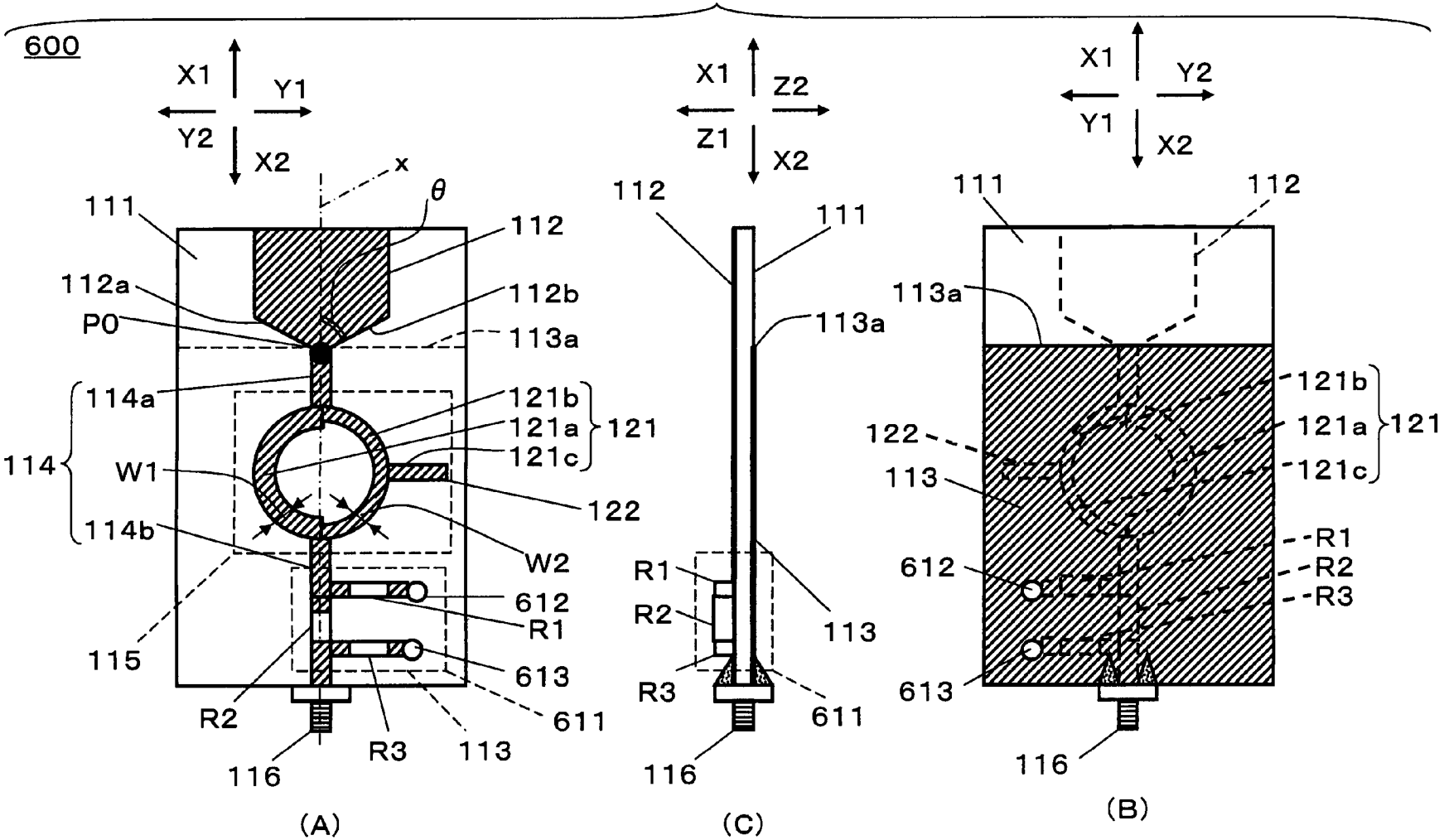
FIG. 19 gives a plan view, a side elevation, and a bottom view of the antenna apparatus according to the sixth embodiment of the present invention.

FIG. 18 is a perspective diagram of an antenna apparatus 600 according to the sixth embodiment of the present invention. FIG. 19 gives a plan view, a side elevation, and a bottom view of the antenna apparatus according to the antenna apparatus 600. In FIG. 18 and FIG. 19, the same reference marks are given to the same components as FIG. 4 and FIG. 5, and the explanations thereof are not repeated.

The antenna apparatus 600 includes an attenuator 611 on the strip line 114, which is different from the first through the fourth embodiments.

The attenuator 611 is formed between the filter 115 and the connector 116.

Figure 20:
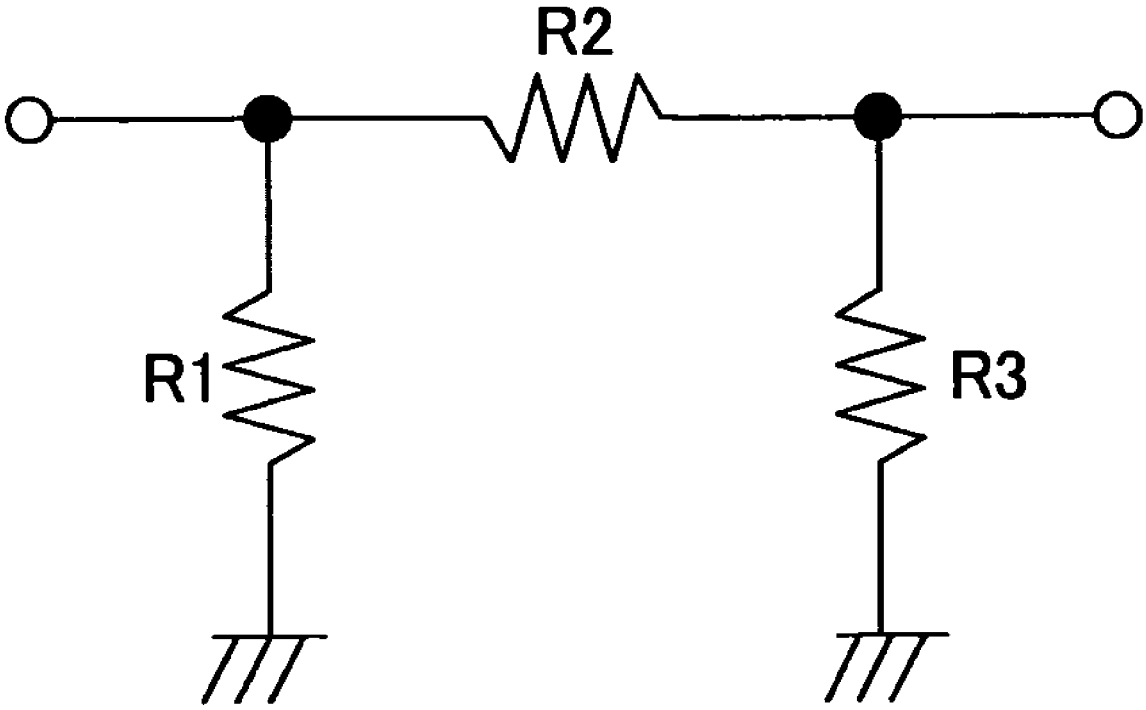
FIG. 20 is a circuit diagram showing an equivalent circuit of an attenuator 611.

FIG. 20 is a circuit diagram showing an equivalent circuit of the attenuator 611.

The attenuator 611 includes resistors R1, R2, and R3. An end of the resistor R1 is connected to the filter 115, and the other end is connected to the grounding pattern 113 via a through hole 612. An end of the resistor R2 is connected to the filter 115, and the other end is connected to the signal-line connection section 116*b* of the connector 116. One end of the resistor R3 is connected to the signal-line connection section 116*b* of the connector 116, and the other end is connected to the grounding pattern 113 via a through hole 613. The resistance values of the resistors R1, R2, and R3 are beforehand set so that the signal provided to the transceiver unit 102 may become optimal.

According to the present embodiment, since the attenuator 611 is provided on the antenna apparatus 600 side, the structure of the transceiver unit 102 can be simplified. Here, in a case where the electric wave intensity is small, a low noise amplifier (LNA) may be provided instead of the attenuator 611.

The Seventh Embodiment

Figure 21:
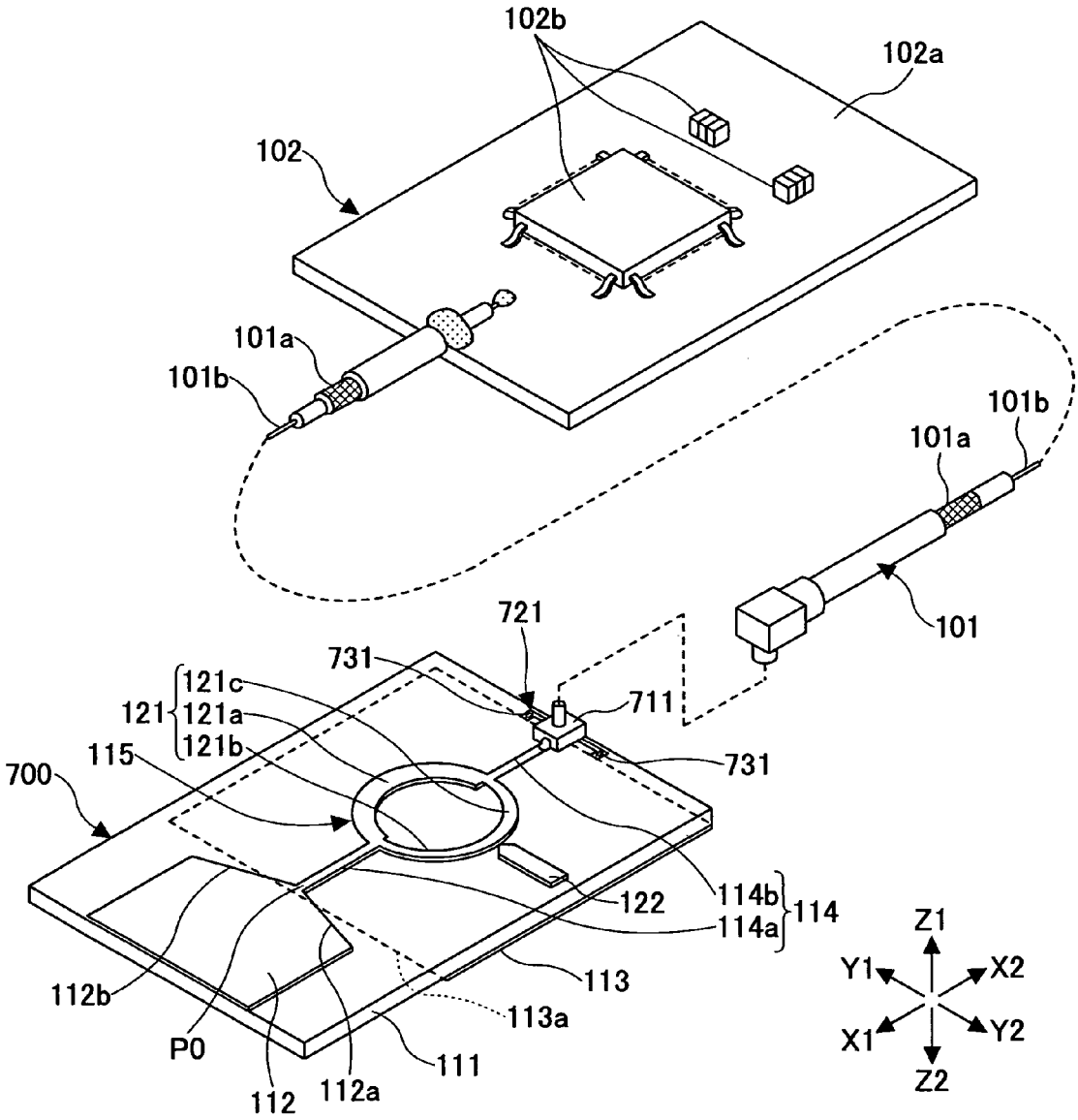
FIG. 21 is a perspective diagram of the antenna apparatus according to the seventh embodiment of the present invention.
Figure 22:
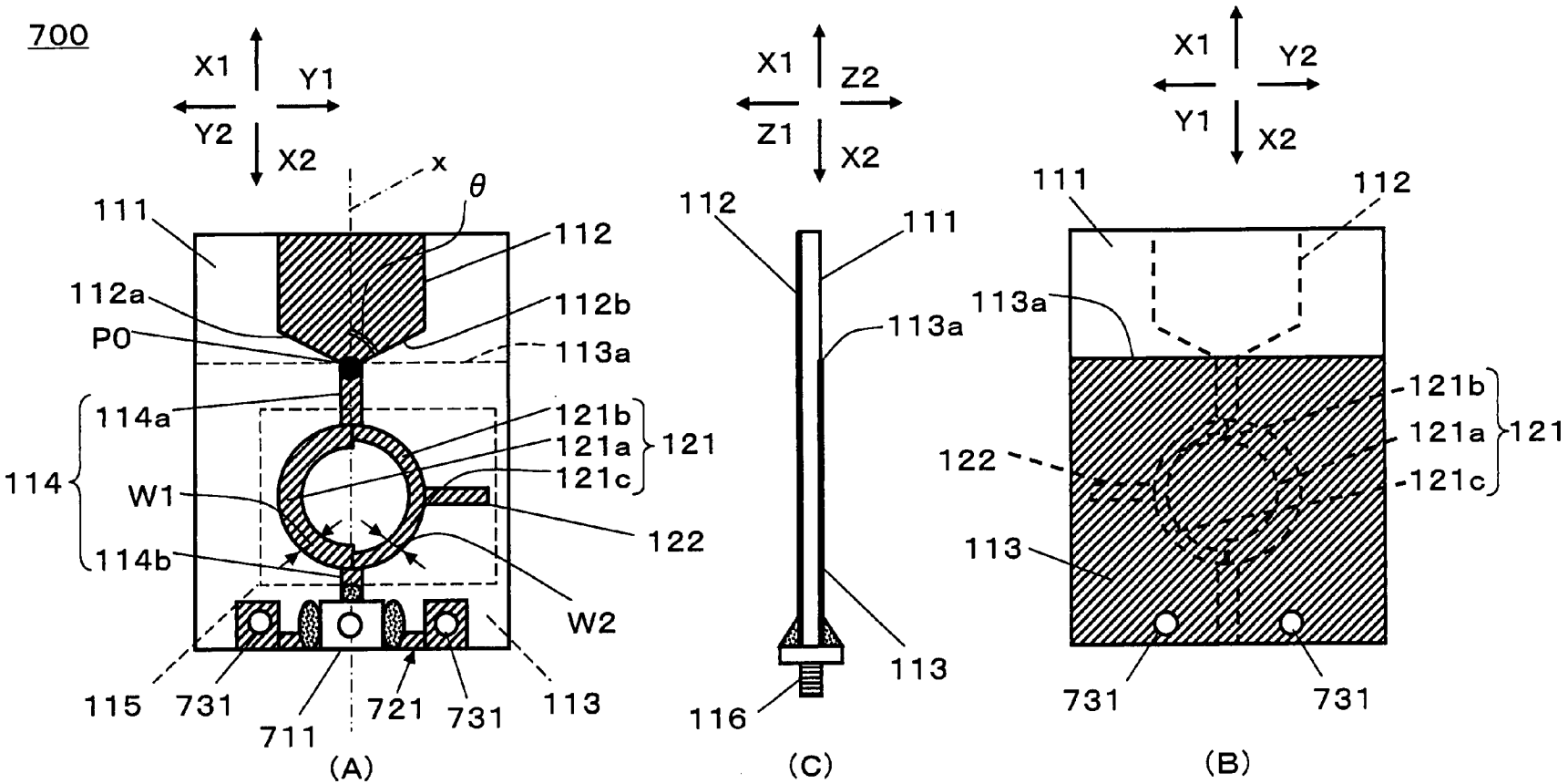
FIG. 22 gives a plan view, a side elevation, and a bottom view of the antenna apparatus according to the seventh embodiment of the present invention.

FIG. 21 is a perspective diagram of an antenna apparatus 700 according to the seventh embodiment of the present invention. FIG. 22 gives a plan view, a side elevation, and a bottom view of the antenna apparatus according to the antenna apparatus 700. In FIG. 21 and FIG. 22, the same reference marks are given to the same components as FIG. 4 and FIG. 5, and the explanations thereof are not repeated.

The antenna apparatus 700 includes a socket connector 711 that is different from the first embodiment, and consequently, the electric conduction pattern of the dielectric substrate 111 is different.

Figure 23:
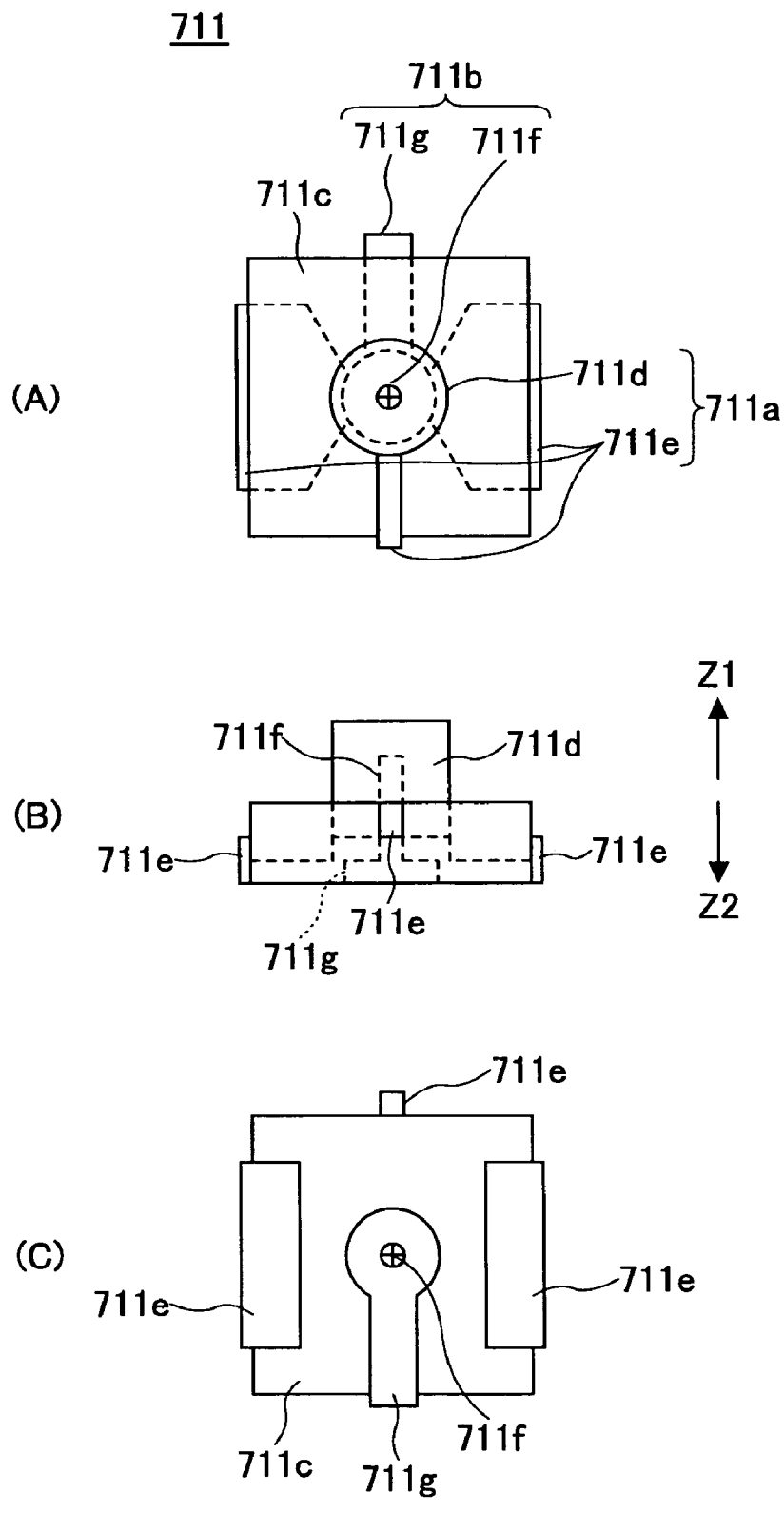
FIG. 23 gives a plan view, a side elevation, and a bottom view of a socket connector 711.

FIG. 23 gives a plan view, a side elevation, and a bottom view of the antenna apparatus according to the socket connector 711. The first view indicated by (A) is an upper surface view. The second view indicated by (B) is a side elevation. The third view indicated by (C) is a bottom plan view.

The socket connector 711 is structured as a surface mount type connector, and includes a shield section 711*a*, a signal-line connection section 711*b*, and an insulation section 711*c*, which are molded in one body.

The shield section 711*a* consists of electrically conductive material, and includes a connection section 711*d* and a connection section 711*e*. The connection section 711*d* is shaped like a cylinder, is extended in a direction of an arrow Z1, and is engaged with the shield of the plug connector. The connection section 711*e* is connected to the connection section 711*d*, and is exposed at the bottom of the insulation section 711*c* in a direction of an arrow Z2.

The signal-line connection section 711*b* consists of electrically conductive material, and includes a contact pin 711*f*, and a connection section 711*g*. The contact pin 711*f* is extended from the insulation section 711*c* in the direction of the arrow Z2 to the inner circumference side of the connection section 711*d*, and is connected to the signal line of the plug connector when the plug connector is engaged with. The connection section 711*g* is connected to the contact pin 711*f*, and is exposed at the bottom of the insulation section 711*c* in the direction of the arrow Z2.

Figure 24:
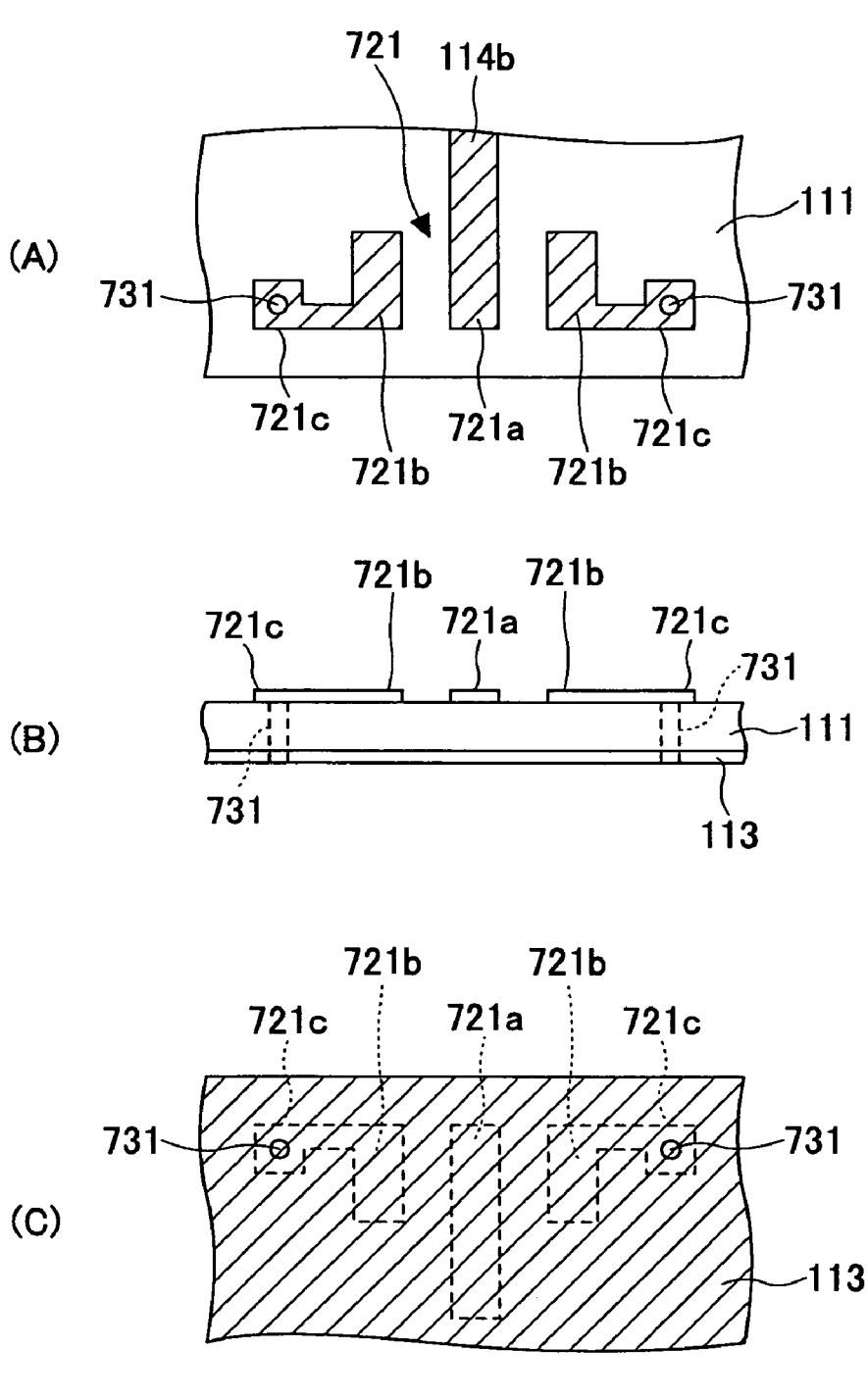
FIG. 24 gives a plan view, a side elevation, and a bottom view of the principal part of a dielectric substrate 111.

FIG. 24 gives a plan view, a side elevation, and a bottom view of the antenna apparatus according to the principal part of the dielectric substrate 111. The first view indicated by (A) is an upper surface view. The second view indicated by (B) is a side elevation. The third view indicated by (C) is a bottom plan view.

A connection pattern 721 for mounting the socket connector 711 is formed at an end of the dielectric substrate 111 in the direction of the arrow X2. The connection pattern 721 includes a signal-line connection section 721*a*, a ground connection section 721*b*, and a through via connection section 721*c*. The signal-line connection section 721*a* is arranged such that it counters the connection section 711*g* of the socket connector 711. The signal-line connection section 721*a* and the connection section 711*g* of the socket connector 711 are soldered.

The ground connection section 721*b* is arranged countering the connection section 711*e* of the socket connector 711. The ground connection section 721*b* and the connection section 711*e* of the socket connector 711 are soldered.

Further, the ground connection section 721*b* is connected to the through via connection section 721*c*. A through via 731 is formed in the through via connection section 721*c*. The through via 731 penetrates the dielectric substrate 111, and connects the through via connection section 721*c* and the grounding pattern 113.

Figure 25:
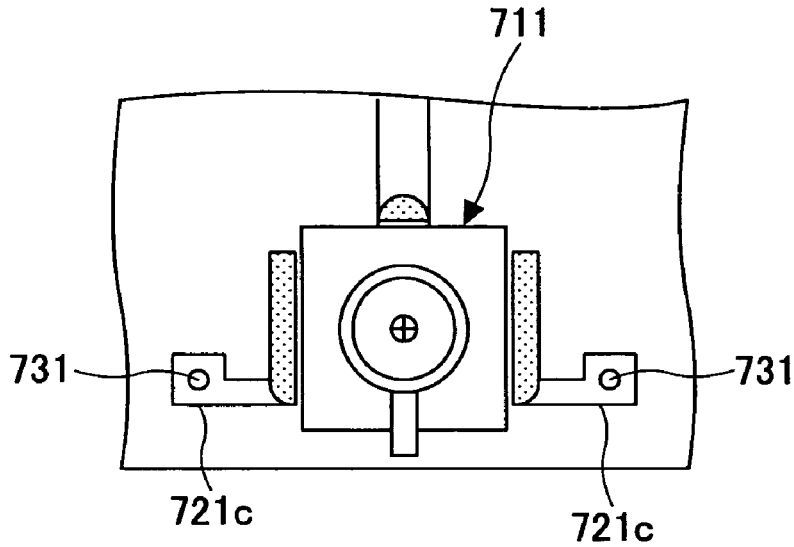
FIG. 25 gives a plan view and a side view of the socket connector 711 as installed on a dielectric substrate 111.
Figure 25:
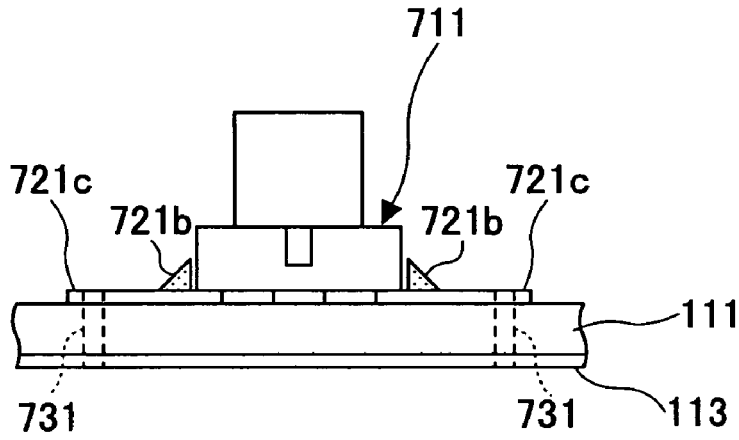

FIG. 25 gives a plan view at (A) and a side view at (B) of the socket connector 711 as mounted on the dielectric substrate 111.

The socket connector 711 is mounted on the dielectric substrate 111 such that the connection section 711*g* may counter the signal-line connection section 721*a*, and the connection section 711*e* may counter the ground connection section 721*b*. Then, the signal-line connection section 721*a* is soldered to the connection section 711*g*, and the connection section 711*e* is soldered to the ground connection section 721*b*.

The plug connector 103 is formed in a longitudinal direction of the coaxial cable 101.

According to the present embodiment, the antenna apparatus 700 is made thin by employing the surface mount type connector.

The Eighth Embodiment

Figure 26:
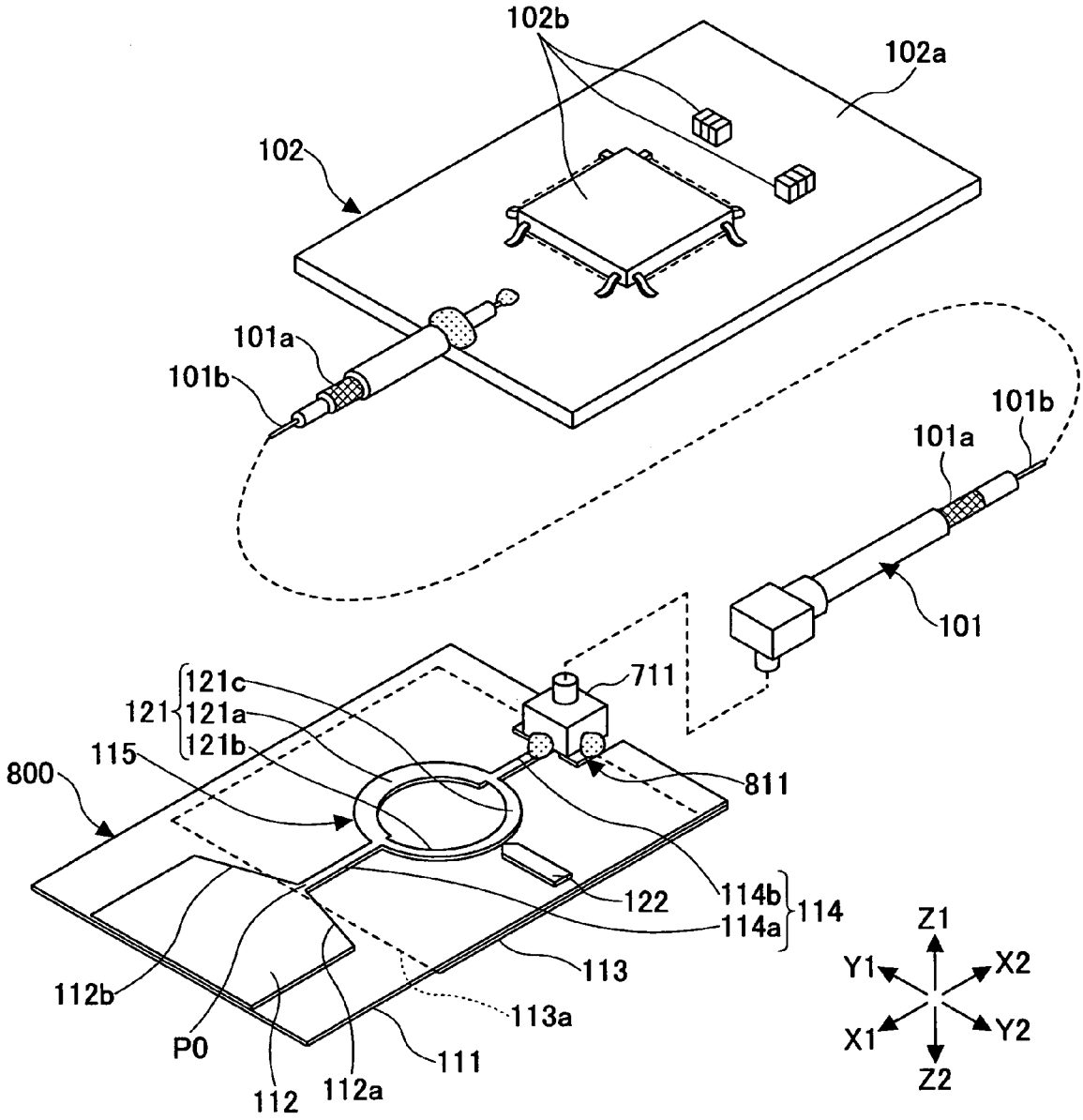
FIG. 26 is a perspective diagram of the antenna apparatus according to the eighth embodiment of the present invention.
Figure 27:
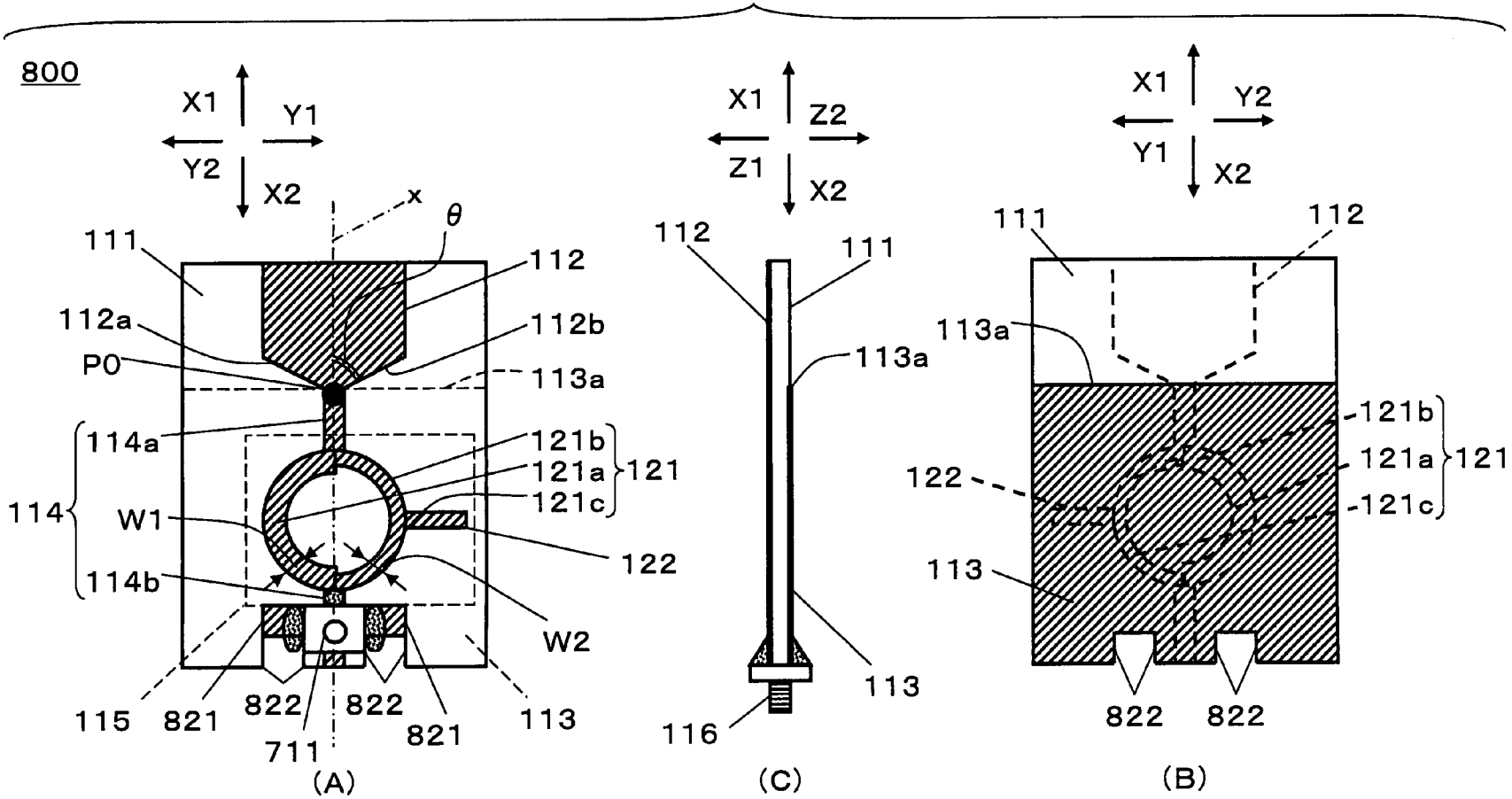
FIG. 27 gives a plan view, a side elevation, and a bottom view of the antenna apparatus according to the eighth embodiment of the present invention.

FIG. 26 is a perspective diagram of an antenna apparatus 800 according to the eighth embodiment of the present invention. FIG. 27 gives a plan view, a side elevation, and a bottom view of the antenna apparatus according to the antenna apparatus 800. In FIGS. 26 and 27, the same reference marks are given to the same components as FIG. 4 and FIG. 5, and the explanations thereof are not repeated.

The dielectric substrate 111 of the antenna apparatus 800 is a flexible substrate, and the antenna apparatus 800 includes a connection section 811 for connecting the socket connector 711, which are different from the seventh embodiment.

Figure 28:
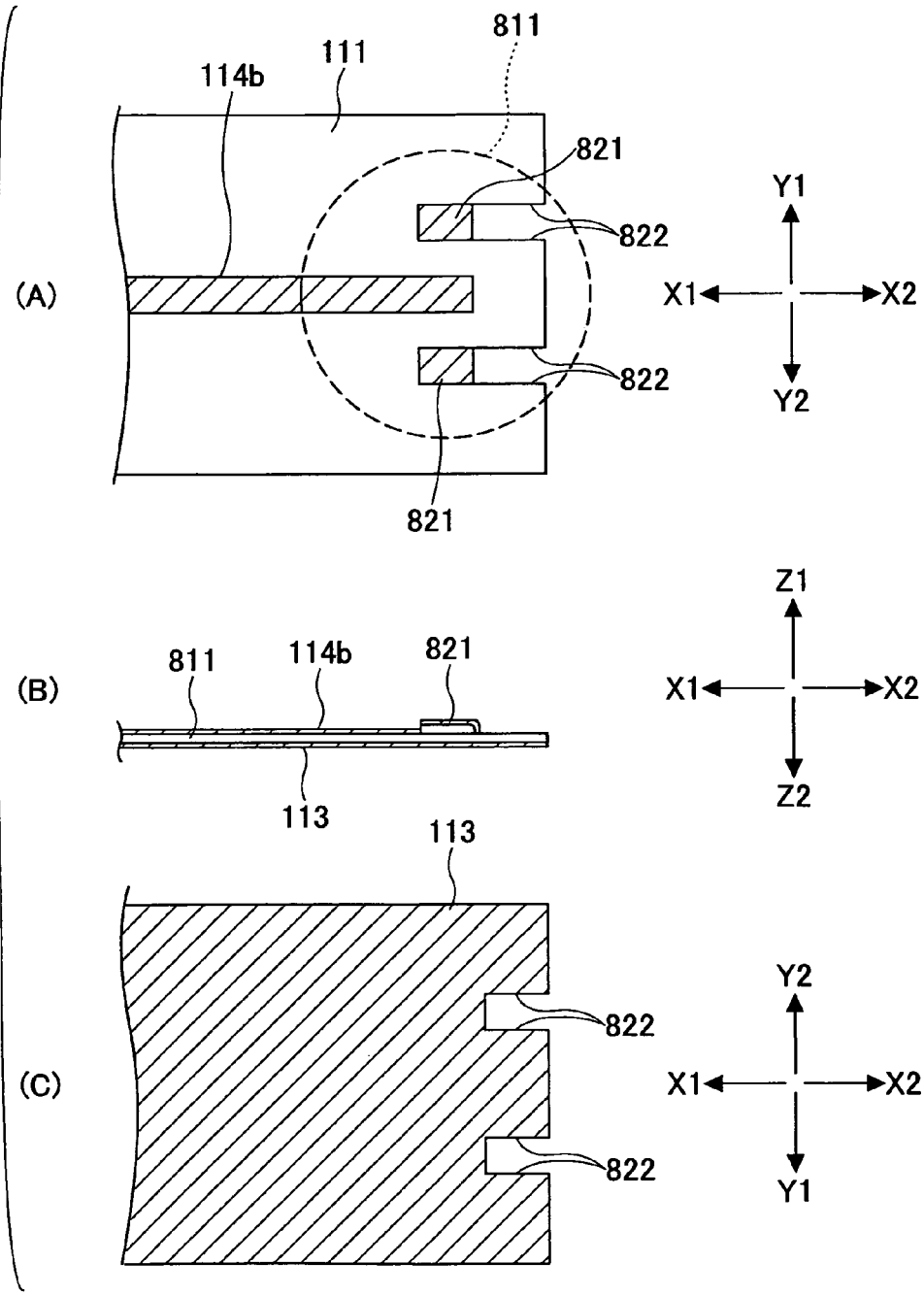
FIG. 28 gives a plan view, a side elevation, and a bottom view of a connection section 811.
Figure 29:
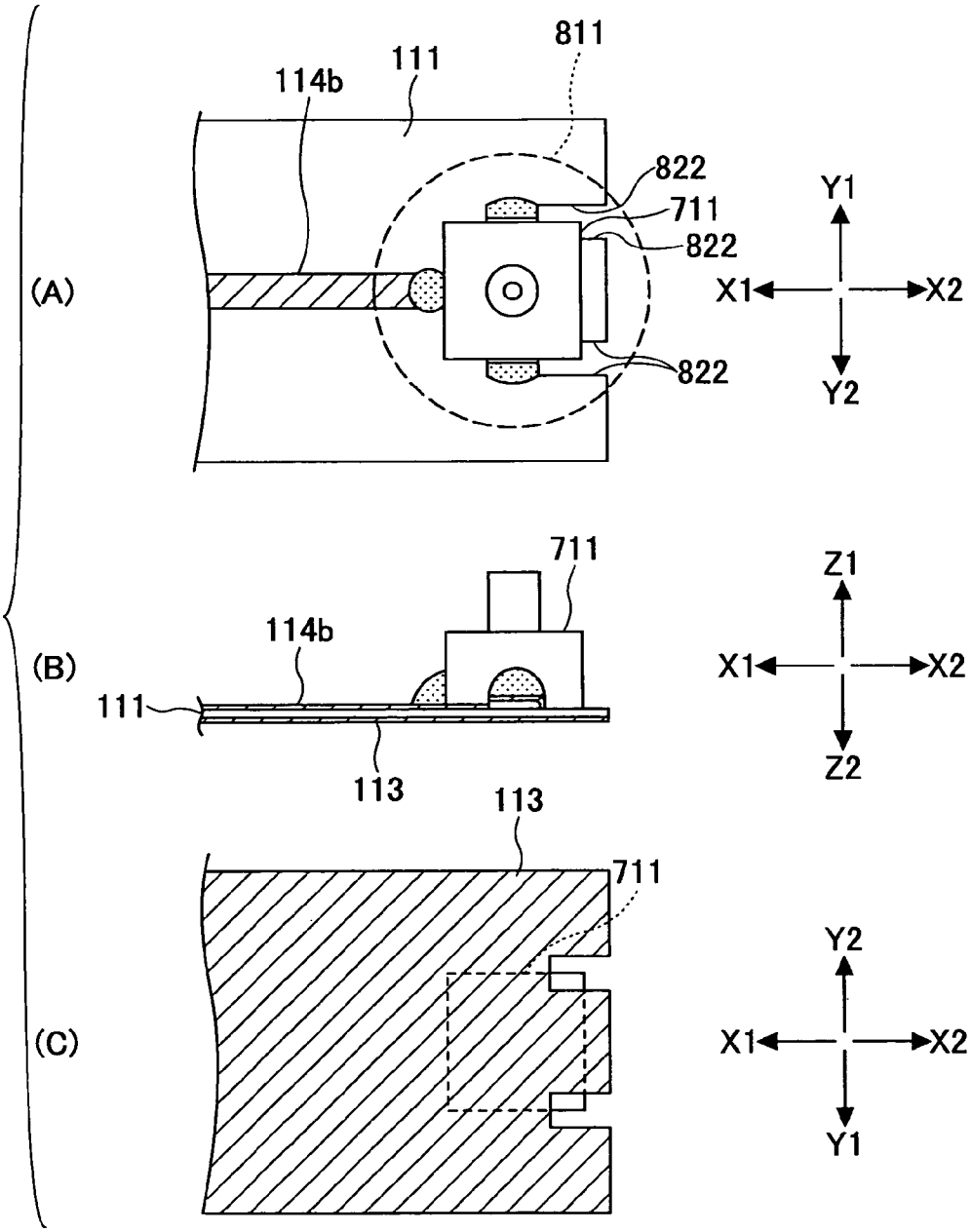
FIG. 29 gives a plan view, a side elevation, and a bottom view of the connection section 811.

Each of FIG. 28 and FIG. 29 gives a plan view, a side elevation, and a bottom view of the antenna apparatus according to the connection section 811.

The connection section 811 has bending sections 821. The bending sections 821 are formed on both sides of, and at an end of, the line 114*b* of the dielectric substrate 111, the end being in the direction of the arrow X2. The bending sections 821 are formed by making incisions at four places 822 in the arrow X1 direction, the four places being at the end of the dielectric substrate 111 in the arrow X2 direction, producing the two bending sections 821; and bending the bending sections 821 in the arrow Z1 direction. In this manner, the grounding pattern 113 is exposed in the arrow Z1 direction of the bending sections 821.

By soldering the connection section 711*e* that constitutes the shield section 711*a* of the socket connector 711 to the bending section 821, as shown in FIG. 29, the socket connector 711 is surface-mounted to the dielectric substrate 111.

According to the present embodiment, incisions are made in the dielectric substrate 111 at the four places 822 for producing the two bending sections 821, and the bending sections 821 are bent such that the connection section for surface-mounting the socket connector 711 is formed. In this way, no patterning is required, and a simple structure is realized for surface-mounting the socket connector 711.

The Ninth Embodiment

Figure 30:
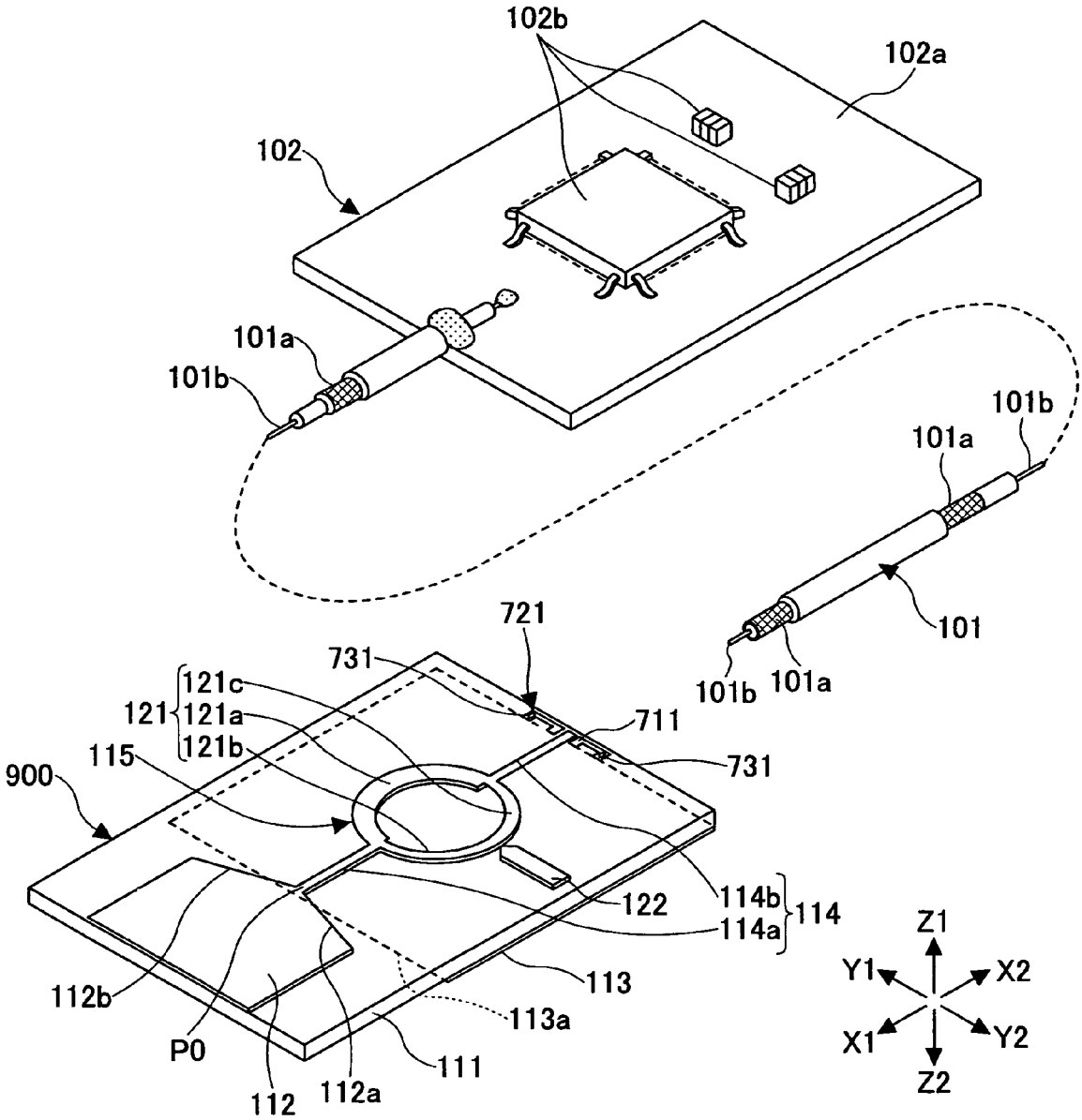
FIG. 30 is a perspective diagram of the antenna apparatus according to the ninth embodiment of the present invention.
Figure 31:
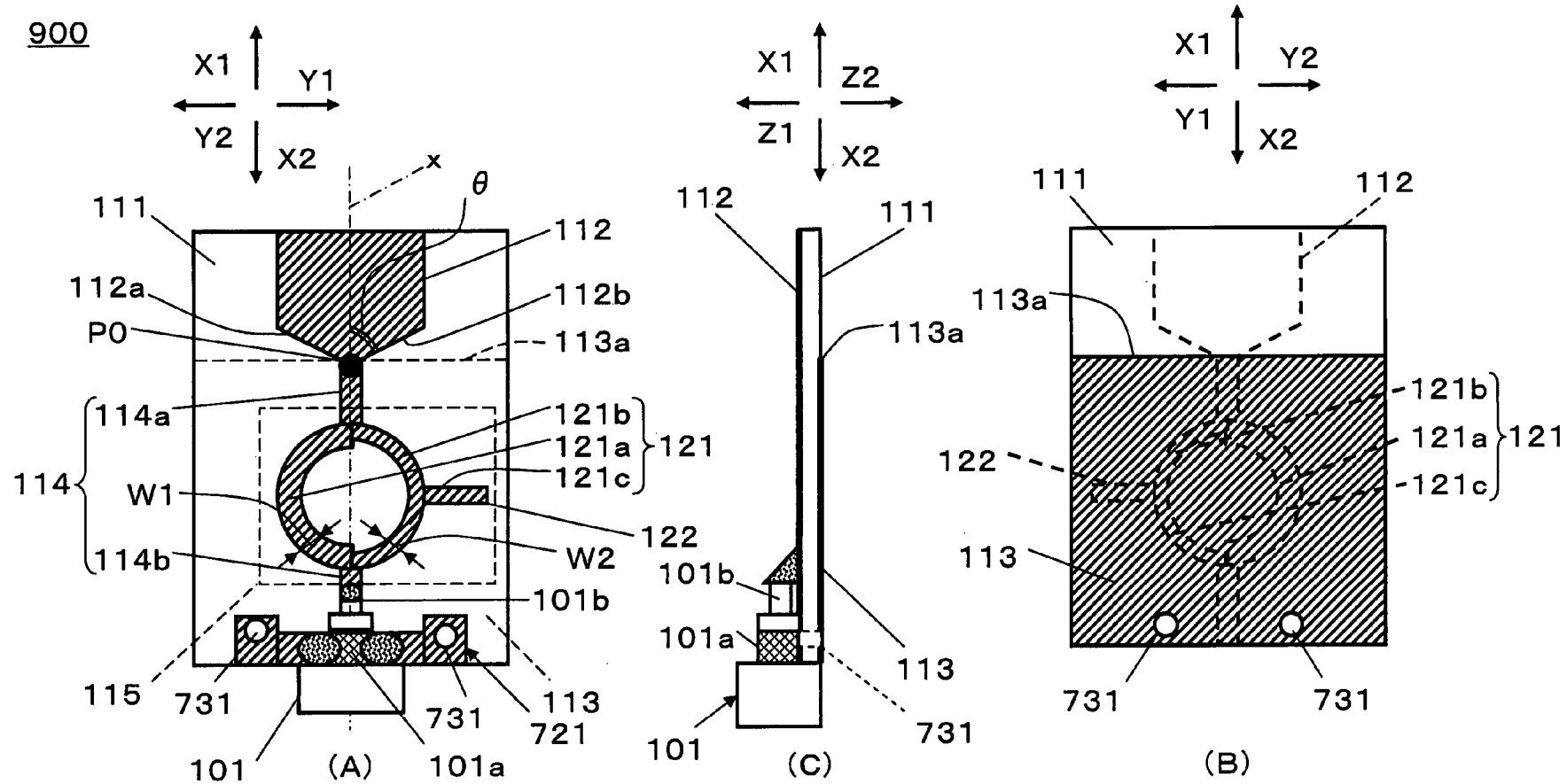
FIG. 31 gives a plan view, a side elevation, and a bottom view of the antenna apparatus according to the ninth embodiment of the present invention.

FIG. 30 is a perspective diagram of an antenna apparatus 900 according to the ninth embodiment of the present invention. FIG. 31 gives a plan view, a side elevation, and a bottom view of the antenna apparatus according to the antenna apparatus 900. In FIG. 30 and FIG. 31, the same reference marks are given to the same components as FIG. 21 and FIG. 22, and the explanations thereof are not repeated.

According to the antenna apparatus 900, the coaxial cable 101 is directly soldered to the connection pattern 721.

The Tenth Embodiment

Figure 32:
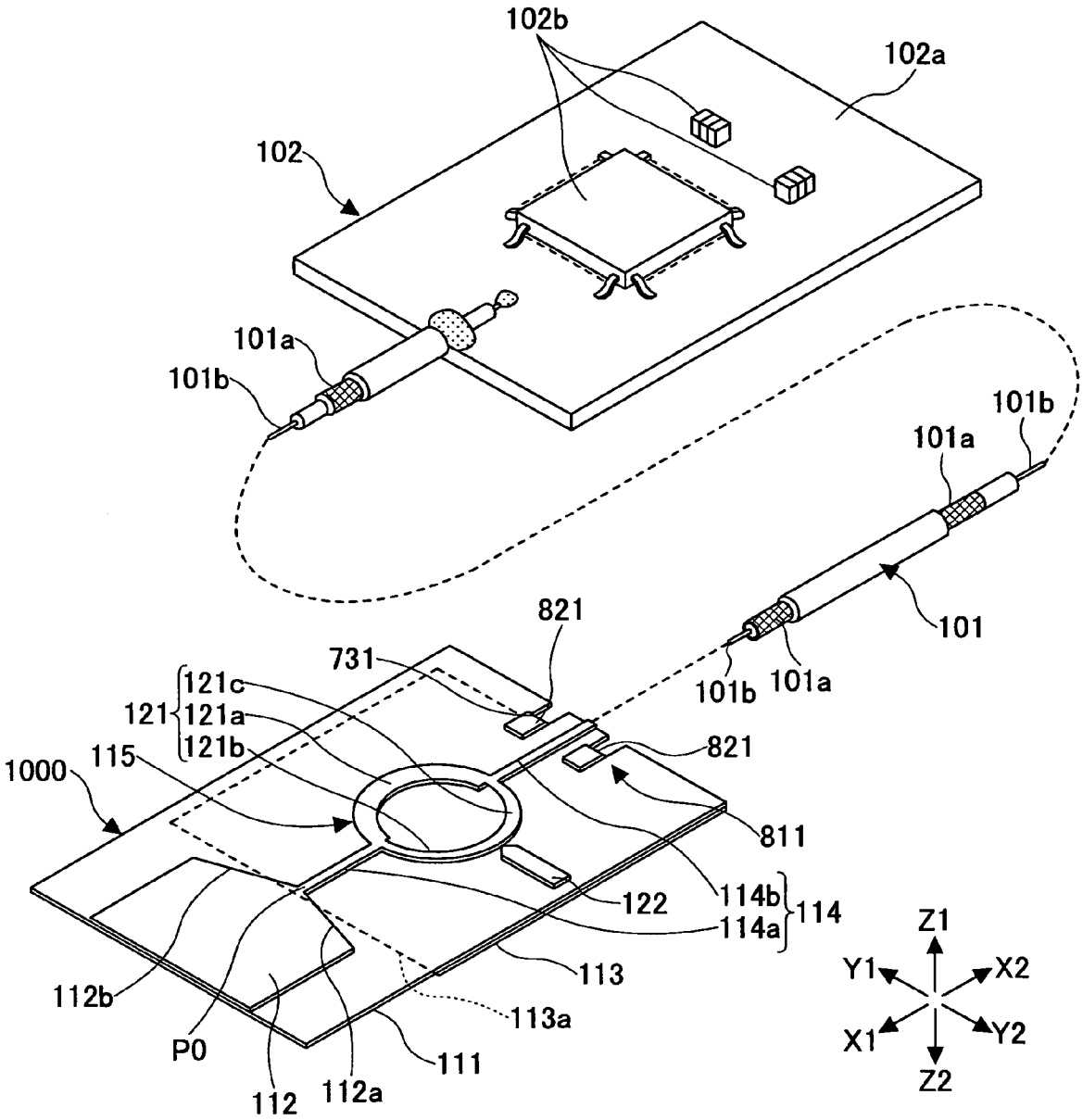
FIG. 32 is a perspective diagram of the antenna apparatus according to the tenth embodiment of the present invention.
Figure 33:
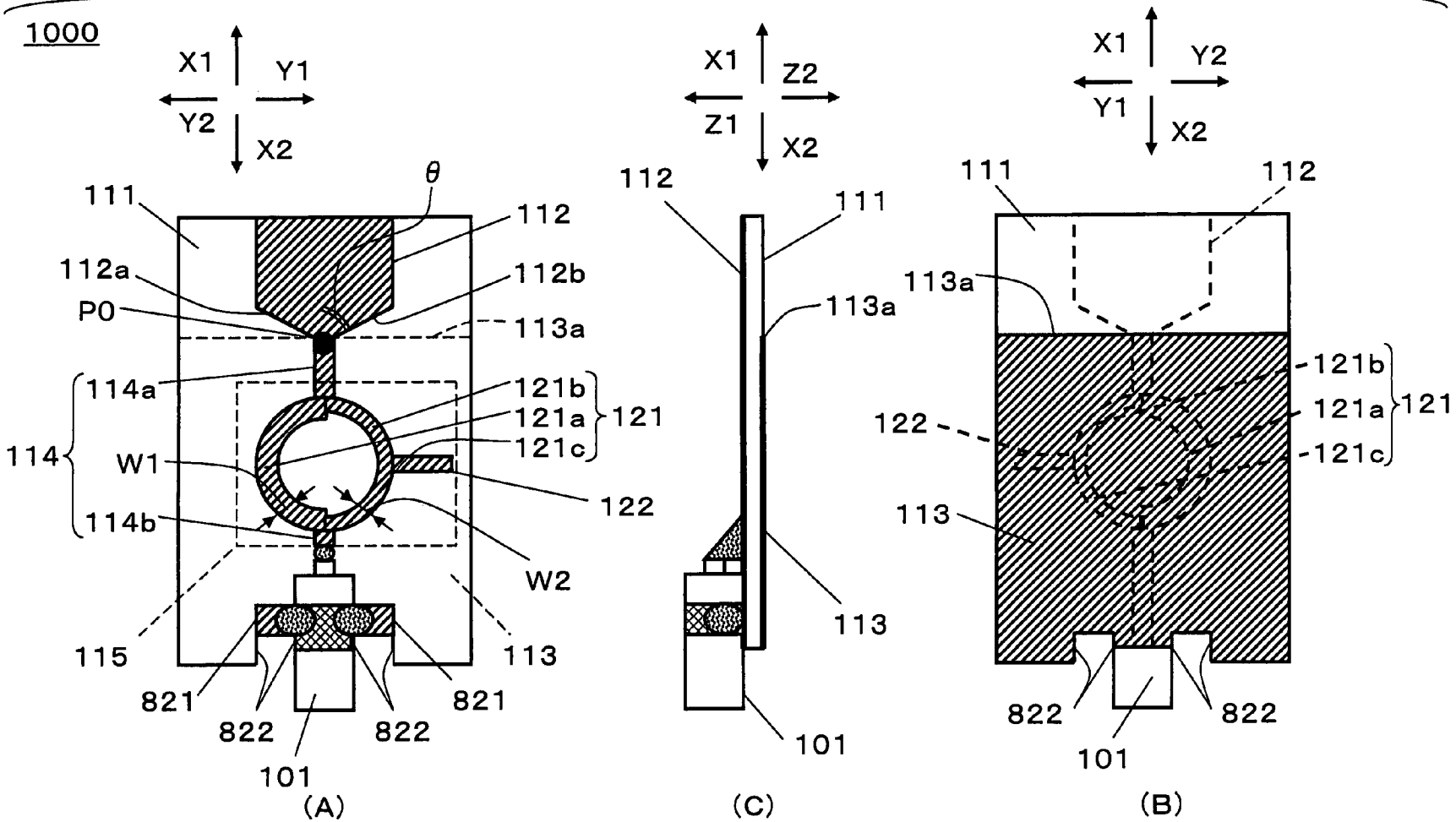
FIG. 33 gives a plan view, a side elevation, and a bottom view of the antenna apparatus according to the tenth embodiment of the present invention.

FIG. 32 is a perspective diagram of an antenna apparatus 1000 according to the tenth embodiment of the present invention. FIG. 33 gives a plan view, a side elevation, and a bottom view of the antenna apparatus according to the antenna apparatus 1000. In FIG. 32 and FIG. 33, the same reference marks are given to the same components as in FIG. 26 and FIG. 27, and the explanations thereof are not repeated.

According to the antenna apparatus 1000, the shield 101*a* of the coaxial cable 101 is directly soldered to the bending section 821, and the signal-line 101*b* is directly soldered to the line 114*b*.

The 11th Embodiment

Figure 34:
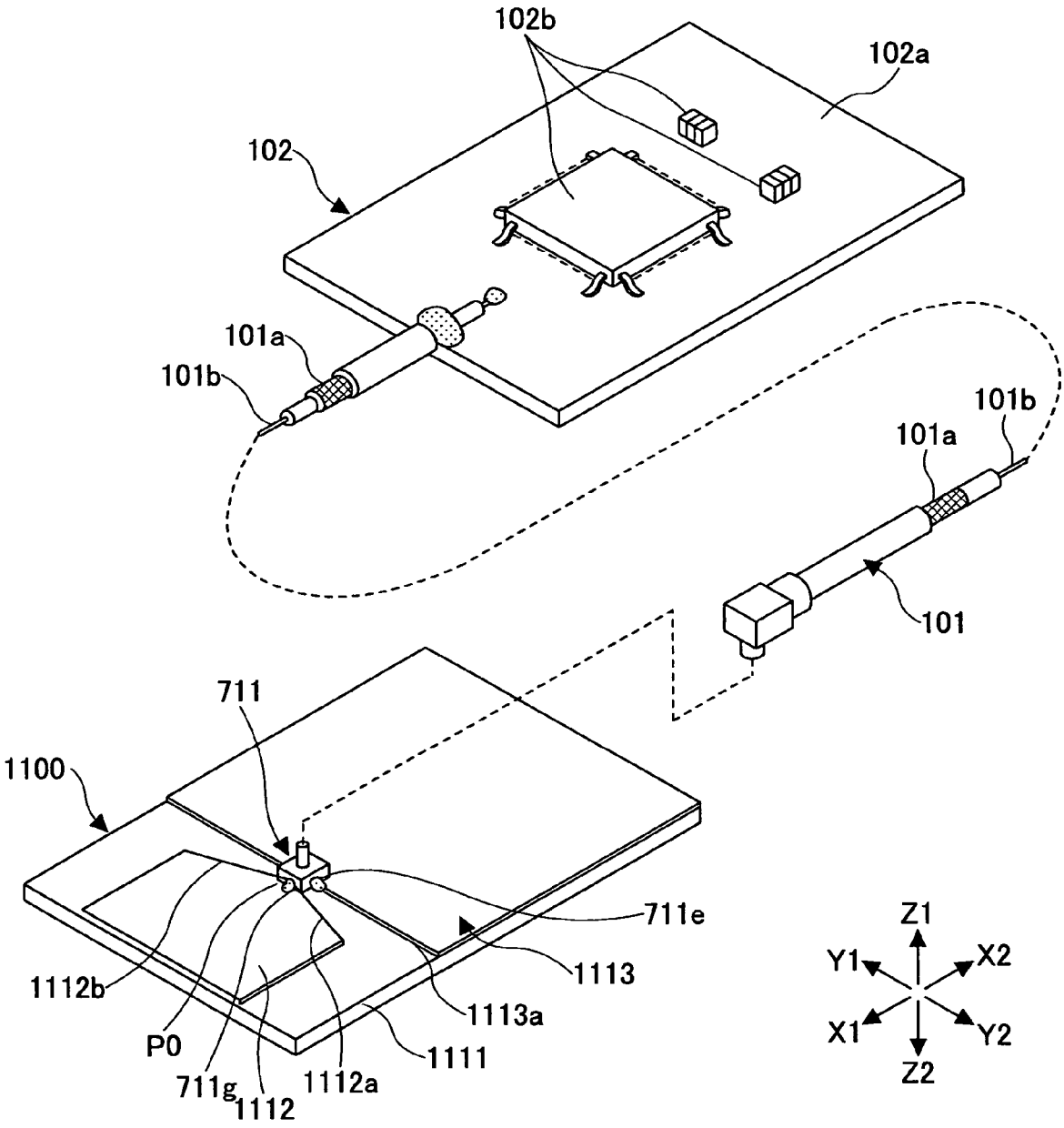
FIG. 34 is a perspective diagram of the antenna apparatus according to the 11th embodiment of the present invention.
Figure 35:
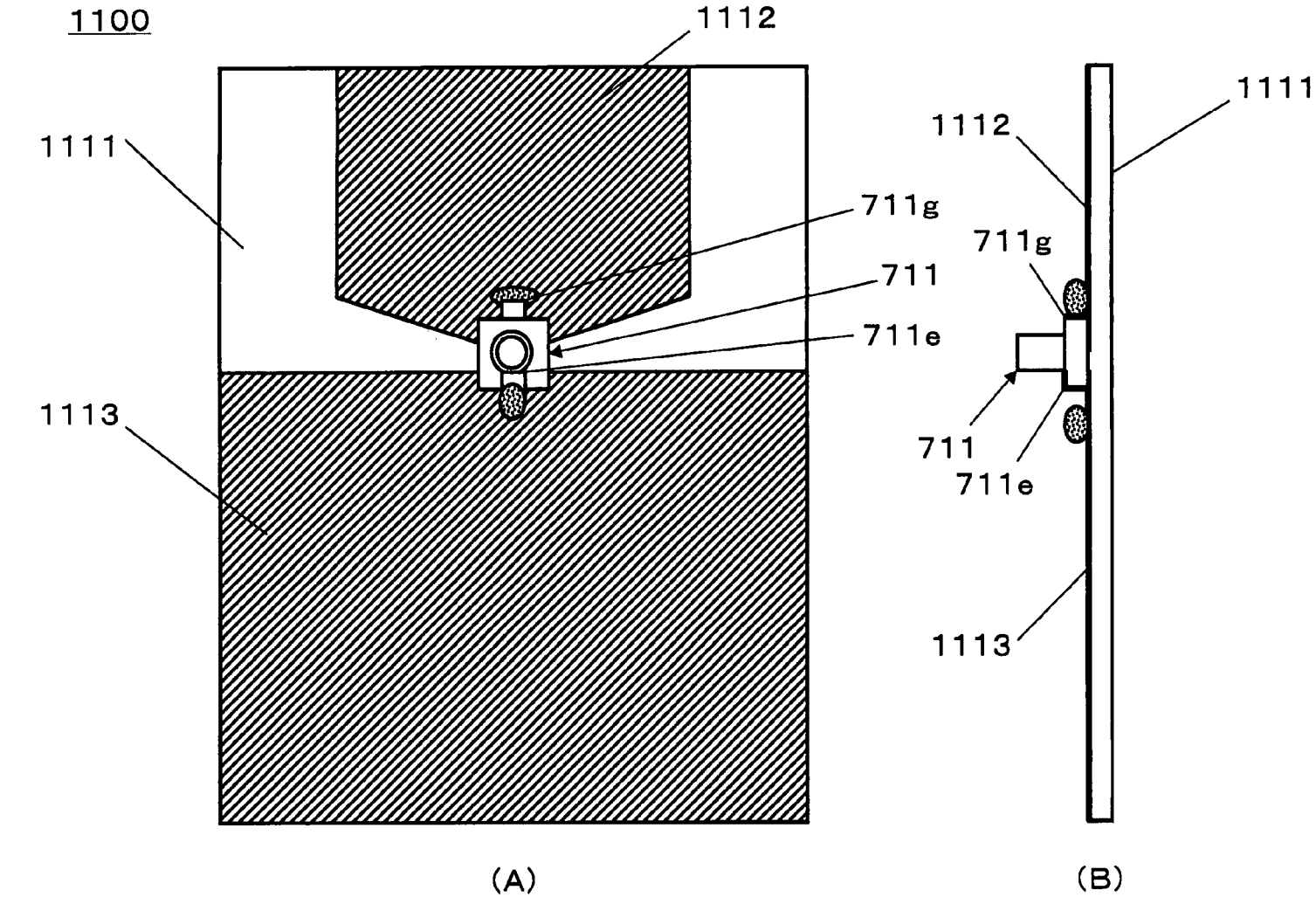
FIG. 35 gives a plan view and a side view of the antenna apparatus according to the 11th embodiment of the present invention.

FIG. 34 is a perspective diagram of an antenna apparatus 1100 according to the 11th embodiment of the present invention. FIG. 35 gives a plan view and a side view of the antenna apparatus 1100.

The antenna apparatus 1100 includes a dielectric substrate 1111, an element pattern 1112, a grounding pattern 1113, and the connector 711.

The dielectric substrate 1111 is shaped like a quadrangle, and is made of glass epoxy resin, flexible PET, and the like. The element pattern 1112 is patterned with an electric conduction material, such as copper and aluminum, on a surface of the dielectric substrate 1111. The element pattern is shaped like a pentagon.

The grounding pattern 1113 is formed with electrically conductive material such as copper and aluminum, the same as the element pattern 1112, on the same surface of the dielectric substrate 1111 adjacent to the element pattern 1112 in the directions of the arrows X1 and X2. Sides 1112*a* and 1112*b* that meet at the peak P0 of the element pattern 1112 are formed so that they make the predetermined angle θ with reference to the axis that perpendicularly intersects a side 1113*a* of the grounding pattern 1113. The angle θ is set at, for example, 63° in the case of UWB.

The connector 711 is the same as shown in FIG. 23. The connection section 711*g* is soldered to the peak P0 of the element pattern 1112. The connection section 711*e* is arranged between the element pattern 1112 and the grounding pattern 1113, and is soldered to the grounding pattern 1113.

The 12th Embodiment

Figure 36:
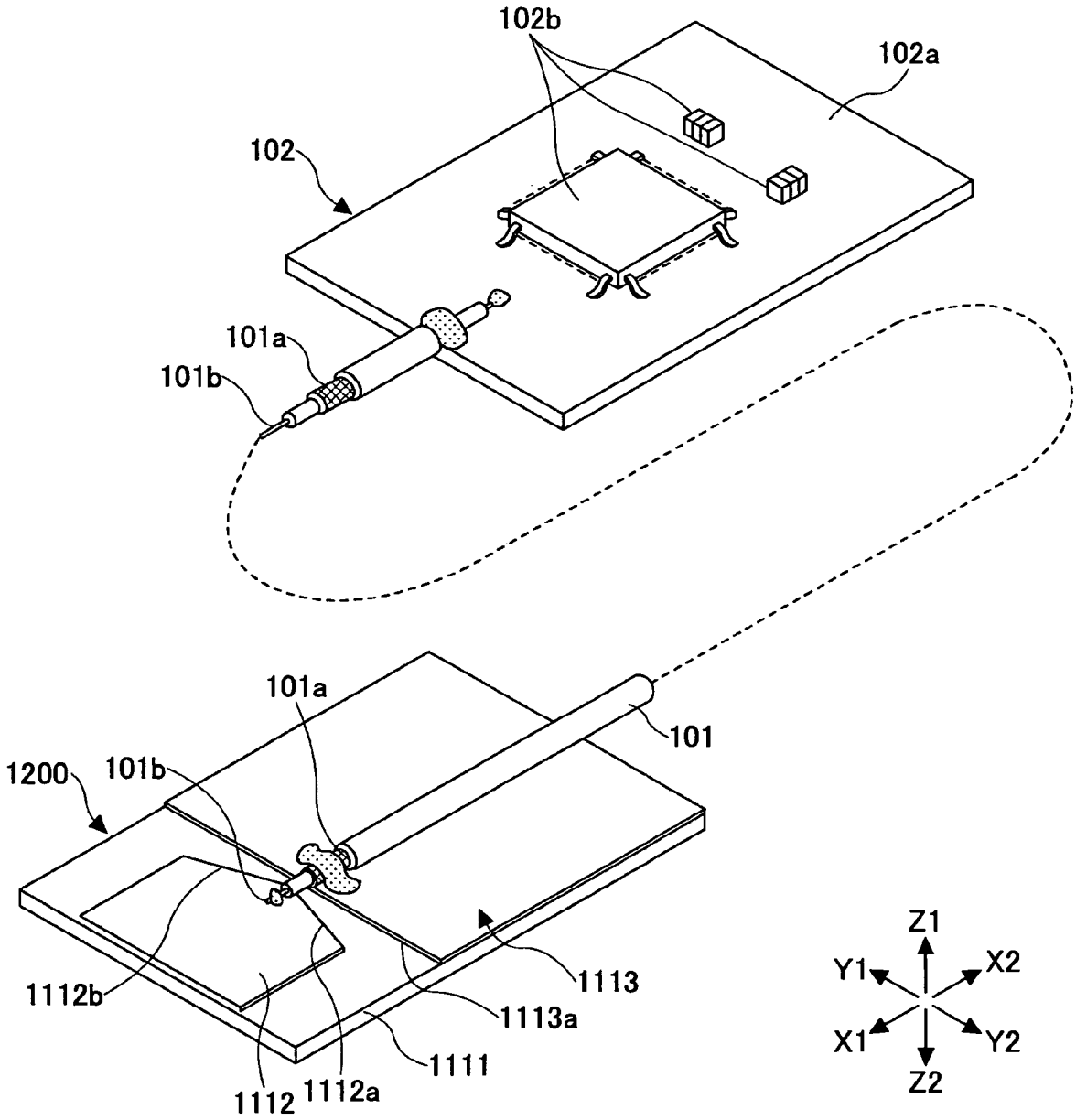
FIG. 36 is a perspective diagram of the antenna apparatus according to the 12th embodiment of the present invention.
Figure 37:
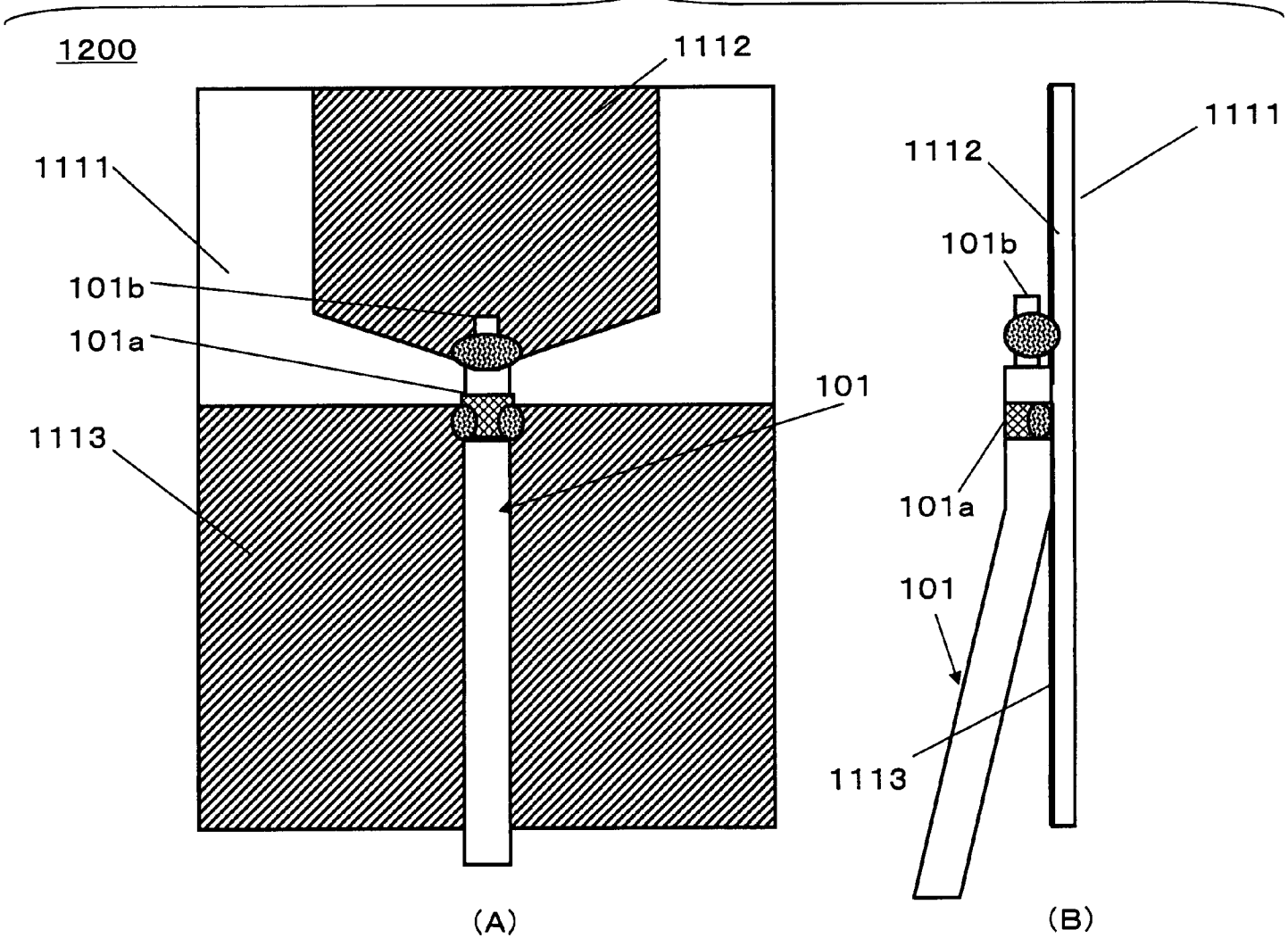
FIG. 37 gives a plan view and a side view of the antenna apparatus according to the 12th embodiment of the present invention.

FIG. 36 is a perspective diagram of an antenna apparatus 1200 according to the 12th embodiment of the present invention. FIG. 37 gives a plan view and a side view of the antenna apparatus 1200. In FIG. 36 and FIG. 37, the same reference marks are given to the same components as FIG. 34 and FIG. 35, and the explanations thereof are not repeated.

The antenna apparatus 1200 includes the dielectric substrate 1111, the element pattern 1112, the grounding pattern 1113, and a coaxial cable 101.

As for the coaxial cable 101, the signal line 101*b* is directly soldered to the element pattern 1112, and the shield 101*a* is directly soldered to the grounding pattern 1113.

The 13th Embodiment

Figure 38:
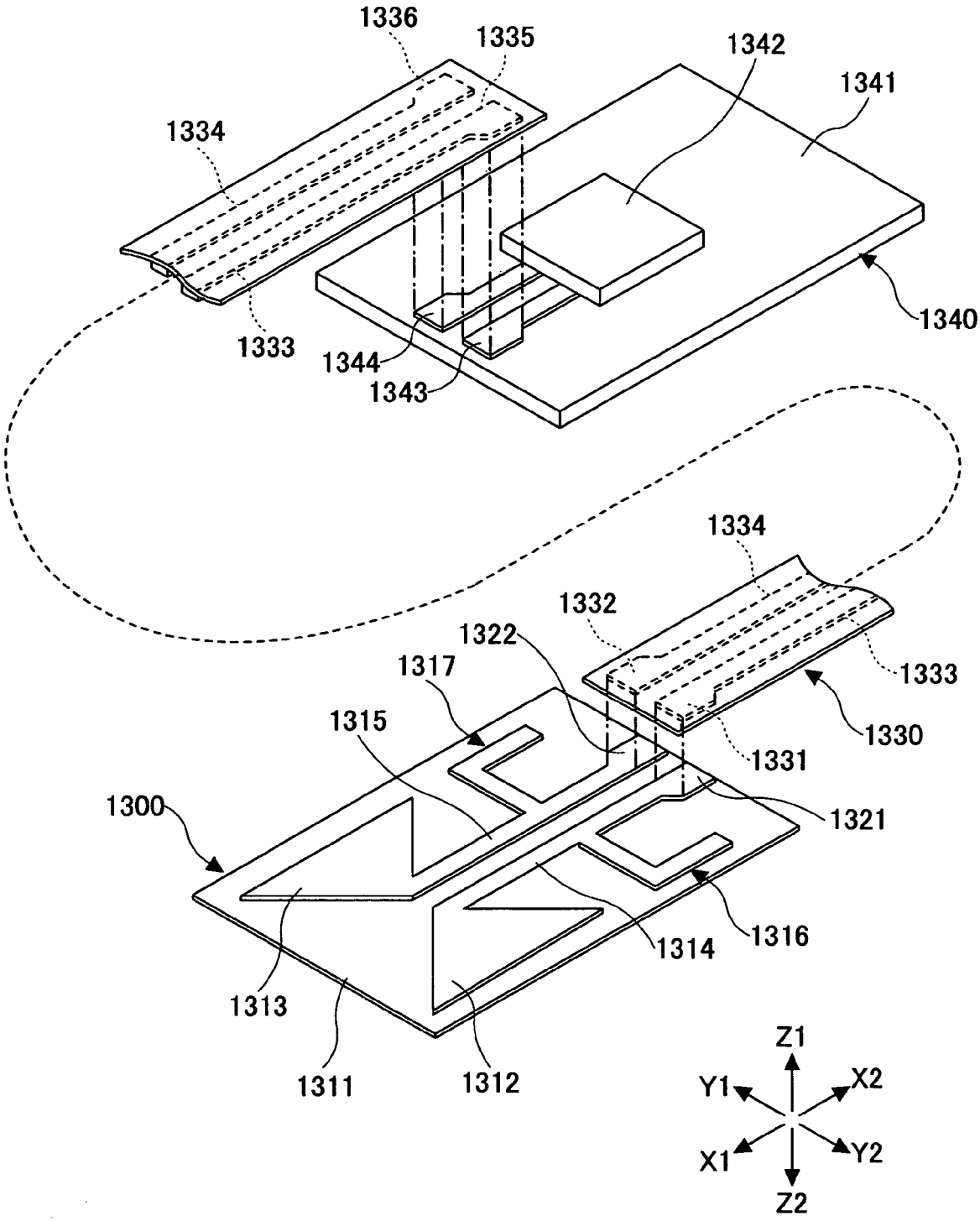
FIG. 38 is a perspective diagram of the antenna apparatus according to the 13th embodiment of the present invention.

FIG. 38 is a perspective diagram of an antenna apparatus 1300 according to the 13th embodiment of the present invention.

The antenna apparatus 1300 is a balanced feeding type antenna apparatus, and includes element patterns 1312 and 1313, balanced feed lines 1314 and 1315, and filters 1316 and 1317 on a dielectric substrate 1311.

The dielectric substrate 1311 is shaped like a quadrangle, and is made of glass epoxy resin, flexible PET resin, and the like. The element patterns 1312 and 1313 are formed with an electrically conductive material, such as copper and aluminum, on a surface of the dielectric substrate 1311, and constitute a self-complementary balanced feeding antenna element pattern.

The balanced feed lines 1314 and 1315 constitute a so-called co-planar strip line. An end of the balanced feed line 1314 is connected to the element pattern 1312, and the other end is connected to the connection pad 1321. An end of the balanced feed line 1315 is connected to the element pattern 1313, and the other end is connected to the connection pad 1322.

The filter 1316 is constituted by a stub that extends from a middle point of the balanced feed line 1314 to outside in the arrow Y2 direction, and is bent in the arrow X2 direction. The length of the stub is set at approximately λ/2. The filter 1317 is constituted by a stub that extends to outside in the arrow Y1 direction from a middle point of the balanced feed line 1315, and is bent in the arrow X2 direction. The length of the stub is set at approximately λ/2.

Here, the filters 1316 and 1317 may be constituted by a ring filter with a stub, or chip parts.

The connection pad 1321 is formed at the other end of the balanced feed line 1314. Further, the connection pad 1322 is formed at the other end of the balanced feed line 1315. The connection pads 1321 and 1322 are connected to a balanced feed cable 1330.

The balanced feed cable 1330 includes a flexible dielectric substrate, to which connection pads 1331 and 1332, balanced feed lines 1333 and 1334, and connection pads 1335 and 1336 are formed by patterning an electrically conductive material such as aluminum and copper. The connection pads 1321 and 1322 are connected to the connection pads 1331 and 1332 of the balanced feed cable 1330 by, e.g., an ultrasonic wave, and thermo-compression bonding of an anisotropic electrically conductive tape.

The connection pad 1331 of the balanced feed cable 1330 is connected to the end of the balanced feed line 1333. Further, the connection pad 1332 of the balanced feed cable 1330 is connected to the end of the balanced feed line 1334. The other end of the balanced feed line 1333 is connected to the connection pad 1335, and the other end of the balanced feed line 1334 is connected to the connection pad 1336.

The connection pads 1335 and 1336 are connected to a transceiver unit 1340 that is constituted by electronic parts 1342, etc., mounted on a printed wiring board 1341. The transceiver unit 1340 further includes connection pads 1343 and 1344 for connecting the balanced feed cable 1330.

Connection pads 1335 and 1336 of the balanced feed cable 1330 are connection to the connection pads 1343 and 1344 of the transceiver unit 1340 by, e.g., the ultrasonic wave, or thermo-compression bonding of the anisotropic electrically conductive tape.

The antenna apparatus 1300 and the transceiver unit 1340 are connected through the balanced feed cable 1330 as described above.

Since the filters 1316 and 1317 are provided on the antenna apparatus 1300 side, the transceiver unit 1340 does not have to provide filters according to the present embodiment.

The 14th Embodiment

Figure 39:
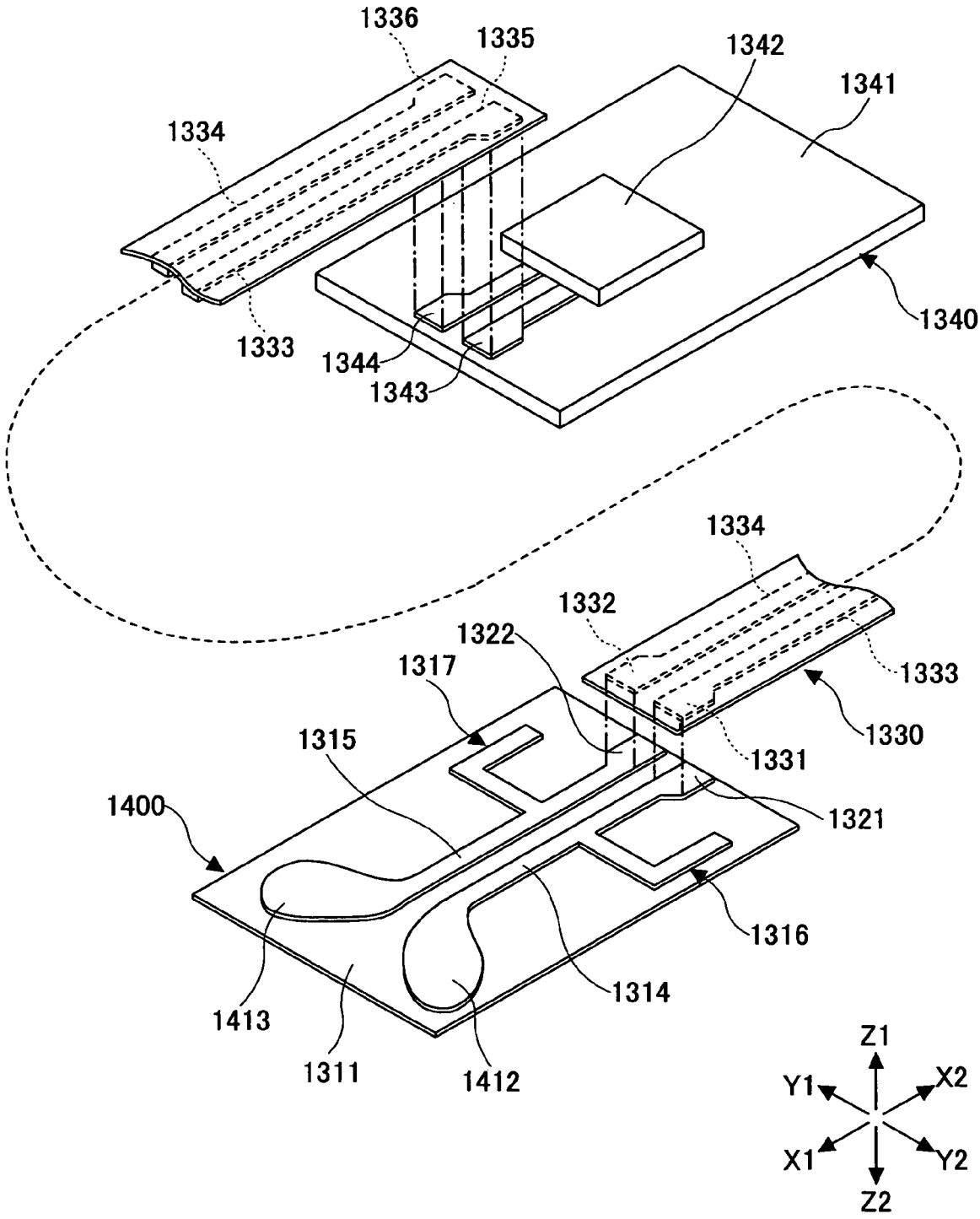
FIG. 39 is a perspective diagram of the antenna apparatus according to the 14th embodiment of the present invention.

FIG. 39 is a perspective diagram of an antenna apparatus 1400 according to the 14th embodiment of the present invention. In FIG. 39, the same reference marks are given to the same components as FIG. 38, and the explanations thereof are not repeated.

As for the antenna apparatus 1400 of the present embodiment, the form of the element patterns 1412 and 1413 is different from the 13th embodiment.

Specifically, the element patterns 1412 and 1413 of the present embodiment consist of so-called Vivaldy type element patterns. In this way, directivity of the antenna apparatus 1400 is improved compared with the 13th embodiment.

The 15th Embodiment

Figure 40:
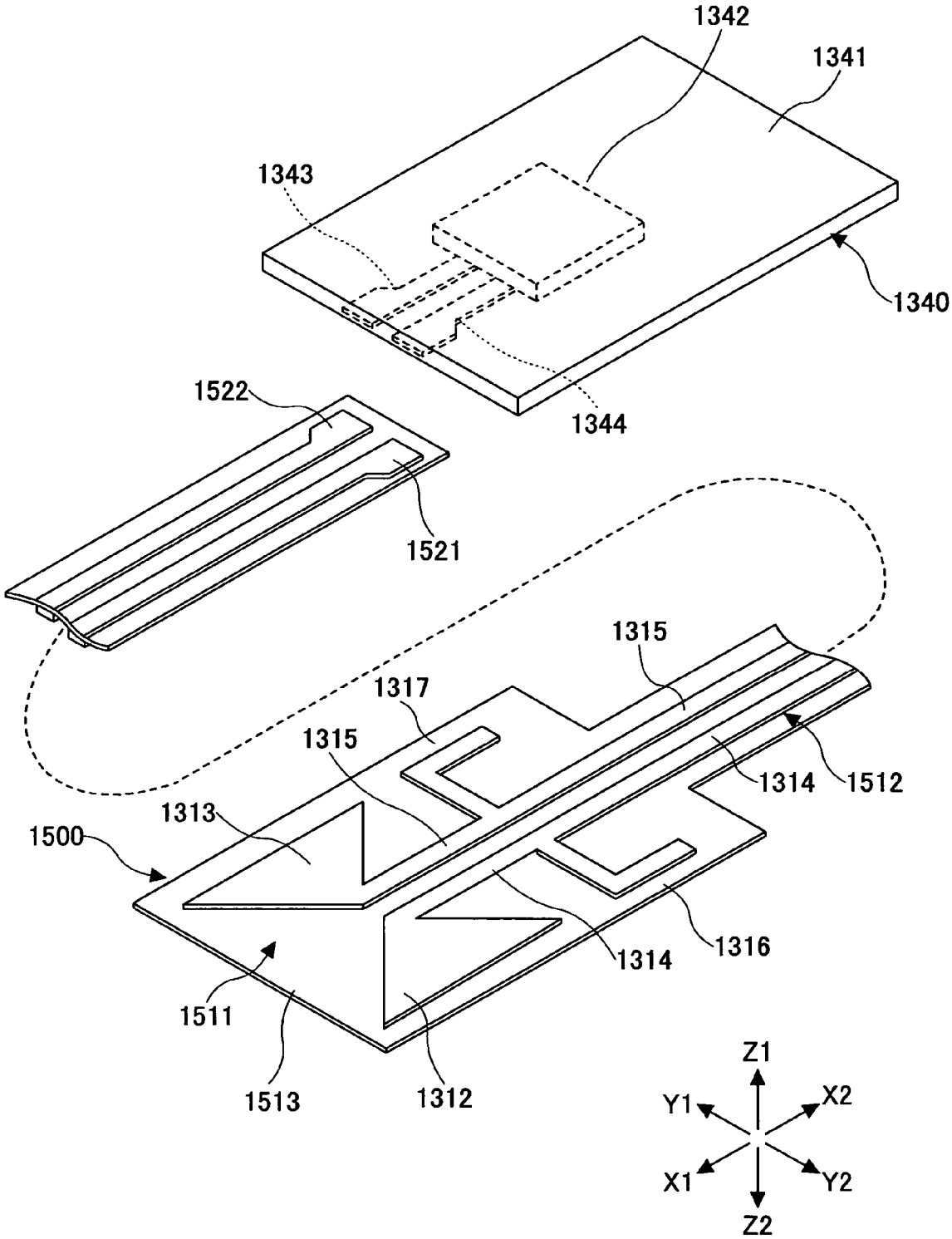
FIG. 40 is a perspective diagram of the antenna apparatus according to the 15th embodiment of the present invention.

FIG. 40 is a perspective diagram of an antenna apparatus 1500 according to the 15th embodiment of the present invention. In FIG. 40, the same reference marks are given to the same components as FIG. 38, and the explanations thereof are not repeated.

According to the antenna apparatus 1500 of the 15th embodiment, an antenna section 1511 and a balanced feed cable section 1512 are formed on the same dielectric substrate 1513.

The balanced feed lines 1314 and 1315 extend in the balanced feed cable section 1512, and the connection pads 1521 and 1522 are formed at ends of the balanced feed lines 1314 and 1315. The connection pads 1521 and 1522 are connected to the connection pads 1343 and 1344 formed in the transceiver unit 1340 by, e.g., the ultrasonic wave, or thermo-compression bonding of the anisotropic electrically conductive tape.

According to the present embodiment, the antenna apparatus 1500 and the transceiver unit 1340 are connected by connecting the connection pads 1521 and 1522 of the balanced feed cable 1512 that is a part of the antenna apparatus 1500 to the connection pads 1343 and 1344 of the transceiver unit 1340; thereby, connection is simplified.

Figure 41:
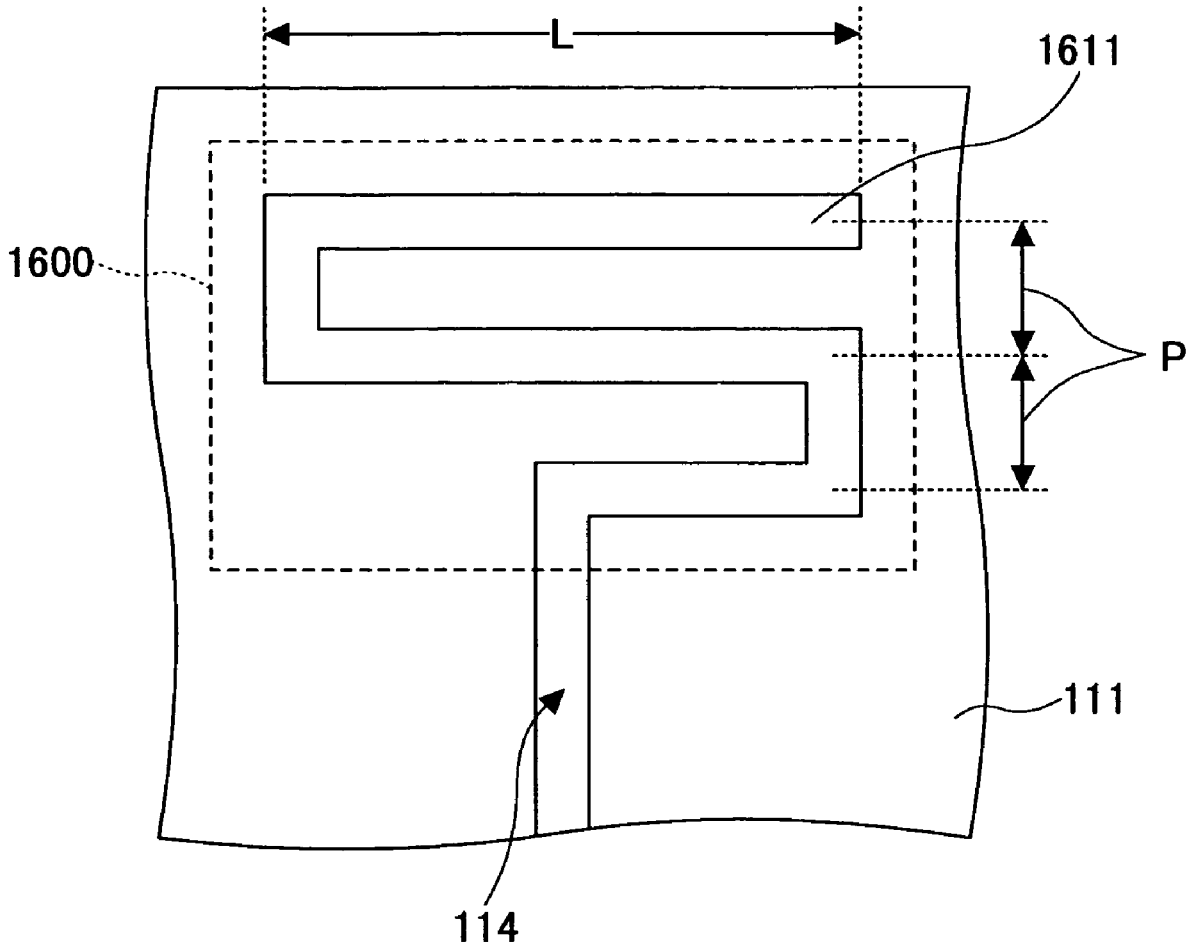
FIG. 41 is a plan view showing an example of a narrow-band antenna element pattern.

FIG. 41 is a plan view showing an example of a narrow-band antenna element pattern 1600.

The narrow-band antenna element pattern 1600 is constituted by an electric conduction path 1611 that is crooked, wherein the frequency characteristics are adjusted by tuning a length L, a pitch p, and so on.

The 16th Embodiment

Figure 42:
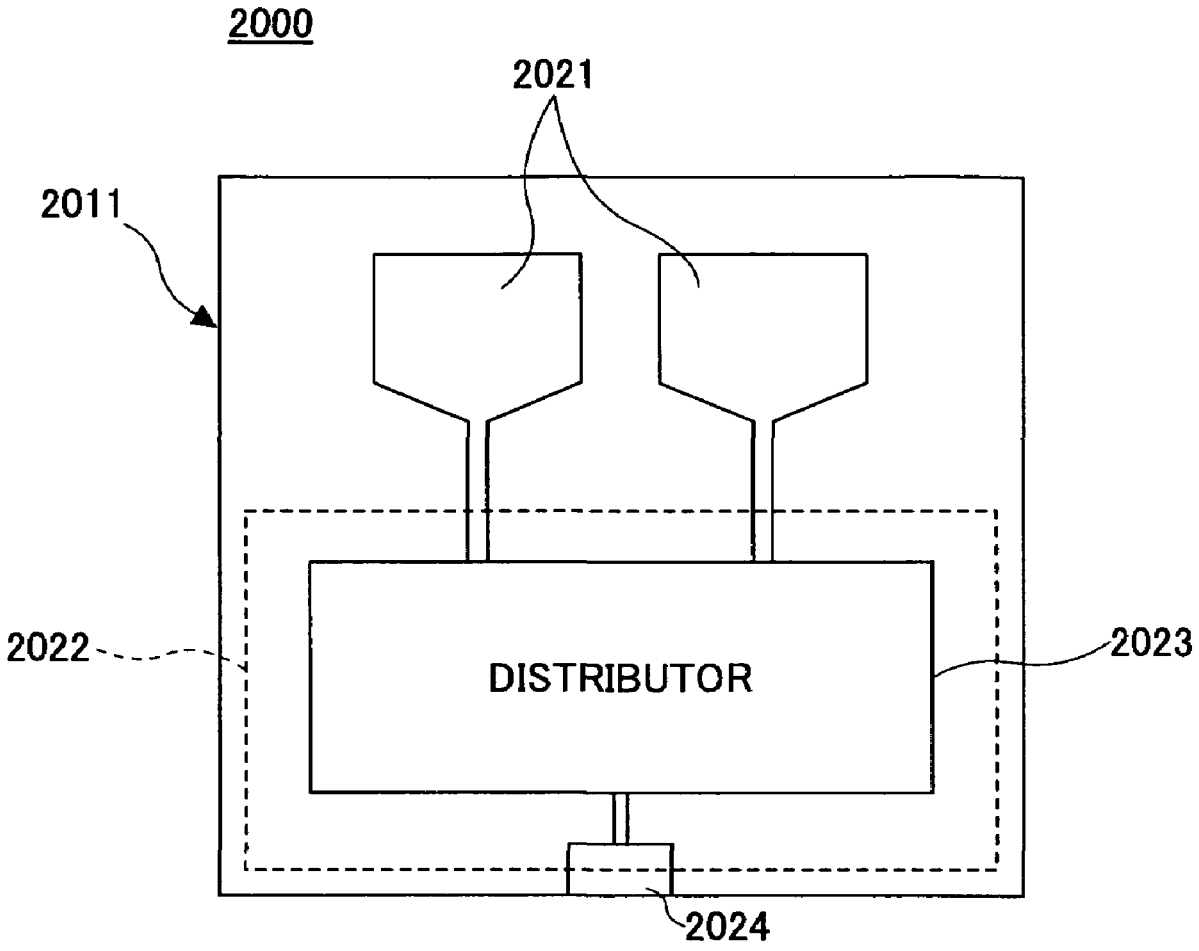
FIG. 42 is a plan view of the antenna apparatus according to the 16th embodiment of the present invention.
Figure 43:
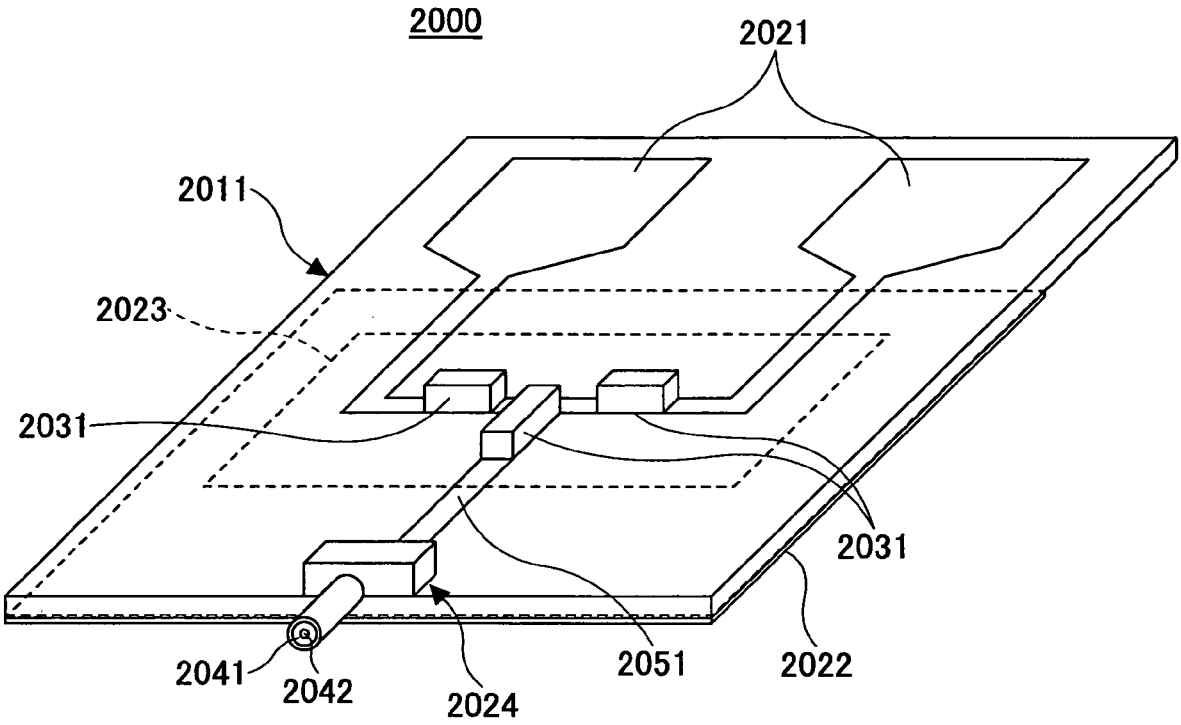
FIG. 43 is a perspective view of the antenna apparatus according to the 16th embodiment of the present invention.

FIG. 42 is a block diagram of an antenna apparatus 2000 according to the 16th embodiment of the present invention, and FIG. 43 is a perspective diagram of the antenna apparatus 2000 according to the 16th embodiment of the present invention.

The antenna apparatus 2000 according to the 16th embodiment is structured by two or more antenna elements 2021, a grounding pattern 2022, a distributor 2023, and a connector 2024, which are arranged on a dielectric substrate 2011.

The dielectric substrate 2011 is formed in the shape of a board with a dielectric material such as glass epoxy resin, flexible PET resin, carbon, PI, and LPC (liquid crystal polymer). On a surface of the dielectric substrate 2011, the antenna element pattern 2021, the distributor 2023, and the connector 2024 are arranged, and on the other surface the grounding pattern 2022 is formed.

The antenna element pattern 2021 is formed on the dielectric substrate 2011 by etching an electrically conductive pattern.

The antenna element pattern 2021 is shaped like a pentagon, looking like a baseball home plate, and provides UWB communication, collaborating with the grounding pattern 2022.

A peak of each antenna element pattern 2021 is connected to the distributor 2023.

The distributor 2023 consists of chip resistors 2031.

The chip resistors 2031 are each arranged with one end connected to a node of the two or more antenna element patterns 2021 and the connector 2024, and with the other end connected to the corresponding one of the two or more antenna element patterns 2021 and the connector 2024 such that the impedance of each path is a desired value, for example, 50 Ω.

Here, the distributor 2023 is not limited to a power divider by resistors as described above, but other means can be used such as a rat race type hybrid circuit, a branch line type hybrid circuit, a ¼-wave distribution coupling type hybrid circuit, other couplers including a phase-inversion type hybrid ring, and a Y form power distribution unit.

Figure 44A:
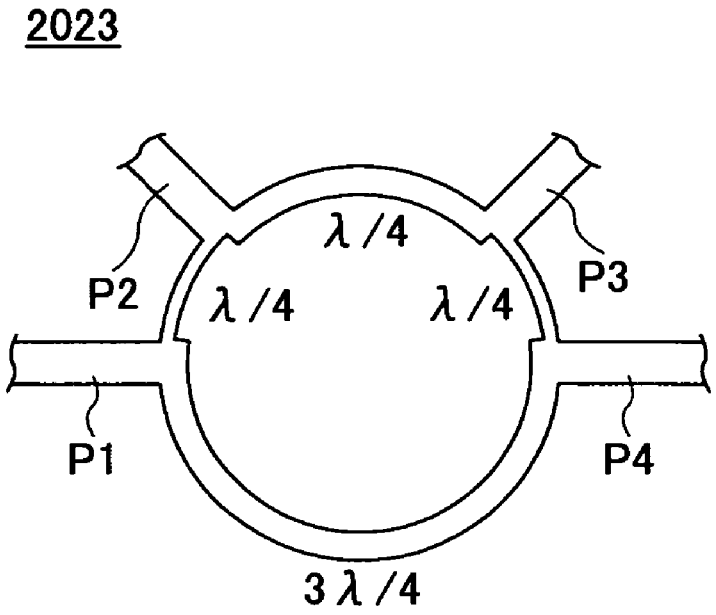
FIG. 44A and FIG. 44B are plan views showing modifications of a distributor.
Figure 44B:
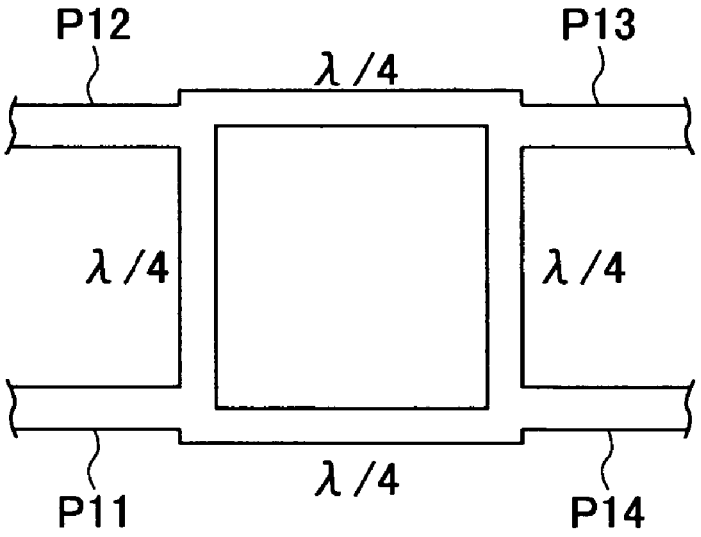

FIGS. 44A and 44B show modifications to the distributor 2023.

The distributor shown by FIG. 44A uses the rat race type hybrid circuit. The distributor shown by FIG. 44B uses the branch line type hybrid circuit.

As for the distributor 2023 using the rat race type hybrid circuit, a terminator is connected to an input/output port P1, a first antenna element pattern 2021 is connected to an input/output port P2, the connector 2024 is connected to an input/output port P3, and a second antenna element pattern 2021 is connected to an input/output port P4.

At this time, the input/output port P2 to which the first antenna element pattern 2021 is connected, and the input/output port P4 to which the second antenna element pattern 2021 is connected are located at equal distance to the input/output port P3 to which the connector 2024 is connected; accordingly, the transmitting/receiving signal of the first antenna element pattern 2021 and the transmitting/receiving signal of the second antenna element pattern 2021 can be made in phase according to this embodiment.

As for the distributor 2023 using the branch line type hybrid circuit, a terminator is connected to an input/output port P11, the first antenna element pattern 2021 is connected to an input/output port P12, the second antenna element pattern 2021 is connected to an input/output port P13, and the connector 2024 is connected to an input/output port P14.

At this time, the input/output port P12 to which the first antenna element pattern 2021 is connected, and the input/output port P13 to which the second antenna element pattern 2021 is connected are located at distances different by λ/4 to the input/output port P14 to which the connector 2024 is connected, so that there is a 90° phase difference between the transmitting/receiving signal of the first antenna element pattern 2021 and the transmitting/receiving signal of the second antenna element pattern 2021 according to this embodiment.

The grounding pattern 2022 is formed by etching an electrically conductive pattern on a surface of the dielectric substrate 2011, which surface is opposite to the surface on which the antenna element patterns 2021 are formed.

The grounding pattern 2022 is formed on the side of the distributor 2023 and the connector 2024 away from and on the surface opposite to the pentagon shaped antenna element patterns 2021.

The connector 2024 is for connecting to a coaxial cable, and includes a signal-line connection section 2041 and a grounding conductor connection section 2042.

The signal-line connection section 2041 of the connector 2024 is connected to the distributor 2023 through an electric conduction pattern 2051.

The grounding conductor connection section 2042 of the connector 2024 is connected to the grounding pattern 2022.

In addition, although two antenna element patterns 2021 are connected by the distributor 2023 in this embodiment, three or more antenna element patterns 2021 can be connected by providing two or more steps of distributors 2023.

The First Modification

Figure 45:
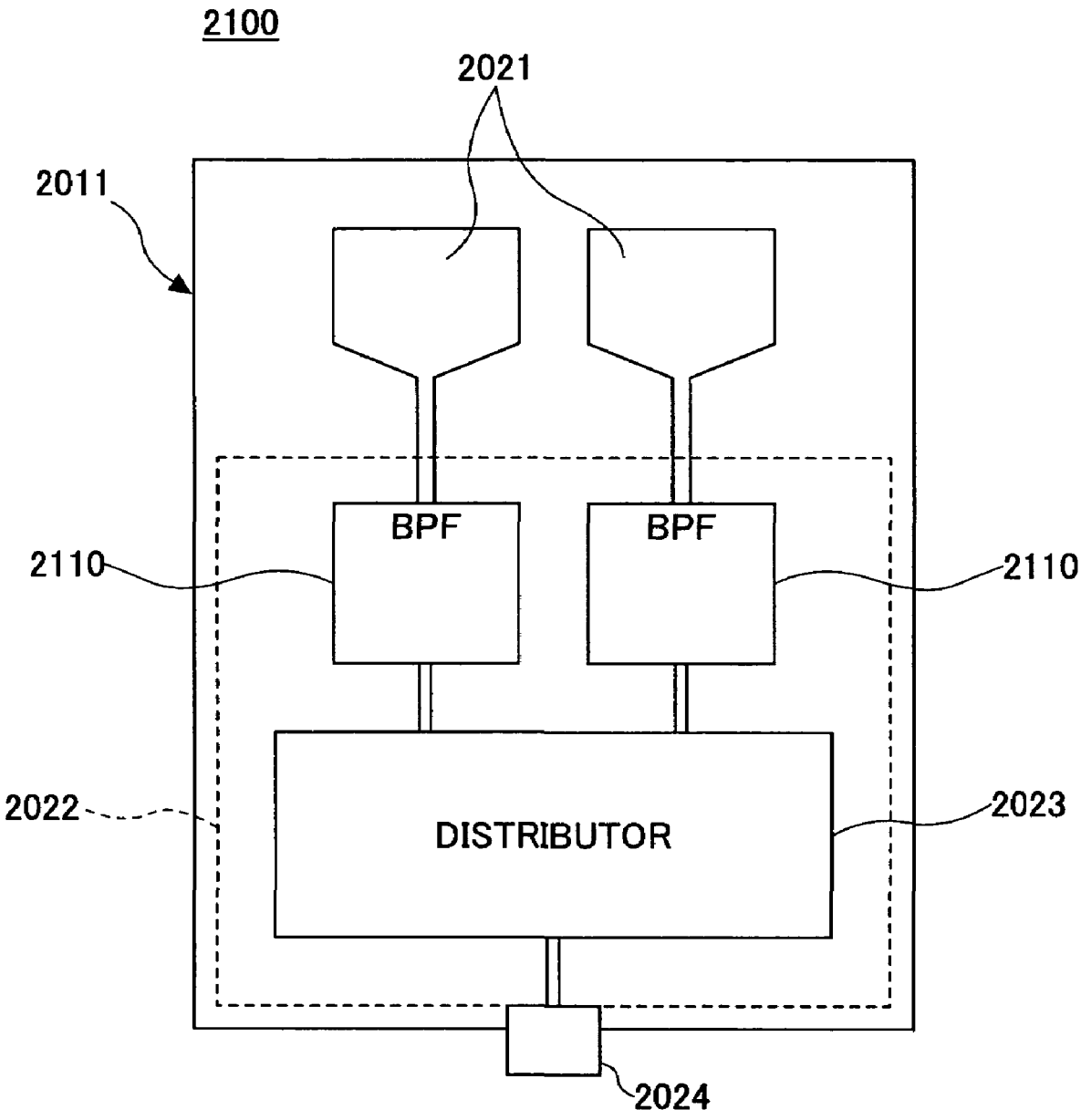
FIG. 45 is a plan view of the first modification of the 16th embodiment.
Figure 46:
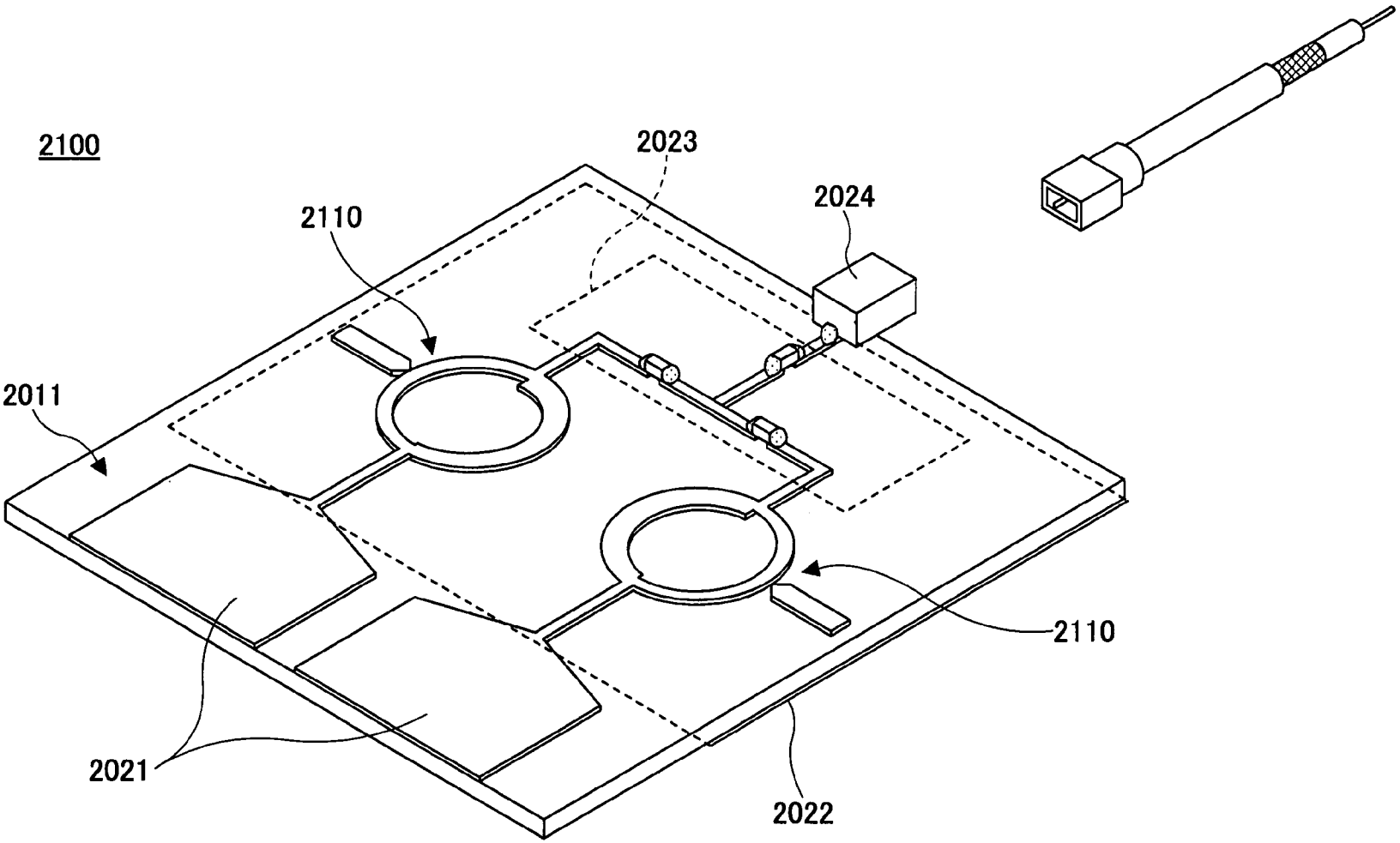
FIG. 46 is a perspective view of the first modification of the 16th embodiment.

FIG. 45 gives a plan view of the first modification of the 16th embodiment of the present invention, and FIG. 46 is a perspective diagram of the first modification of the 16th embodiment of the present invention.

Where items in FIGS. 45 and 46 are the same as those shown in FIGS. 42 and 43, the same reference numbers are given, and the explanations thereof are not repeated.

The antenna apparatus 2100 of the first modification includes a filter circuit 2110 between each of the antenna element patterns 2021 and the distributor 2023.

Each filter circuit 2110 is constituted by a ring filter with a stub such as shown in FIG. 3 and FIG. 4, or a chip capacitor, a chip inductor, and a chip resistor.

In addition, frequency characteristics of the filter circuits 2110 are set for the corresponding antenna element patterns 2021 according to transmitting/receiving frequency, that is, the frequency characteristics of one filter circuit 2110 may be the same as or different from those of another filter circuit 2110.

Further, an attenuator may be provided to each of the antenna element patterns 2021.

The Second Modification

Figure 47:
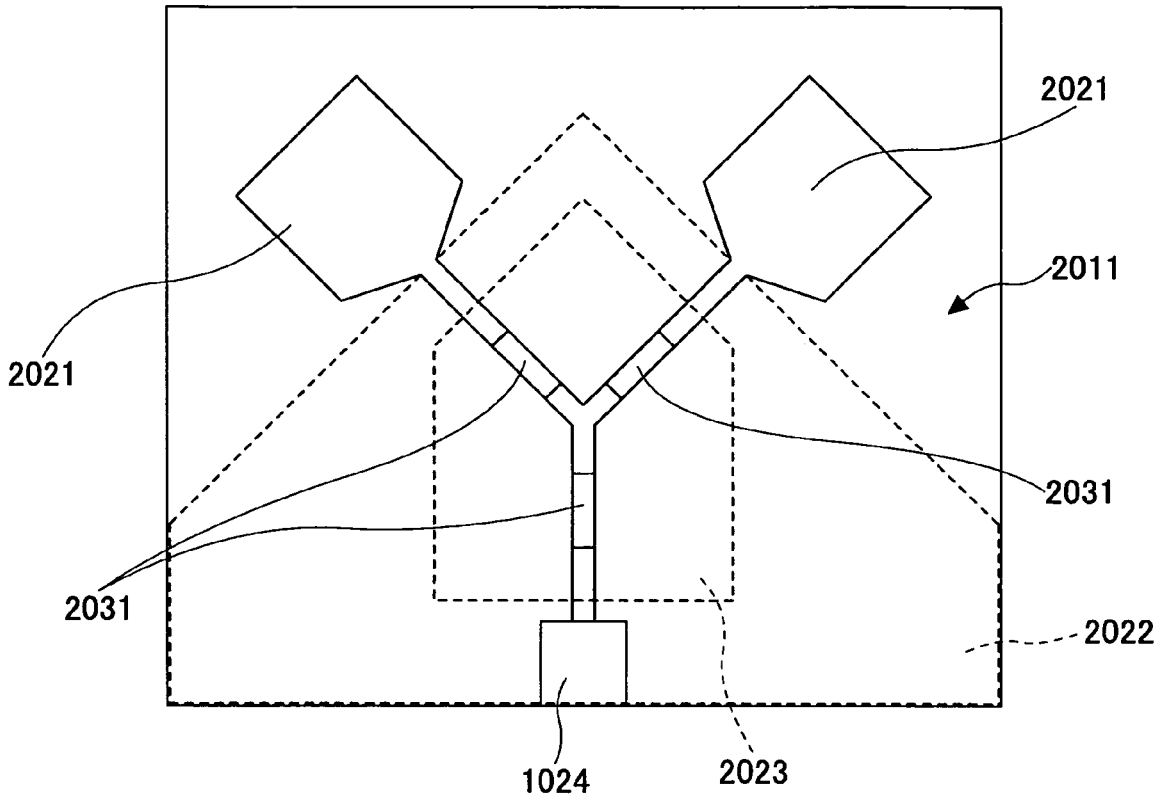
FIG. 47 is a plan view of the second modification of the 16th embodiment.

FIG. 47 is a plan view of the second modification of the 16th embodiment of the present invention.

Where items in FIG. 47 are the same as those shown in FIGS. 42 and 43, the same reference numbers are given, and the explanations thereof are not repeated.

The antenna element patterns 2021 of this modification are extended in different directions.

In an example shown in FIG. 47, the first antenna element pattern 2021 and the second antenna element pattern 2021 intersect at an angle of 90°.

Figure 48:
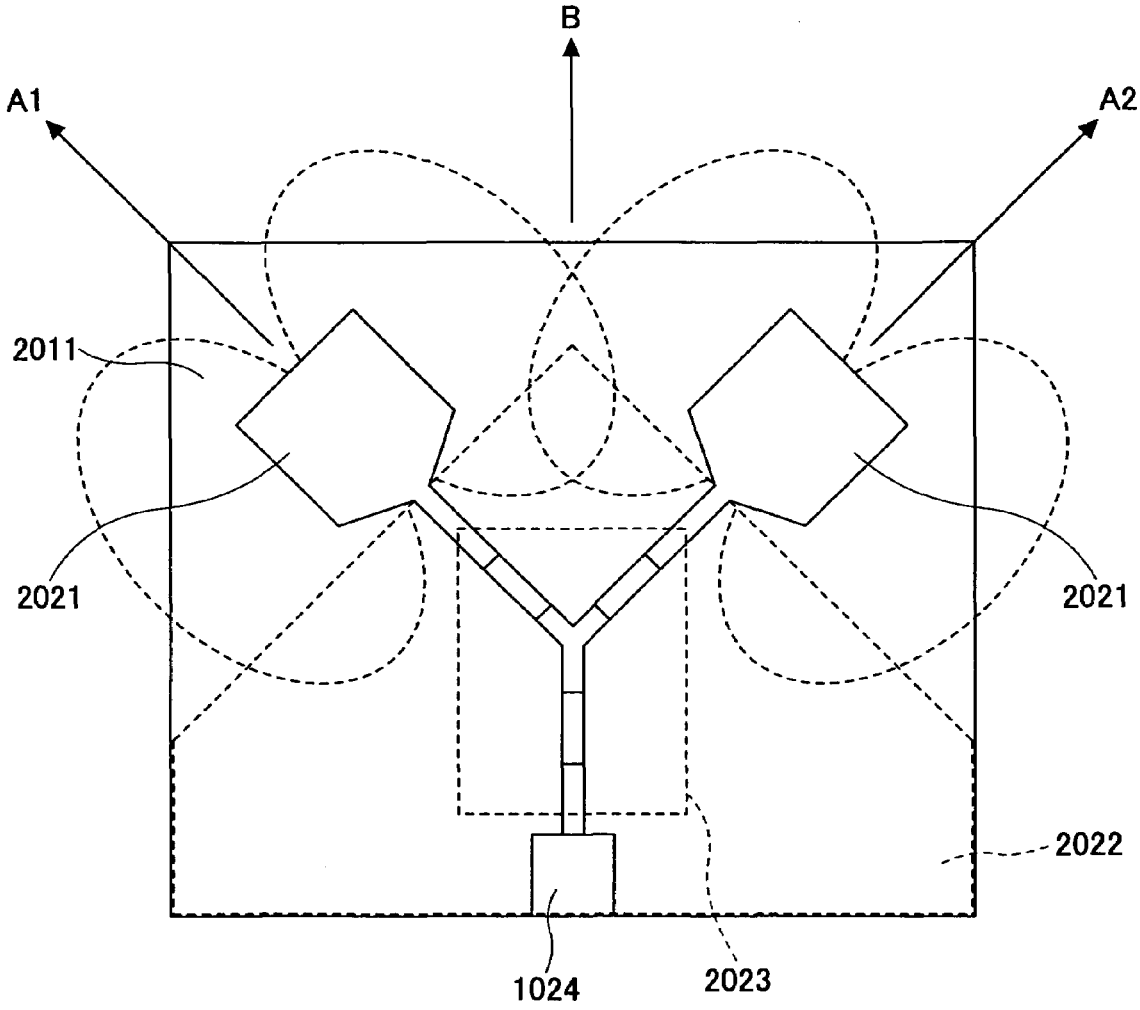
FIG. 48 is a plan view of the second modification of the 16th embodiment for explaining operations.

FIG. 48 is a plan view of the second modification of the 16th embodiment of the present invention for describing operations.

As shown in FIG. 48, since the antenna element patterns 2021 have corresponding null points of power distribution in front directions shown by arrows A1 and A2, they generate a null point of power distribution in a front direction shown by an arrow B by arranging the extending directions to be different as shown in FIG. 48.

Accordingly, the antenna front is clearly identified, and installation of the antenna is facilitated.

The Third Modification

Figure 49:
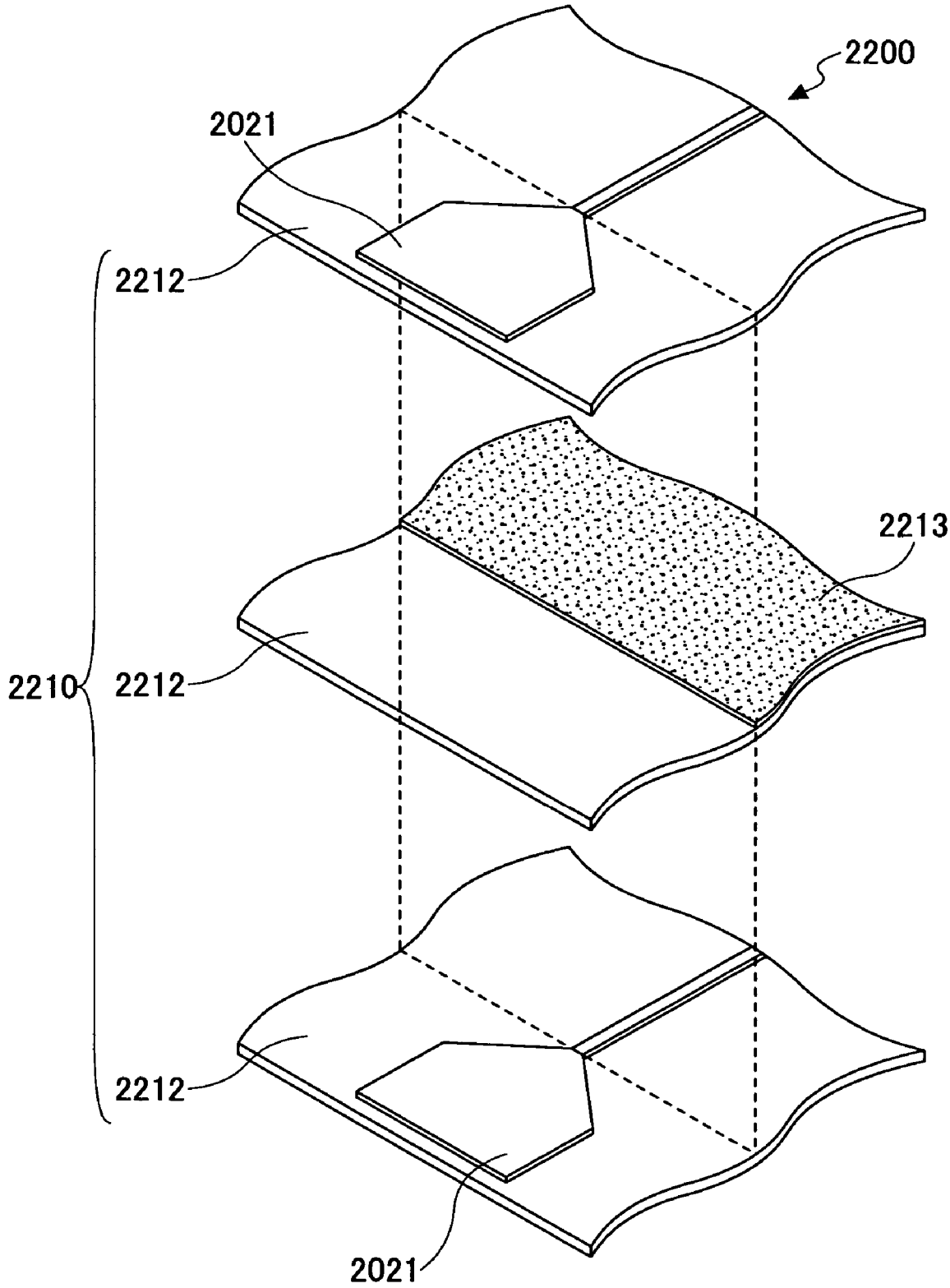
FIG. 49 is a perspective view of the third modification of the 16th embodiment.

FIG. 49 is a perspective diagram of the third modification of the 16th embodiment of the present invention.

Where items in FIG. 49 are the same as those shown in FIG. 42 and FIG. 43, the same reference numbers are given, and the explanations thereof are not repeated.

An antenna apparatus 2200 according to this modification includes a dielectric substrate 2210 that is constituted by two or more dielectric layers 2212 that are laminated. Therein, a grounding pattern 2213 is sandwiched by antenna element patterns 2021.

Since, according to this embodiment, the antenna element patterns 2021 are laminated, the dielectric substrate 2210 can be miniaturized, and therefore, the antenna apparatus 2200 can be miniaturized.

Further, the antenna element patterns 2021 may be arranged so that their extending directions are different from each other as shown in FIG. 47.

Others

Further, although the first through the 15th embodiments are described with the super-wide band flat antenna elements, such as UWB, the description is for example only; the antenna element pattern may be constituted by a narrow-band or a wide-band flat antenna element.

Furthermore, although the feed line to the antenna element pattern is constituted by a strip line formed on the dielectric substrate surface, it can be constituted by a strip line surrounded by the grounding pattern.

Figure 50:
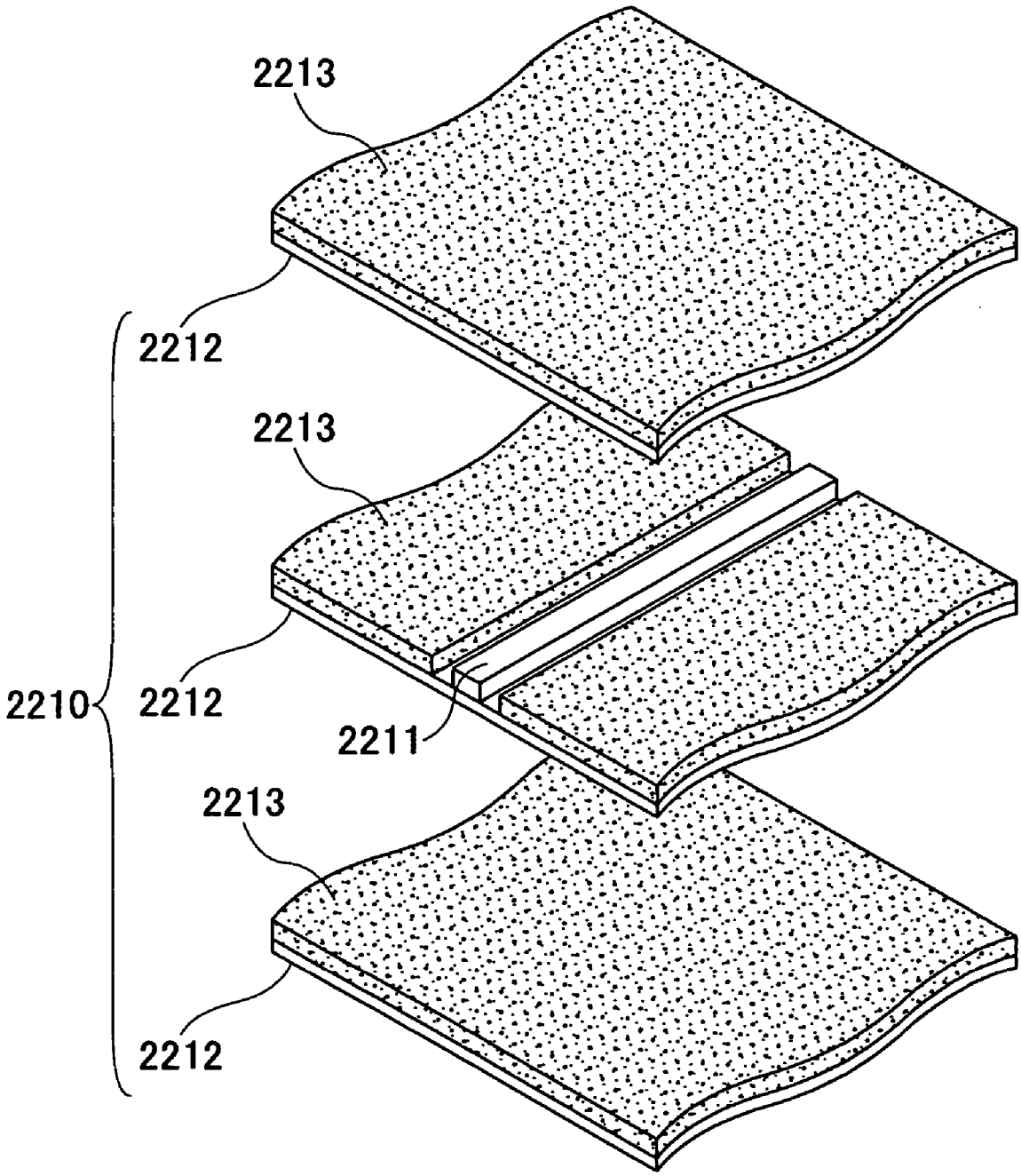
FIG. 50 is a perspective view of a modification of a strip line.

FIG. 50 is a perspective drawing showing a modification of the strip line.

Here, the dielectric substrate 2210 includes two or more dielectric layers 2212 that are laminated as shown in FIG. 50. The strip line 2211 is provided in a middle dielectric layer, both sides of the strip line being surrounded by a grounding pattern 2213. Further, the middle dielectric layer is sandwiched by an upper and a lower dielectric layers, to which other grounding patterns 2213 are formed.

The 17th Embodiment

Further, an antenna element pattern may be formed on the surface of a polyhedron made of dielectric material.

Figure 51A:
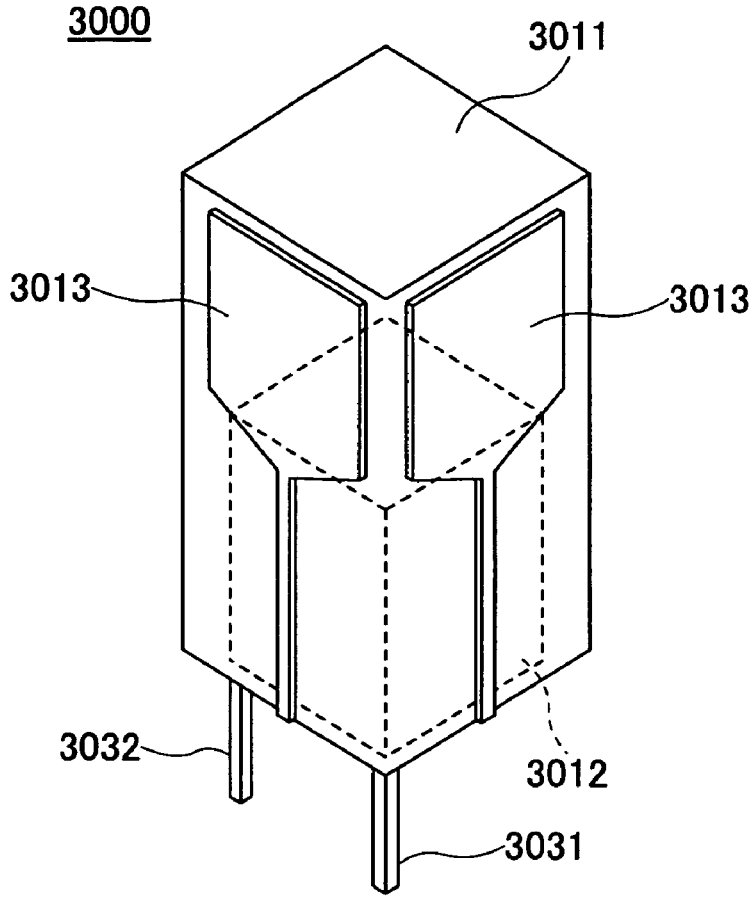
FIG. 51 is a perspective view of the 17th embodiment of the present invention.
Figure 51B:
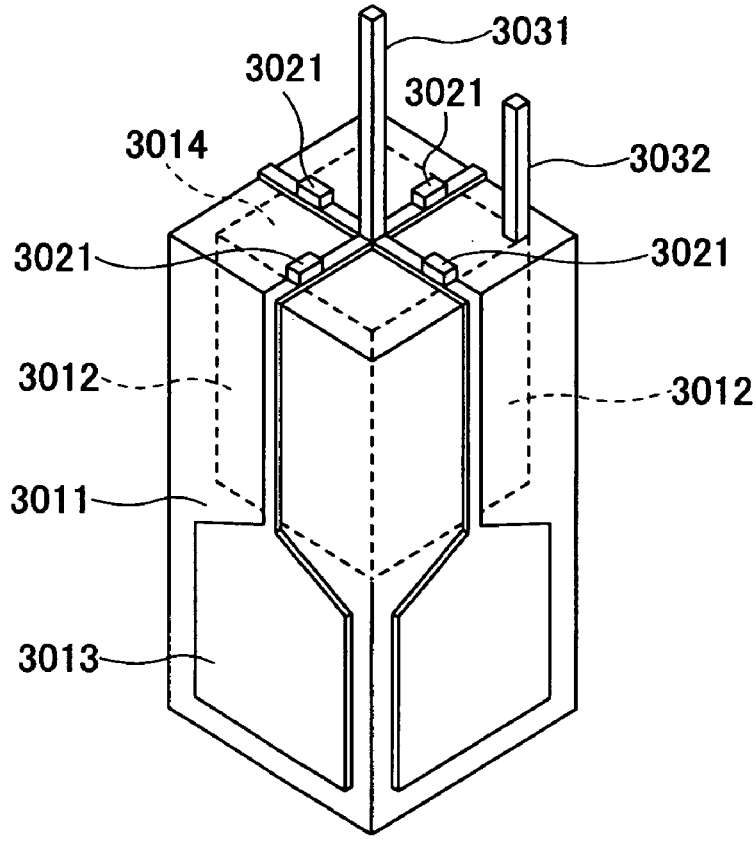

FIGS. 51A and 51B are perspective diagrams of the 17th embodiment of the present invention.

An antenna apparatus 3000 of this embodiment includes a metal section 3011, a dielectric section 3012, two or more antenna element patterns 3013, and a distributor 3014.

The metal section 3011 is made of a metal material in the shape of a square pole, and is grounded.

An end of the dielectric section 3012 is surrounded by the circumference of the metal section 3011 and the other end is extended from the tip of the metal section 3011 in the shape of the square pole, the dielectric section 3012 being sintered.

The antenna element pattern 3013 is formed in a portion extended from the four sides of the dielectric section 3012 on the metal section 3011.

The antenna element pattern 3013 is made into the same form as the antenna element pattern 2021, etc. described above.

The distributor 3014 is constituted by chip resistors 3021 carried at the bottom of the dielectric section 3012, is prepared between the antenna element patterns 3013 and a signal terminal 3031, and distributes a signal of the signal terminal 3031 to the antenna element patterns 3013.

In addition, the distributors 3014 may be the rat race type hybrid circuit such as shown in FIG. 44A, or alternatively, the branch line type hybrid circuit such as shown in FIG. 44B.

In addition, the metal section 3011 is connected to a grounding terminal 3032.

The grounding terminal 3032 is extended from the bottom of the dielectric section 3012, and is grounded.

Here, although this embodiment is described using the shape of a square pole, this is for example only; other N-sided prisms (N being an integer 3 or greater) may be used.

Further, the shape is not limited to a prism, but rather, other shapes such as multiple cone and polyhedron may be used.

Further, the antenna element patterns 3013 may be provided in inclined positions.

In this way, the null point of power distribution can be abolished.

Further, the present invention is not limited to these embodiments, but variations and modifications may be made without departing from the scope of the present invention.

The present application is based on Japanese Priority Applications No. 2005-160286 filed on May 31, 2005, and No. 2006-031242 filed on Feb. 8, 2006 with the Japanese Patent Office, the entire contents of which are hereby incorporated by reference.

What is claimed is:

1. The antenna apparatus comprising:

a dielectric substrate;

an antenna element pattern formed on the dielectric substrate;

a feed line connected to the antenna element pattern; and a filter inserted into the feed line wherein the filter is constituted by a distributed constant circuit formed by an electrically conductive pattern of a ring filter having a stub arranged at a middle part of the feed line.

2. The antenna apparatus as claimed in claim 1, wherein the feed line is structured by one of a strip line and a microstrip line.

3. The antenna apparatus as claimed in claim 1, wherein the dielectric substrate is made of a material that is flexible.

4. The antenna apparatus as claimed in claim 1, further comprising:

one of a narrow-band antenna apparatus and a wideband antenna apparatus.

5. An antenna apparatus, comprising:

a dielectric substrate;

an antenna element pattern formed on the dielectric substrate;

a feed line formed on the dielectric substrate, and connected to the antenna element pattern;

a filter inserted into the feed line; and a signal level adjustment unit for adjusting a signal level on the feed line, the signal level adjustment unit being inserted into the feed line, wherein the filter is placed on a surface, of the dielectric substrate, opposed to another surface on which a grounding pattern is placed, and the filter includes a ring filter having a stub arranged at a middle part of the feed line.

6. The antenna apparatus as claimed in claim 5, wherein the signal level adjustment unit is one of an attenuator and an amplifying circuit.

7. The antenna apparatus as claimed in claim 6, wherein the feed line is constituted by one of a strip line and a microstrip line.

8. The antenna apparatus as claimed in claim 5, wherein the dielectric substrate is made of a material that is flexible.

9. The antenna apparatus as claimed in claim 5, further comprising:

one of a narrow-band antenna apparatus and a wideband antenna apparatus.

10. An antenna apparatus, comprising:

a dielectric substrate;

an antenna element pattern formed on the dielectric substrate;

a grounding pattern;

a feed line connected to the antenna element pattern; and a connector including a signal line connection unit to connect an end of a signal line to the feed line, and a grounding conductor connected to the grounding pattern, wherein another end of the signal line is connected to a transceiver unit and the connector is a surface mount connector, and wherein the surface mount connector is connected to the grounding pattern via a through via formed in the dielectric substrate.

11. An antenna apparatus, comprising:

a dielectric substrate;

an antenna element pattern formed on the dielectric substrate;

a grounding pattern;

a feed line connected to the antenna element pattern; and a connector including a signal line connection unit to connect an end of a signal line to the feed line, and a grounding conductor connected to the grounding pattern, wherein another end of the signal line is connected to a transceiver unit and the connector is a surface mount connector, and wherein the dielectric substrate consists of a material that is flexible, and the surface mount connector is connected to the grounding pattern by turning up a part of the dielectric substrate.

12. An antenna apparatus, comprising:

a dielectric substrate;

an antenna element pattern formed on the dielectric substrate;

a grounding pattern;

a feed line connected to the antenna element pattern;

a connector including a signal line connection unit to connect an end of a signal line to the feed line, and a grounding conductor connected to the grounding pattern, wherein another end of the signal line is connected to a transceiver unit; and one of a narrow-band antenna apparatus and a wideband antenna apparatus.

13. An antenna apparatus comprising:

a dielectric substrate;

an antenna element pattern formed on the dielectric substrate;

a grounding pattern formed on the dielectric substrate;

a feed line connected to the antenna element pattern; and a coaxial cable including a signal line connected to the feed line and a grounding conductor connected to the grounding pattern, wherein the grounding conductor of the coaxial cable is connected to the grounding pattern via a through via formed in the dielectric substrate.

14. The antenna apparatus as claimed in claim 13, further comprising:

one of a narrow-band antenna apparatus and a wideband antenna apparatus.

15. An antenna apparatus comprising:

a dielectric substrate;

an antenna element pattern formed on the dielectric substrate;

a grounding pattern formed on the dielectric substrate;

a feed line connected to the antenna element pattern; and a coaxial cable including a signal line connected to the feed line and a grounding conductor connected to the grounding pattern, wherein:

the dielectric substrate consists of a material that is flexible, and the grounding conductor of the coaxial cable is connected to a part of the grounding pattern which part becomes on the same surface as the feed line by partially folding the dielectric substrate.

16. The antenna apparatus as claimed in claim 15, further comprising:

one of a narrow-band antenna apparatus and a wideband antenna apparatus.

17. An antenna apparatus, comprising:

a dielectric substrate;

a balanced feed type antenna element pattern formed on the dielectric substrate;

a balanced feed line formed on the dielectric substrate for supplying electric power to the balanced feed type antenna element pattern; and a filter connected to the balanced feed line, wherein the filter is constituted by a stub that extends from a point of the balanced feed line to outside in a first direction, and is bent in a second direction at a point of the stub.

18. The antenna apparatus as claimed in claim 17, wherein the dielectric substrate consists of a material that is flexible.

19. The antenna apparatus as claimed in claim 17, further comprising:

one of a narrow-band antenna apparatus and a wideband antenna apparatus.

20. An antenna apparatus, comprising:

a dielectric substrate;

a plurality of antenna element patterns formed on the dielectric substrate;

a feed line connected to the antenna element pattern; and a distributor connecting the antenna element patterns and the feed line wherein the antenna element patterns are arranged in mutually different directions.

21. The antenna apparatus as claimed in claim 20, wherein the distributor includes a power distributor.

22. The antenna apparatus as claimed in claim 20, wherein the distributor includes a rat race type hybrid circuit.

23. The antenna apparatus as claimed in claim 20, wherein the distributor includes a branch line type hybrid circuit.

24. The antenna apparatus as claimed in claim 20, wherein the antenna element patterns are formed in a shape that enables UWB communications.

25. An antenna apparatus, antenna apparatus, comprising:

a dielectric substrate;

a plurality of antenna element patterns formed on the dielectric substrate;

a feed line connected to the antenna element pattern; and a distributor connecting the antenna element patterns and the feed line wherein a filter circuit is provided between the antenna element patterns and the distributor.

26. The antenna apparatus as claimed in claim 25, wherein the distributor includes a power distributor.

27. The antenna apparatus as claimed in claim 25, wherein the distributor includes a rat race type hybrid circuit.

28. The antenna apparatus as claimed in claim 25, wherein the distributor includes a branch line type hybrid circuit.

29. The antenna apparatus as claimed in claim 25, wherein the antenna element patterns are formed in a shape that enables UWB communications.

30. An antenna apparatus, comprising:

a dielectric section;

a plurality of antenna element patterns formed on surfaces of the dielectric section;

a feed line connected to the antenna element pattern; a distributor connecting the antenna element patterns and the feed line, wherein the dielectric section is formed in the shape of a prism and each of the antenna element patterns is formed on a different side of the dielectric section.

31. The antenna apparatus as claimed in claim 30, wherein the distributor is formed at a bottom of the dielectric section.

* * * * *

UNITED STATES PATENT AND TRADEMARK OFFICE

CERTIFICATE OF CORRECTION

PATENT NO. : 7,423,594 B2
APPLICATION NO. : 11/402867
DATED : September 9, 2008
INVENTOR(S) : Masahiro Yanagi et al.

It is certified that error appears in the above-identified patent and that said Letters Patent is hereby corrected as shown below:

Column 19, Line 6, after “apparatus” insert --,--.

Column 19, Line 21, after “apparatus” insert --,--.

Column 20, Line 22, after “An antenna apparatus” delete “antenna apparatus,”.

Signed and Sealed this

Thirty-first Day of March, 2009

John Doll

JOHN DOLL
*Acting Director of the United States Patent and Trademark Office*